US011952774B1

(12) United States Patent
Asiala, Jr. et al.

(10) Patent No.: US 11,952,774 B1
(45) Date of Patent: Apr. 9, 2024

(54) TOP ADJUSTABLE TEMPORARY WALL SYSTEM

(71) Applicant: Signature Wall Solutions, Inc., Midland, MI (US)

(72) Inventors: Wiljo E. Asiala, Jr., Midland, MI (US); Kenneth Staten, Clare, MI (US); Zachary E. Cesa, Midland, MI (US)

(73) Assignee: Signature Wall Solutions, Inc., Midland, MI (US)

( * ) Notice: Subject to any disclaimer, the term of this patent is extended or adjusted under 35 U.S.C. 154(b) by 0 days.

(21) Appl. No.: 18/472,321

(22) Filed: Sep. 22, 2023

Related U.S. Application Data

(60) Provisional application No. 63/431,344, filed on Dec. 9, 2022, provisional application No. 63/409,796, filed on Sep. 25, 2022.

(51) Int. Cl.
*E04B 2/82* (2006.01)
*E04B 2/74* (2006.01)

(52) U.S. Cl.
CPC ..... *E04B 2/827* (2013.01); *E04B 2/7405* (2013.01); *E04B 2002/7487* (2013.01)

(58) Field of Classification Search
CPC ..... E04B 2/827; E04B 2/7405; E04B 2002/7487; E04B 2002/0204; E04B 2002/0243; E04B 2002/0247
See application file for complete search history.

(56) References Cited

U.S. PATENT DOCUMENTS 5,375,641 A * 12/1994 Schlueter ..... G09F 15/0068 160/231.1
8,839,592 B2 9/2014 Foran
10,041,249 B1 8/2018 Hebert et al.
10,329,760 B2 6/2019 Harber et al.
11,441,309 B1 * 9/2022 Asiala, Jr. ..... E04C 2/292
2021/0238845 A1 8/2021 Bickford et al.

FOREIGN PATENT DOCUMENTS

IT MI20121496 A1 3/2014

OTHER PUBLICATIONS

STARC System RealWall™ Basic Panel Assembly—YouTube <https://www.youtube.com/watch?v=VXTfaxp5ldw>.
International Search Report and Written Opinion dated Dec. 7, 2023 in corresponding PCT Application No. PCT/US2023/033571. 11 pages.

* cited by examiner

*Primary Examiner* — Patrick J Maestri
(74) *Attorney, Agent, or Firm* — Harness, Dickey & Pierce, P.L.C.

(57) ABSTRACT

An extendable wall panel assembly includes a first wall panel and a first core that includes a first and second surface. A first edge joiner comprises a first male extension extending therefrom. A second edge joiner has a first female receiver disposed therein. A second wall panel is slidably coupled to the first and second wall panels and has a second core. A third edge joiner extends between a third surface and a fourth surface and has a second male extension extending therefrom. A fourth edge joiner has a second female receiver disposed therein. A coupling mechanism has a first channel disposed in the first wall panel receiving a first clamp bar therein. A first fastener receiver is coupled to the second wall panel and a fastener extend through the first fastener receiver and into the first clamp bar in the first channel.

23 Claims, 40 Drawing Sheets

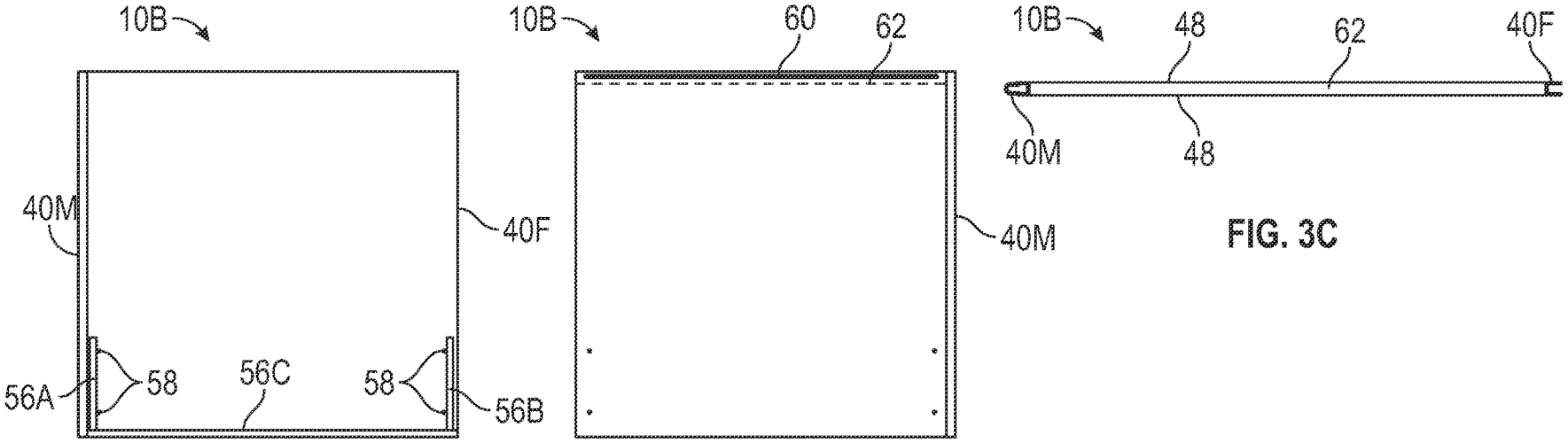
FIG. 3A
FIG. 3B
FIG. 3C
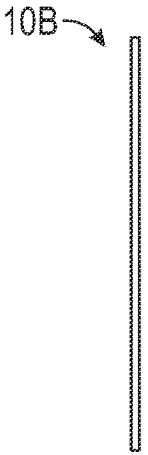
FIG. 3D

TOP ADJUSTABLE TEMPORARY WALL SYSTEM

CROSS-REFERENCE TO RELATED APPLICATION

This application is non-provisional application of U.S. Provisional Application No. 63/409,796, filed on Sep. 25, 2022, and U.S. Provisional Application No. 63/431,344, filed on Dec. 9, 2022. The entire disclosures of the above application are incorporated herein by reference.

FIELD

The present disclosure relates generally to wall systems and, more particularly, to wall systems that have panels that are vertically adjustable.

BACKGROUND

Temporary wall systems have been in use for many years for various purposes. Sometimes temporary walls are constructed from studs and drywall, then destroyed when done. Temporary wall systems may be used to separate an area under construction from an area being used. The temporary wall systems separate dirt and noise associated with a construction area from the portions of the structure that are still in use. Temporary wall systems can also be used to reduce the amount of floor area heated and cooled in a larger structure, while allowing expansion when needed.

Reusable temporary walls are used in many industries to reduce waste and cost. Reusable wall systems are easily installed and disassembled so they can be moved to a different location for reuse. Reusable temporary wall systems are typically formed at standard heights such as 8 feet. However, the known reusable temporary wall systems are incorporated into structures that have ceilings that vary in height. The tops of the reusable temporary walls may therefore not extend to the full ceiling height. An unfinished look and a gap to allow dust and noise from a work zone on the other side of the wall to reach the non-working side.

SUMMARY

The ability to provide a simplistic wall system that is aesthetically pleasing while providing a seal to prevent dust and dirt contamination is desirable.

In one aspect of the disclosure, an extendable wall panel assembly includes a first wall panel and a first core comprising a first surface and a second surface opposite the first surface. A first edge joiner extends between the first surface and the second surface. The first edge joiner comprises a first male extension extending therefrom. A second edge joiner extends between the first surface and the second surface parallel to the first edge joiner. The second edge joiner has a first female receiver disposed therein. A second wall panel is slidably coupled to the first wall panel and second wall panel and has a second core comprising a third surface and a fourth surface opposite the third surface. A third edge joiner extends between the third surface and the fourth surface. The third edge joiner has a second male extension extending therefrom. A fourth edge joiner extends between the third surface and the fourth surface parallel to the third edge joiner. The fourth edge joiner has a second female receiver disposed therein. A coupling mechanism has a first channel disposed in the first wall panel receiving a first clamp bar therein. A first fastener receiver is coupled to the second wall panel and a fastener extending through the first fastener receiver and into the first clamp bar in the first channel.

Implementations may include one or more of the following features. The extendable wall panel assembly where the first channel is formed in a slot tube. The first channel is integrally formed with the first edge joiner. The first fastener receiver is integrally formed with the third edge joiner. A third channel is integrally formed with the second edge joiner. The first fastener receiver may include a second channel disposed within the second wall panel. The coupling mechanism further may include a second fastener receiver disposed in the second channel for receiving a second fastener. The first clamp bar receives the first fastener and the second fastener. The first surface may include a first planar skin, the second surface may include a second planar skin, and where the first core is disposed between the first planar skin and the second planar skin. The first planar skin and the second planar skin are composed of polymer. The first core and the second core are composed of a high-density foam. The high-density foam is composed of expanded polystyrene. The first clamp bar may include a rectangular cross section. The first male extension of a first wall panel of the plurality of wall panels is inserted into the first female receiver of a second wall panel of the plurality of wall panels. The first wall panel may include a door disposed therethrough, said second panel may include a first vertical sub-panel portion, a second vertical sub-panel portion and a horizontal sub-panel portion extending between the first vertical sub-panel portion and the second vertical sub-panel portion, where a distance between the first vertical sub-panel portion and the second vertical sub-panel portion is greater than or equal to a width of the door, a plurality of filler panels extending between first vertical sub-panel portion and the second vertical sub-panel portion. The first vertical sub-panel portion may include a first vertical edge channel and the second vertical sub-panel portion may include a second vertical edge channel and a second vertical edge channel. The plurality of filler panels is at least partially received in the first vertical edge channel and the second vertical edge channel. A bottom filler panel is secured to the first vertical edge channel by a first latch secured to the bottom filler panel. A bottom filler panel is secured to the first vertical edge channel by a first latch and a second latch secured to the bottom filler panel.

One general aspect includes an extendable wall panel assembly that also has a first wall panel that includes a first core including a first surface and a second surface opposite the first surface; a first edge joiner extending between the first surface and the second surface, the first edge joiner may include a first male extension extending therefrom; a second edge joiner extending between the first surface and the second surface parallel to the first edge joiner, the second edge joiner may include a first female receiver disposed therein, a first channel receiving a first clamp bar therein; a second channel receiving a second clamp bar therein. The assembly also includes a second wall panel slidably coupled to the first wall panel and second wall panel may include: a second core may include a third surface and a fourth surface opposite the third surface; a third edge joiner extending between the third surface and the fourth surface, the third edge joiner may include a second male extension extending therefrom; a fourth edge joiner extending between the third surface and the fourth surface parallel to the third edge joiner, the fourth edge joiner may include a second female receiver disposed therein; a third channel having a first fastener extending therethrough, said first fastener coupling the first clamp bar within the first channel; and a fourth channel having a second fastener extending therethrough, said second fastener coupling the second clamp bar within the second channel.

Implementations may include one or more of the following features. The extendable wall panel assembly may include a third fastener coupling the first clamp bar within the first channel and a fourth fastener coupling the second clamp bar within the first channel. The first fastener and the third fastener extend into the first channel through a first elongated slot through the first channel. The second fastener and the fourth fastener extend into the second channel through a second elongated slot through the first channel.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations and are not intended to limit the scope of the present disclosure.

Figure 2C:
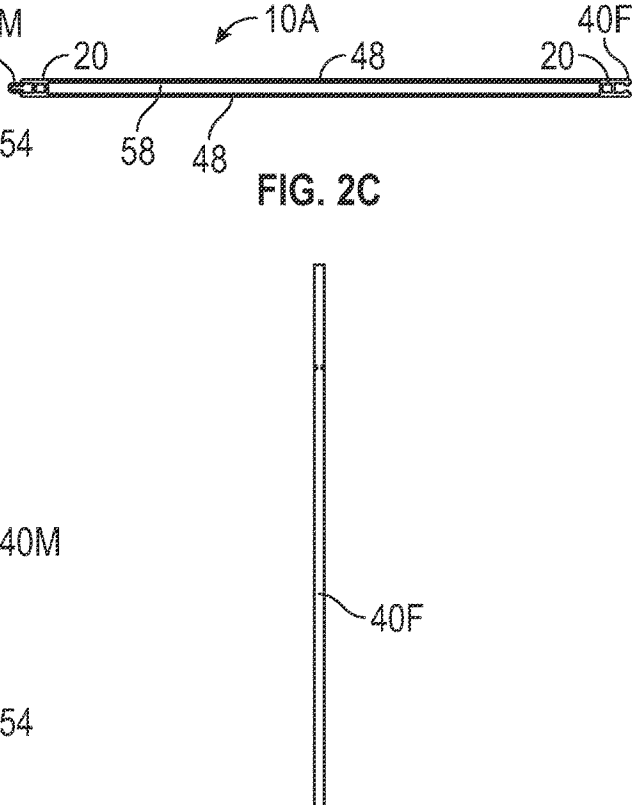
Figure 2D:
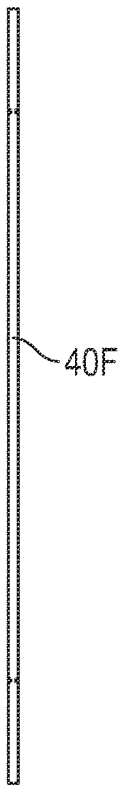
Figure 2B:
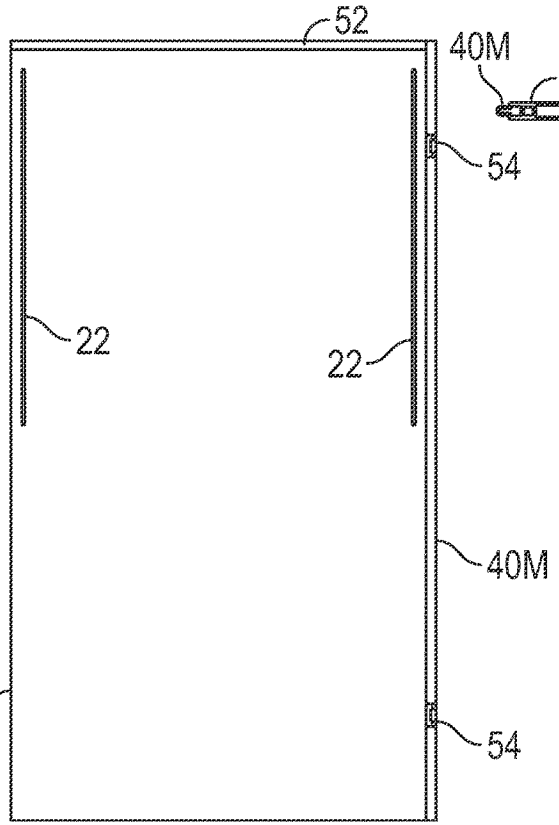
Figure 2A:
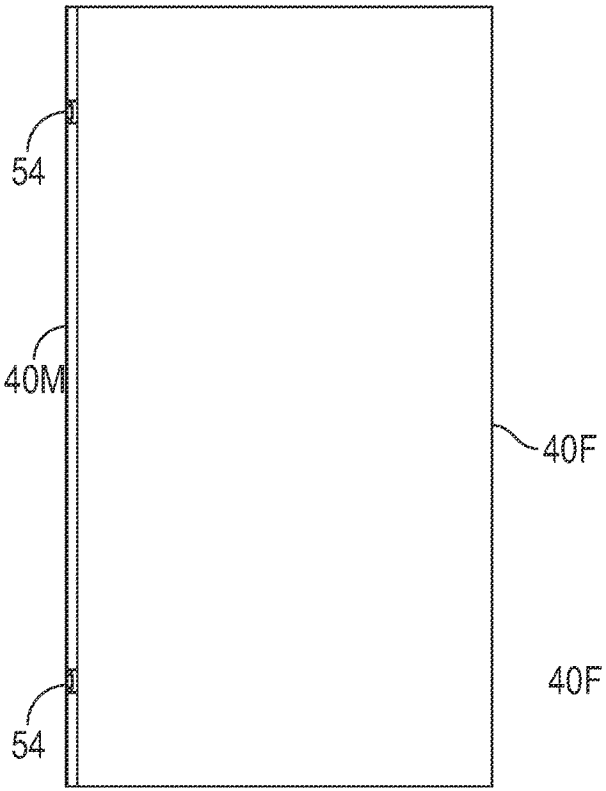

FIG. 2A front view of the of a lower or fixed lower panel.

FIG. 2B rear view of the of the lower or fixed lower panel.

FIG. 2C top view of the of the lower or fixed lower panel.

FIG. 2D right side view of the of the lower or fixed lower panel.

FIG. 3A front view of the of a lower or fixed lower panel.

FIG. 3B rear view of the of the lower or fixed lower panel.

FIG. 3C top view of the of the lower or fixed lower panel.

FIG. 3D right side view of the of the lower or fixed lower panel.

Figure 4A:
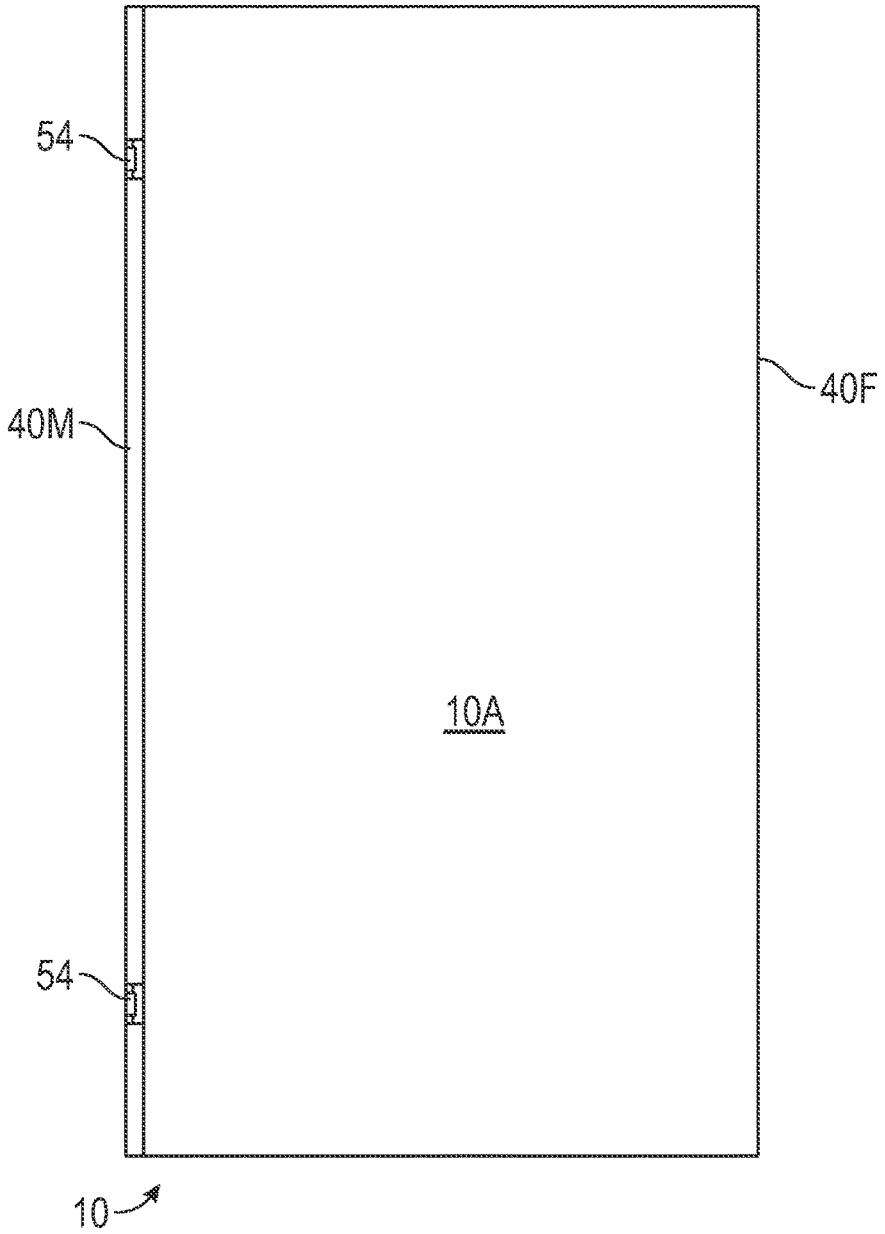

FIG. 4A is a front view of the panel assembly at a minimum height.

Figure 4B:
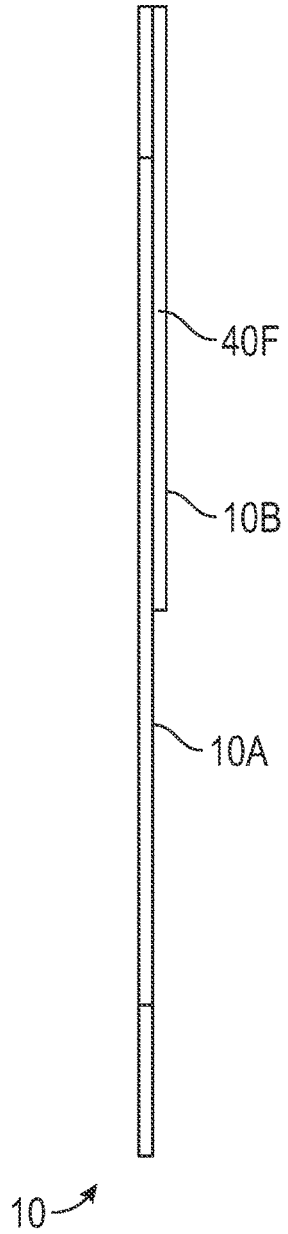

FIG. 4B is a right side view of the panel assembly of FIG. 4A.

Figure 4C:
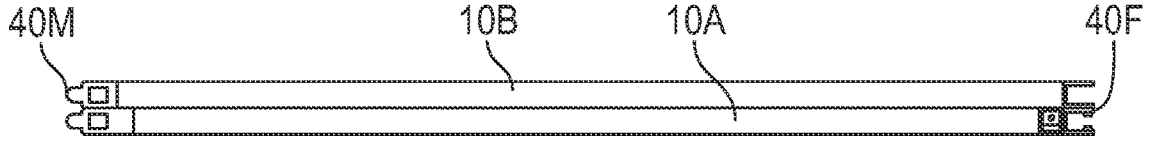

FIG. 4C is a top view of the panel assembly of FIG. 4A.

Figure 4E:
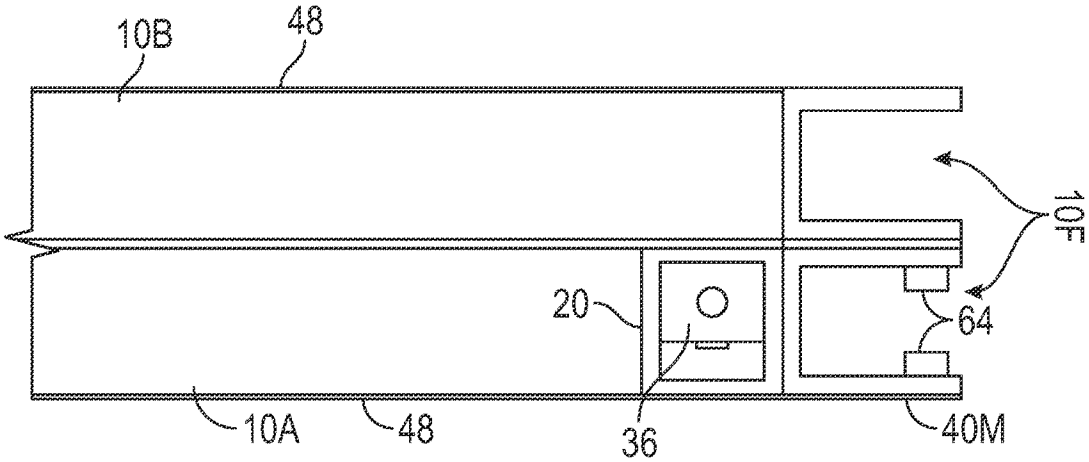
Figure 4D:
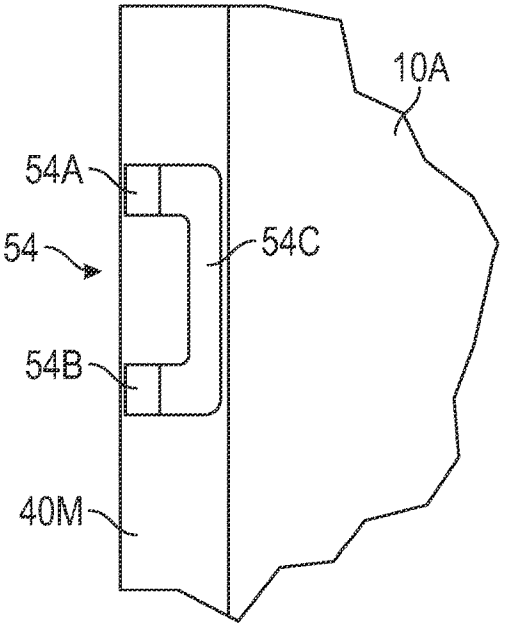

FIG. 4D is an enlarged view of the left side of the panel assembly at the channel opening.

FIG. 4E is an enlarged top view of the right side of the panel assembly.

Figure 4F:
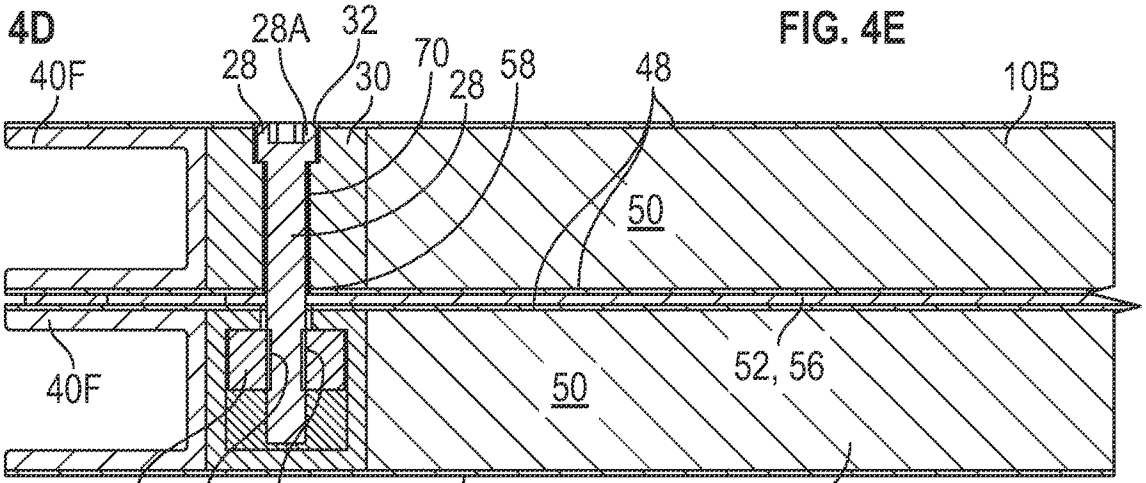

FIG. 4F is an enlarged cross-sectional view of the right side of the panel assembly through a fastener.

Figure 5C:
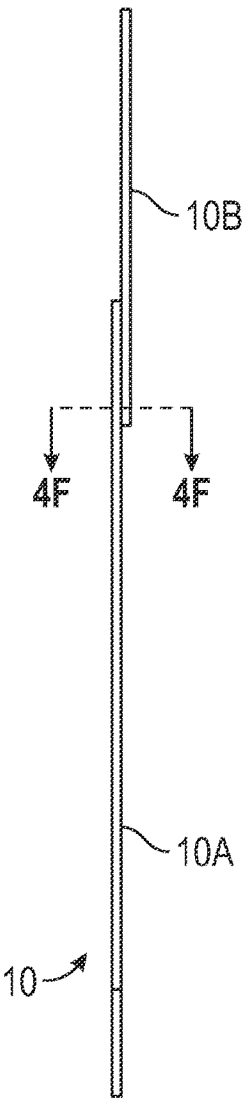
Figure 5B:
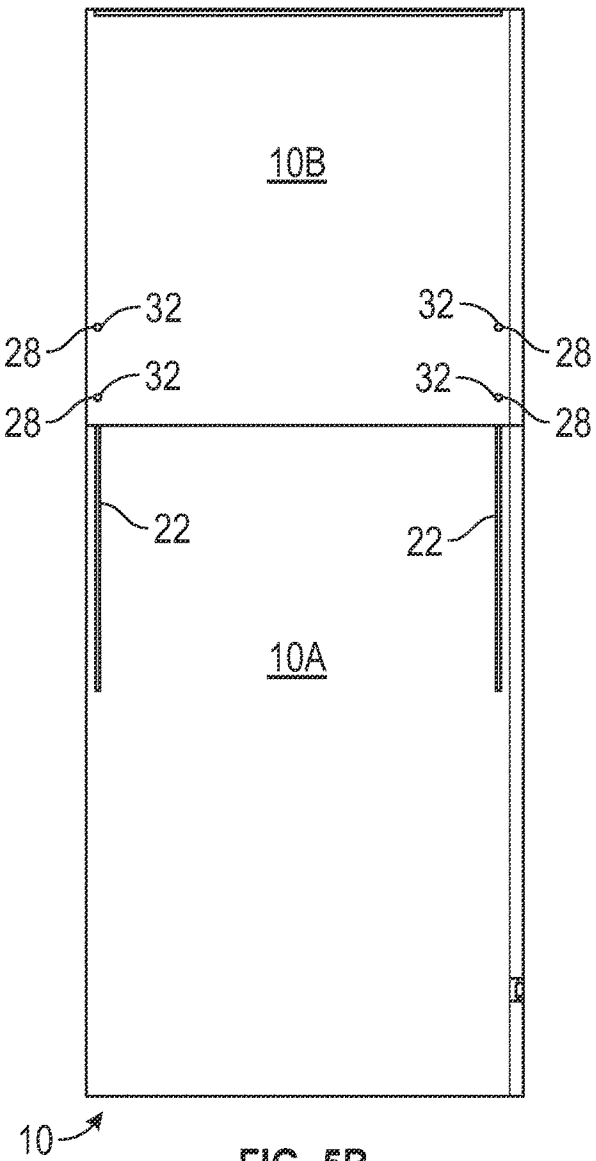
Figure 5A:
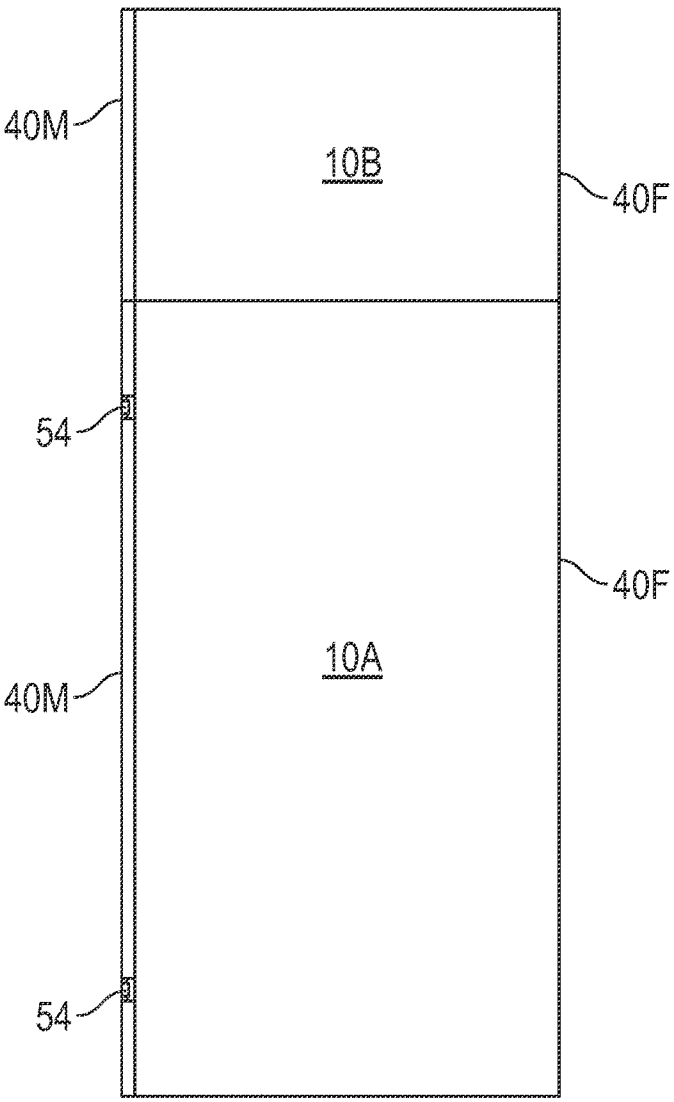

FIG. 5A is a front view of the panel assembly of FIG. 4A in a maximum height position.

FIG. 5B is a rear view of the panel assembly of FIG. 5A.

FIG. 5C is a left side view of the panel assembly of FIG. 5A.

Figure 6B:
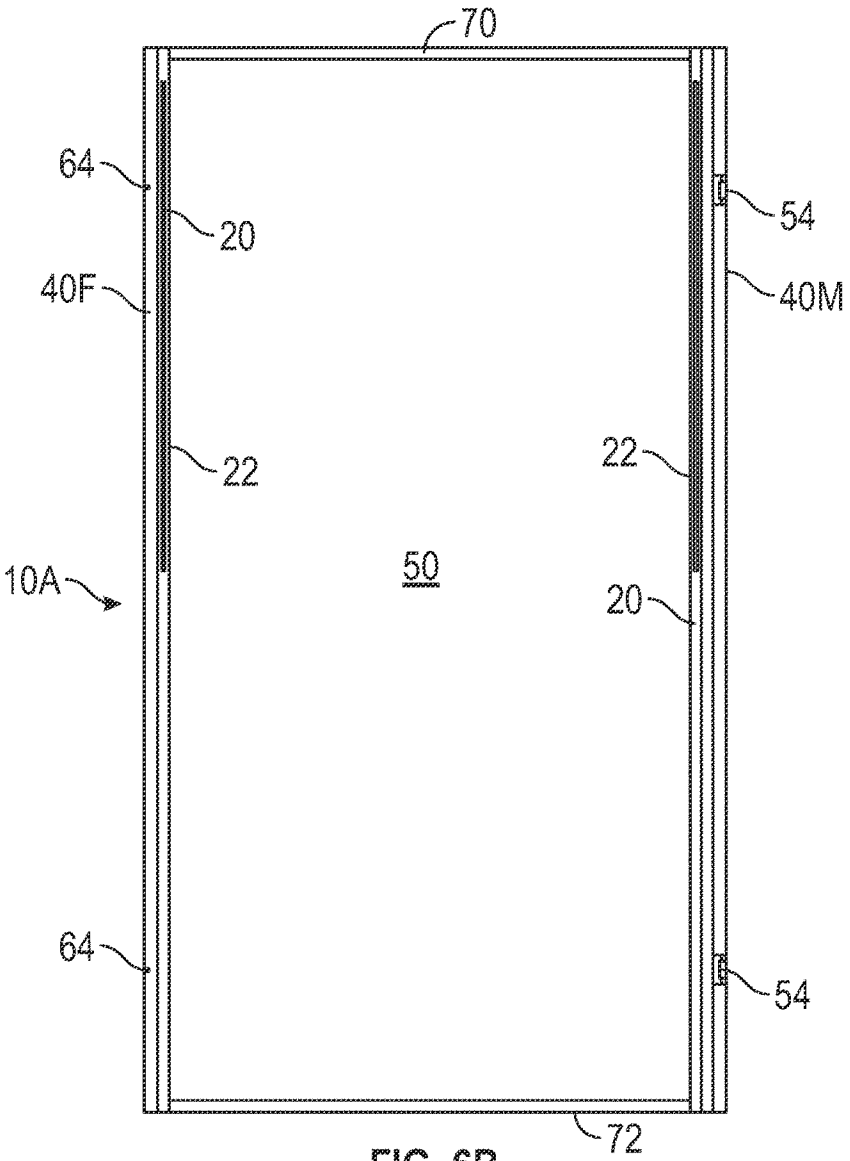
Figure 6A:
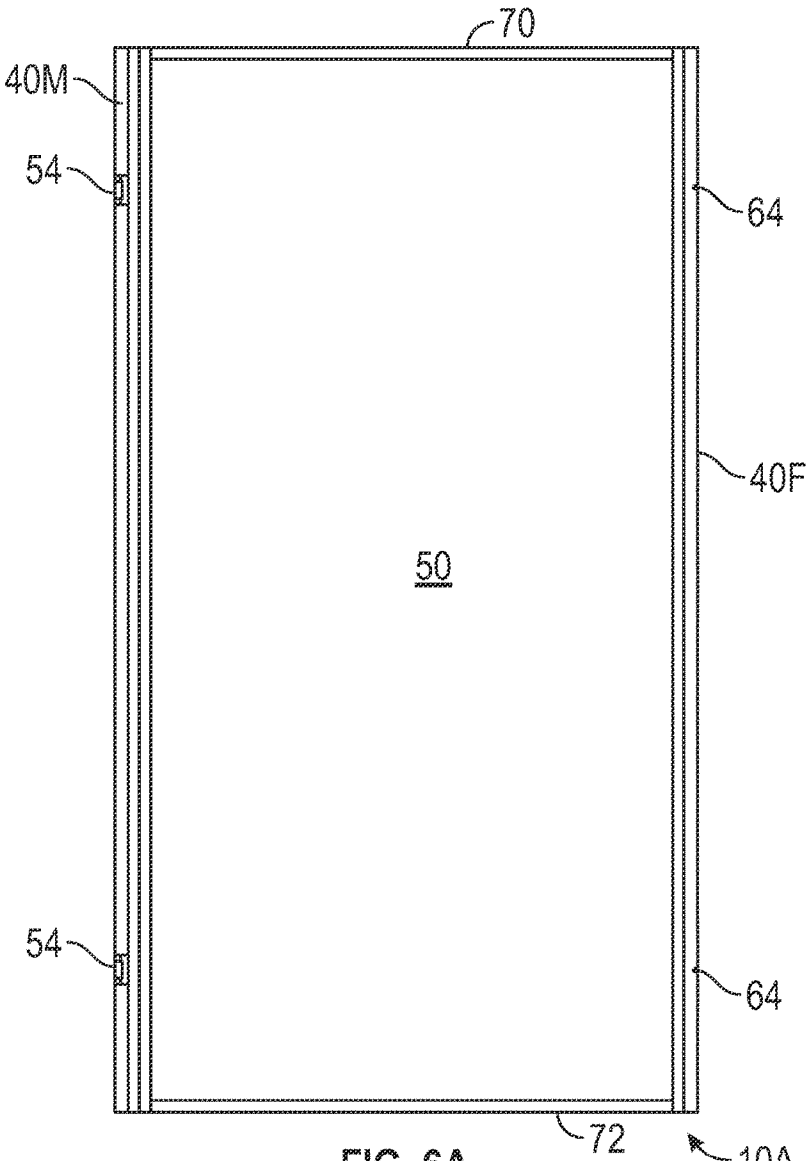

FIG. 6A is a front view of a fixed panel of the panel assembly with the skin removed to reveal the interior structure.

FIG. 6B is a back view of the fixed panel assembly with the skin removed.

Figure 7B:
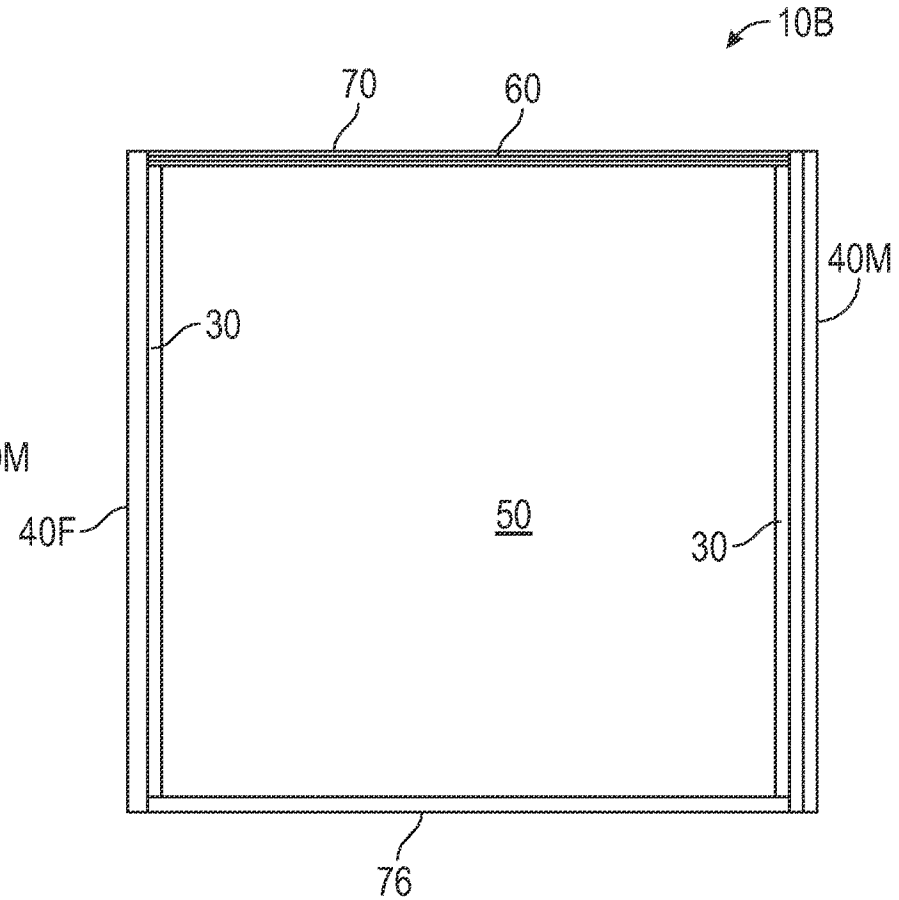
Figure 7A:
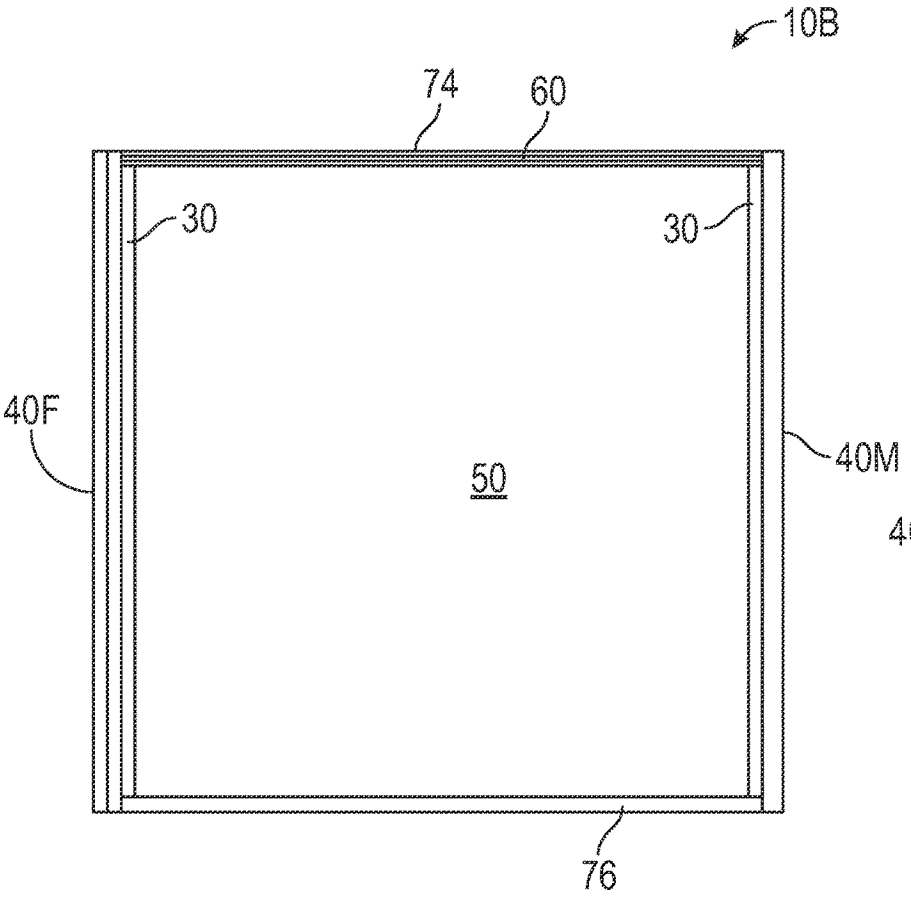

FIG. 7A is a front view of the extendable panel of the panel assembly with the skin removed.

FIG. 7B is rear view of the extendable panel assembly of FIG. 7A.

Figure 8:
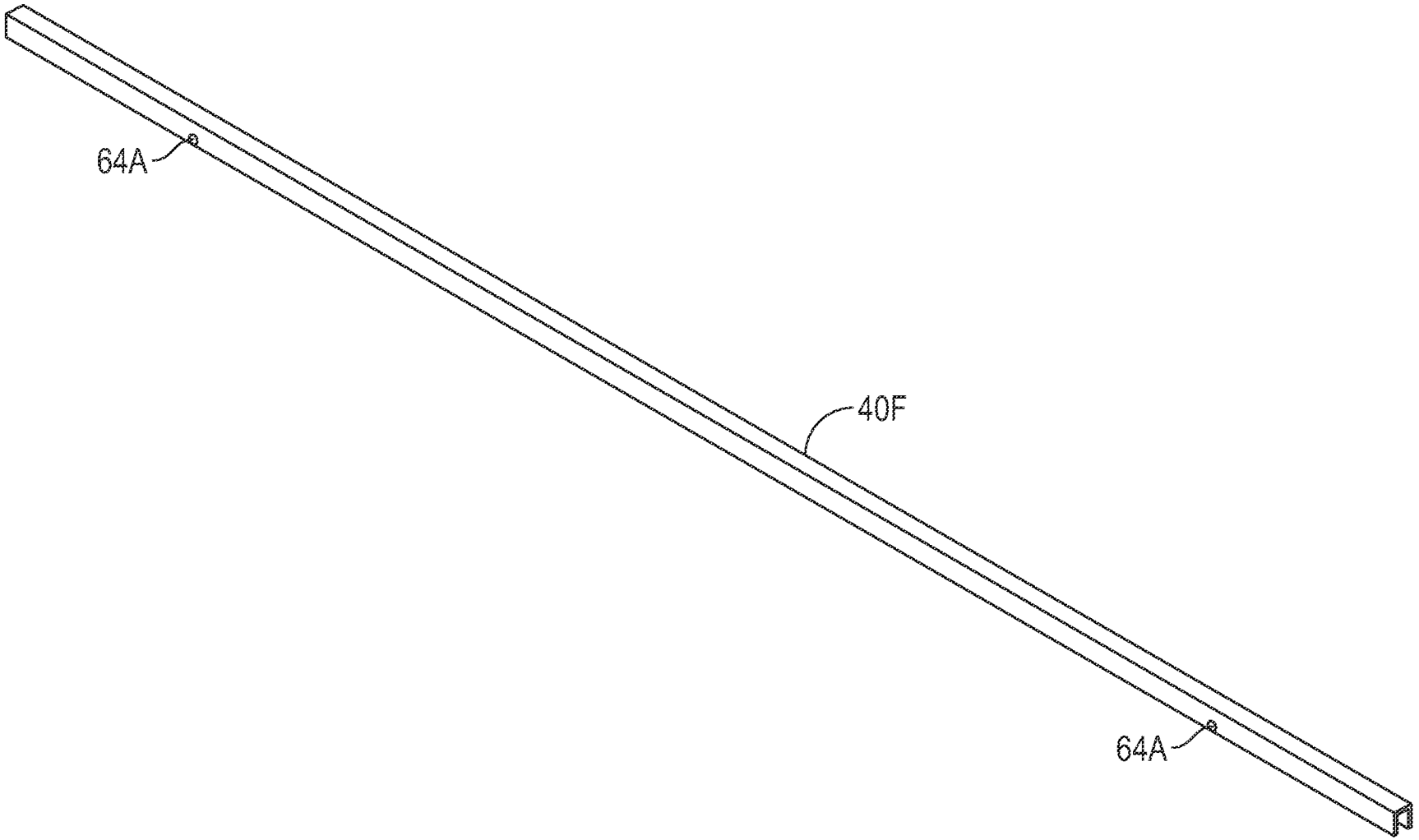

FIG. 8 is a perspective view of the female edge joiner.

Figure 9A:
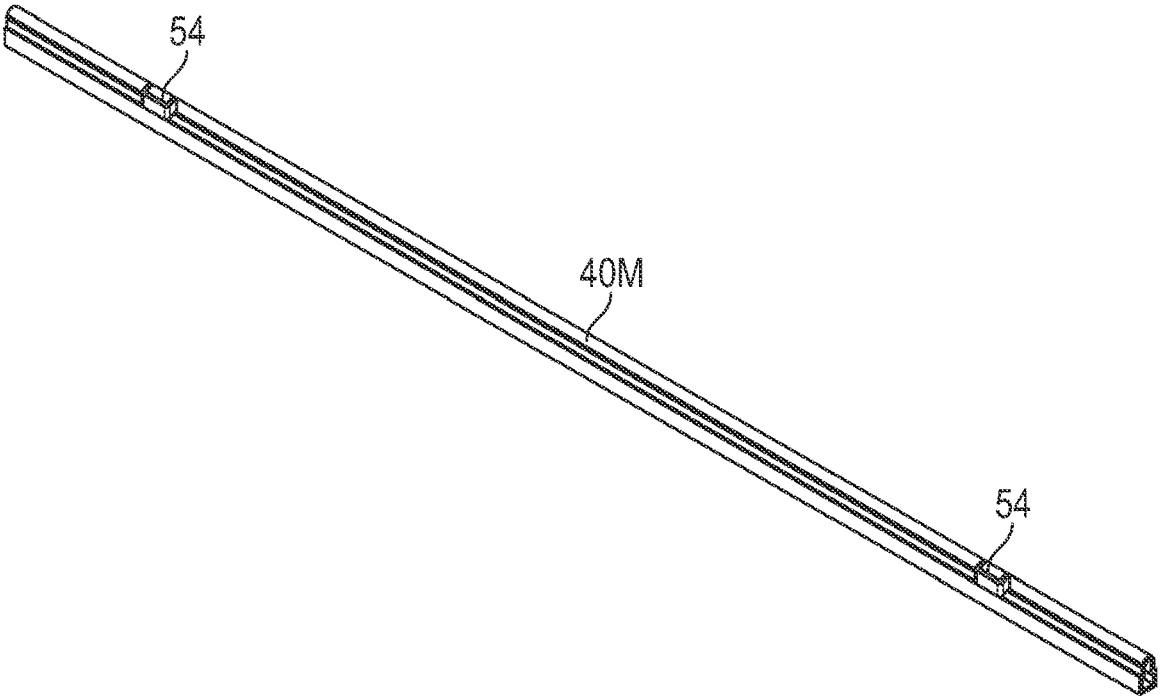

FIG. 9A is a perspective view of the male edge joiner.

Figure 9B:
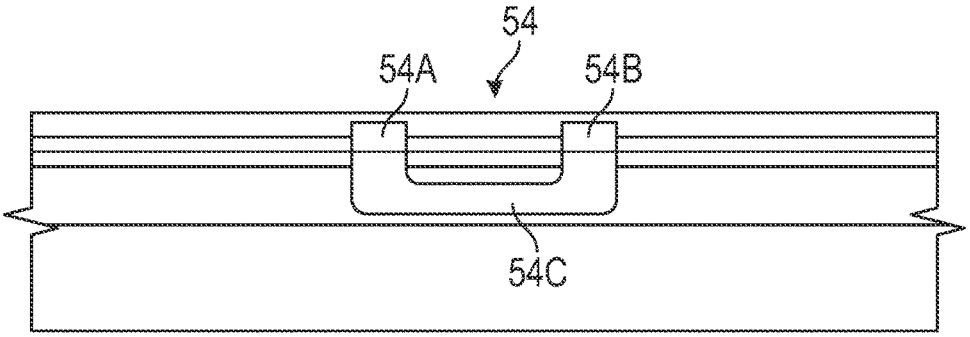

FIG. 9B is a side view of the channel opening 54 of the male edge joiner.

Figure 9C:
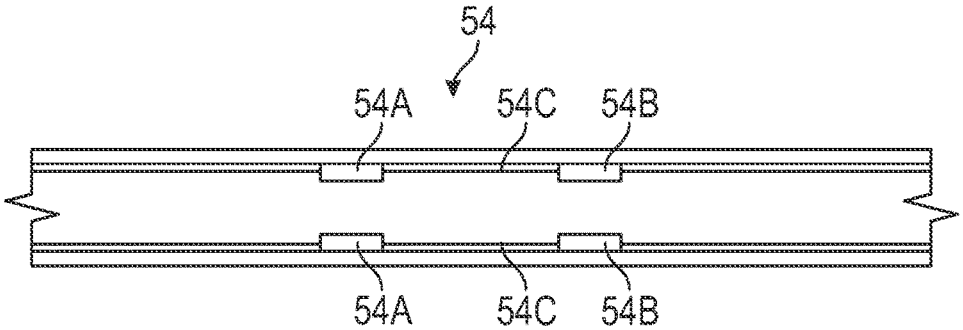

FIG. 9C is an inside view of the male edge joiner illustrating the channel openings 54.

Figure 10:
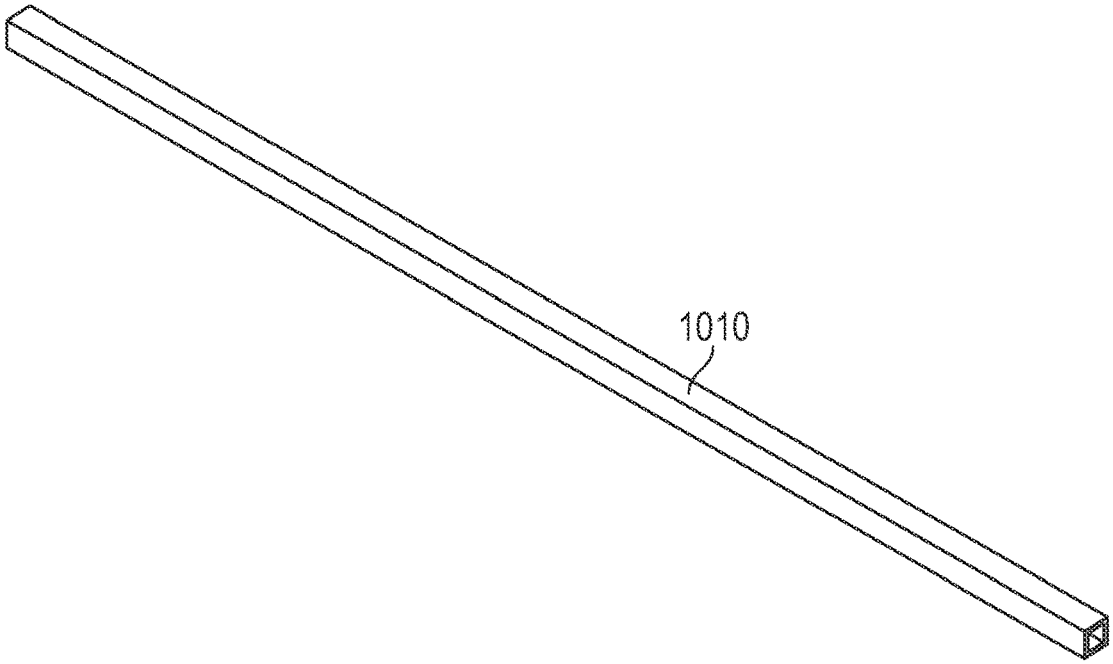

FIG. 10 is a perspective view of an aluminum tube used for top and bottom frame portions.

Figure 11A:
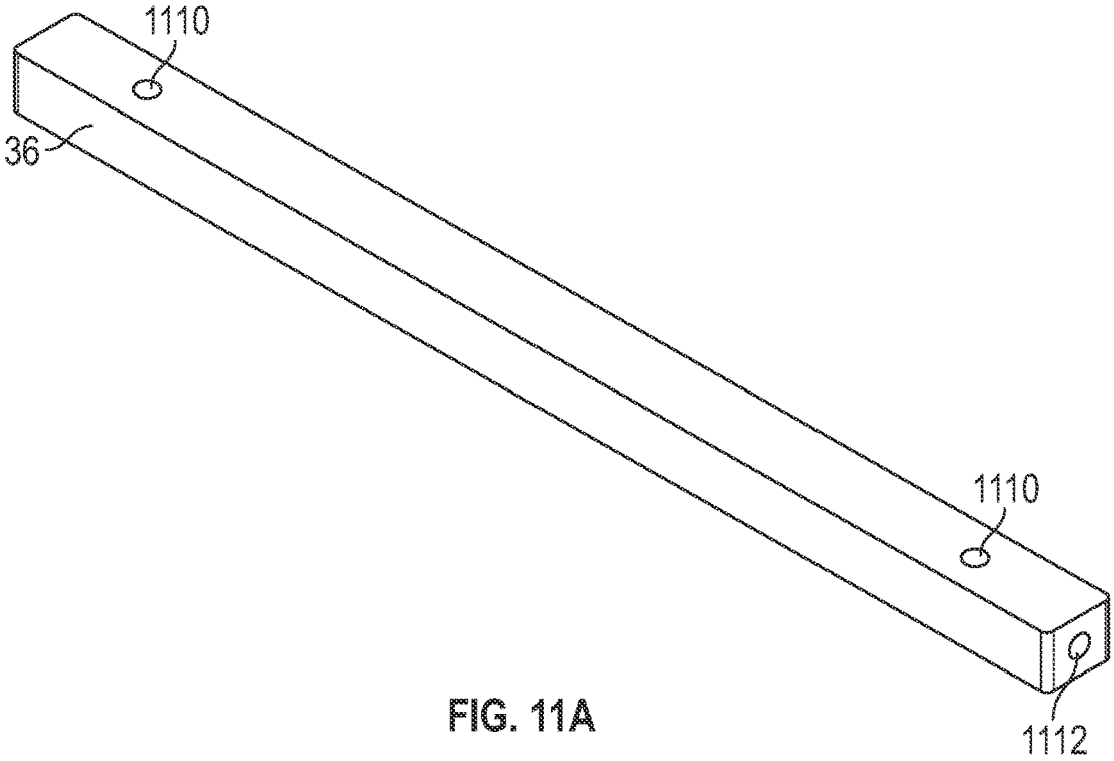

FIG. 11A is a perspective view of a clamp bar.

Figure 11B:
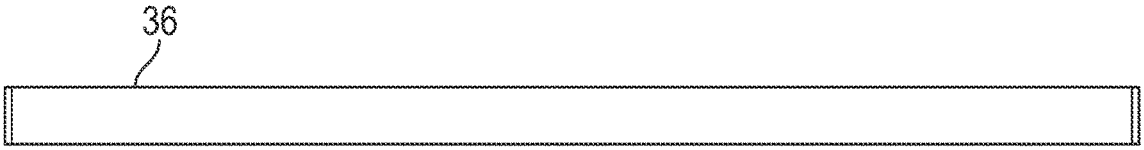

FIG. 11B is a side view of the clamp bar of FIG. 11A.

Figure 11C:
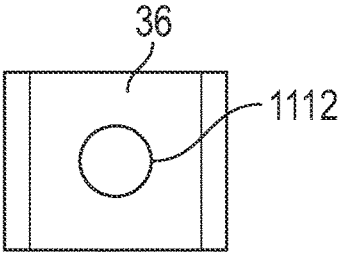

FIG. 11C is an end view of the clamp bar of FIG. 11A.

Figure 11D:
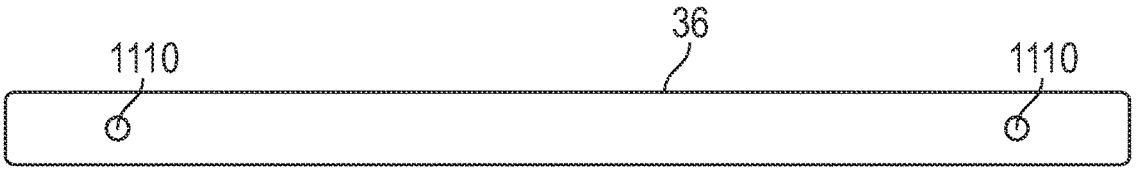

FIG. 11D is a top view of the clamp bar of FIG. 11A.

Figure 12:
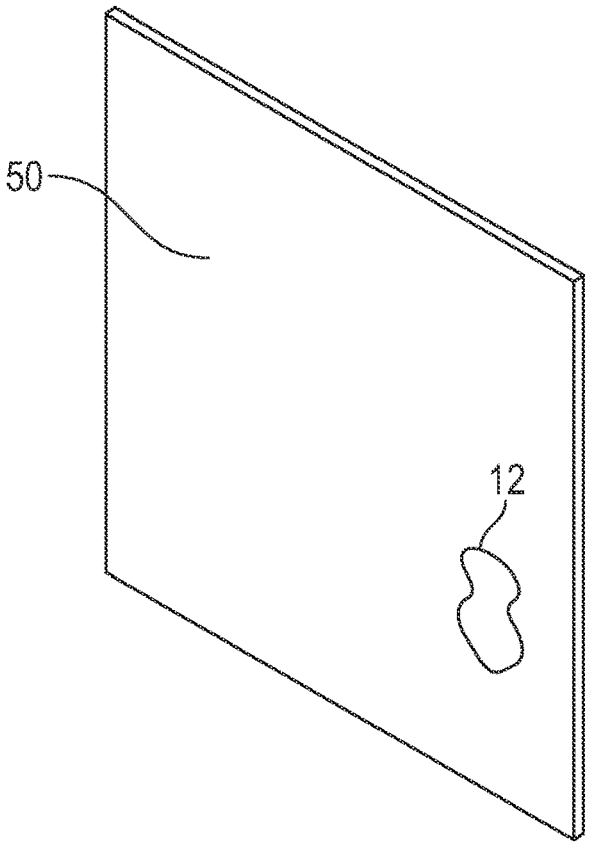

FIG. 12 is a perspective view of the foam or core layer.

Figure 13A:
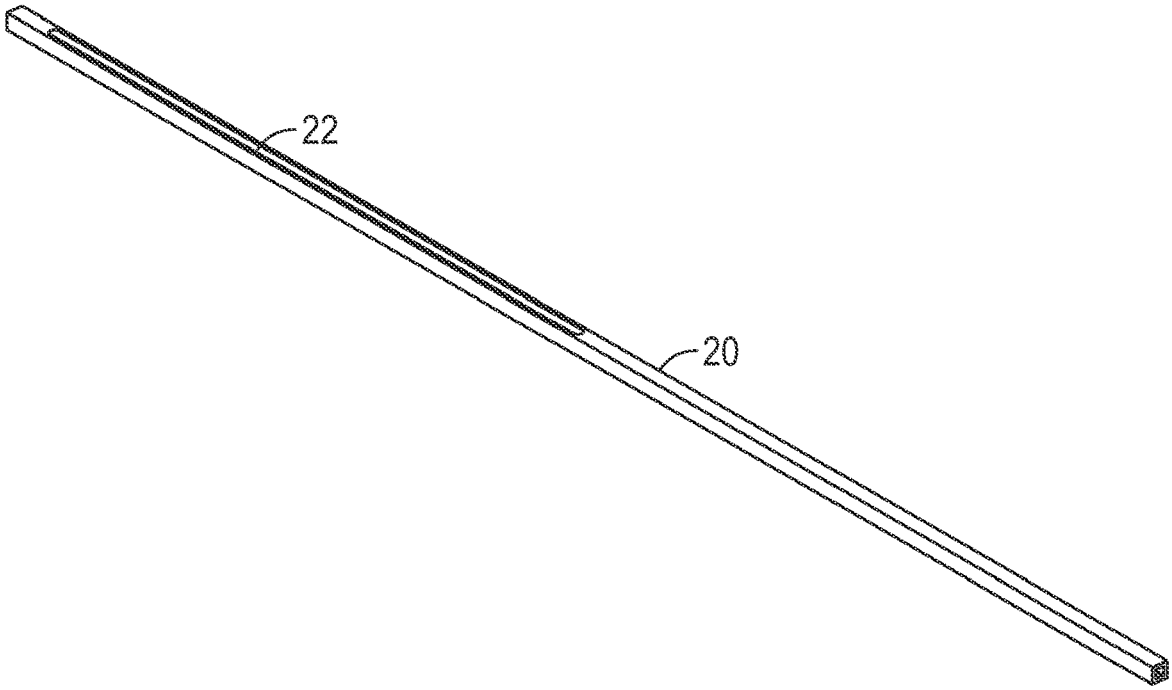

FIG. 13A is a perspective view of the slot tube.

Figure 13B:
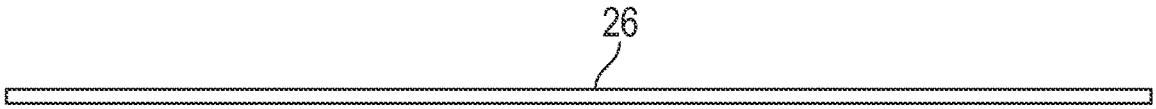

FIG. 13B is a side view of the slot tube of FIG. 13A.

Figure 13C:
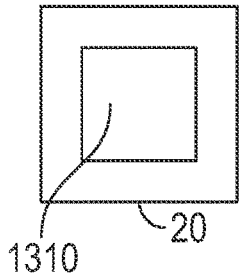

FIG. 13C is an end view of the slot tube of FIG. 13A.

Figure 13D:
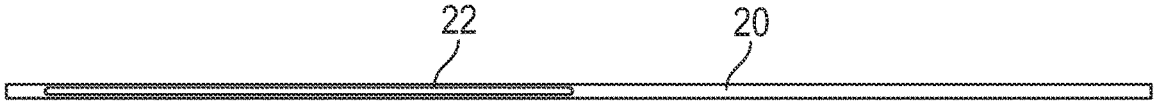

FIG. 13D is a top view of the slot tube of FIG. 13A.

Figure 14A:
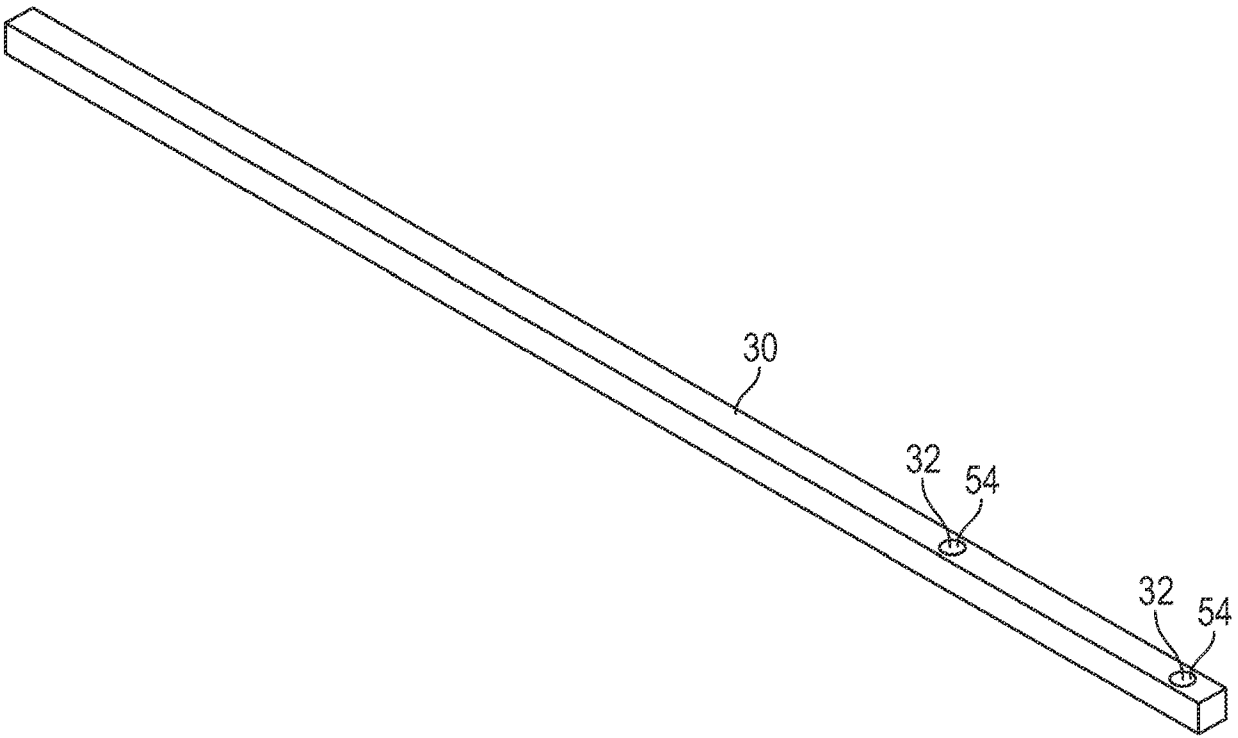

FIG. 14A is a perspective view of the bar and channel openings 54 therethrough.

Figure 14B:
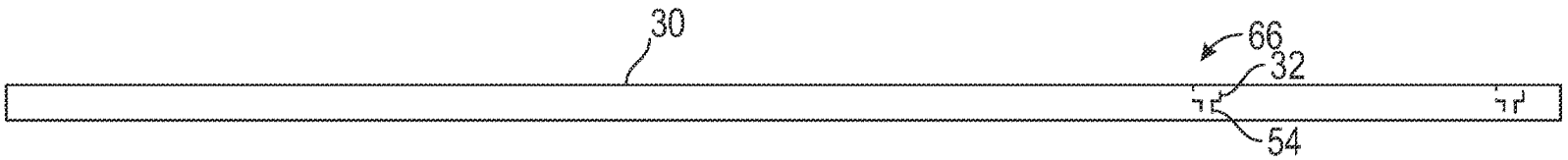

FIG. 14B is a side view illustrated with the hidden channel openings therethrough.

Figure 14C:
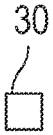

FIG. 14C is an end view of the bar of FIG. 14A.

Figure 15:
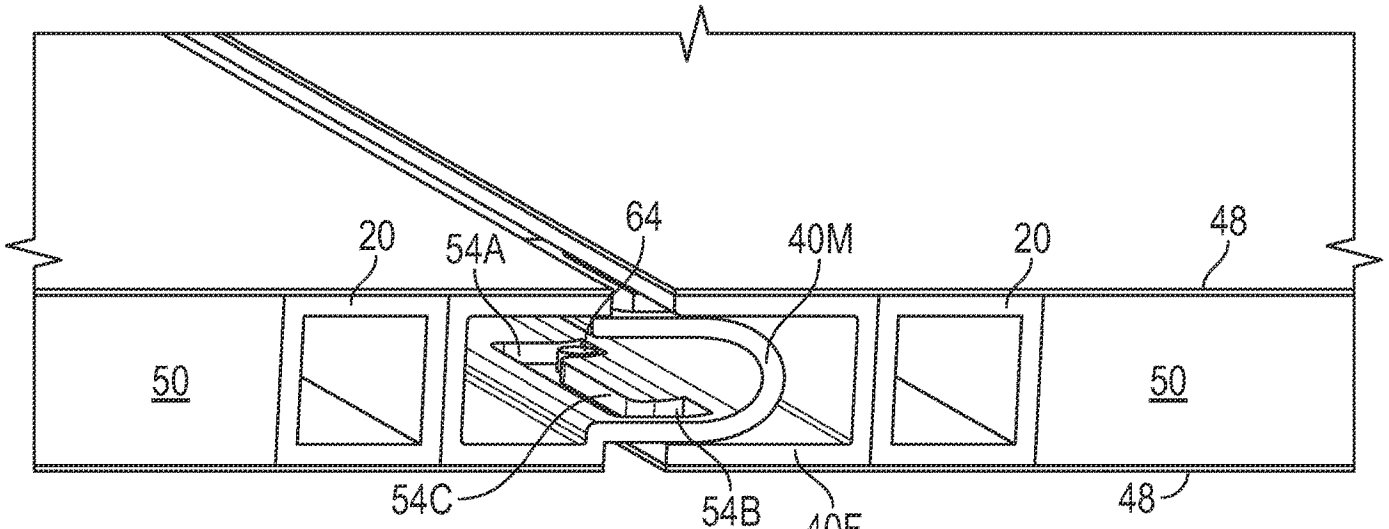

FIG. 15 is an enlarged cross-sectional view of the male and female joiners in a partial assembled state.

Figure 16:
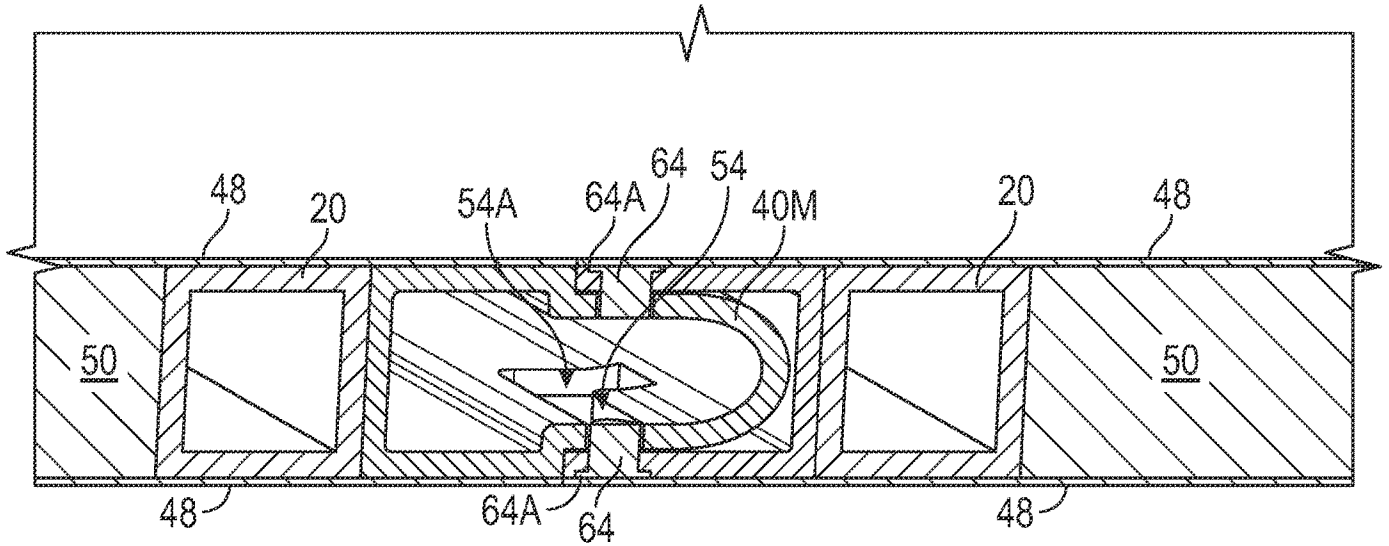

FIG. 16 is a cross sectional view of the male and female joiners in an assembled state.

Figure 17:
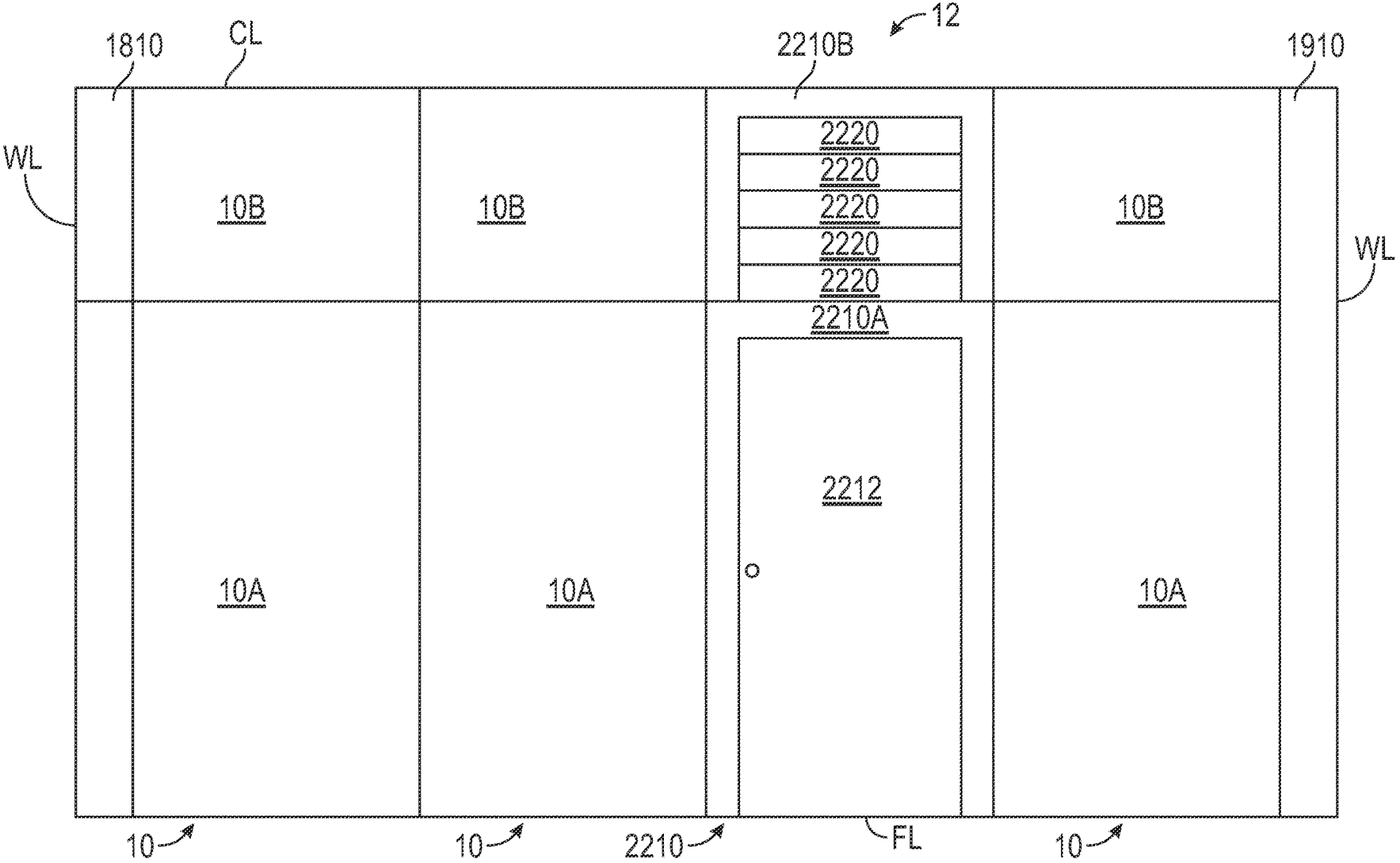

FIG. 17 is a front view of a wall system having various types of different components relative to the structure of a building.

Figure 18A:
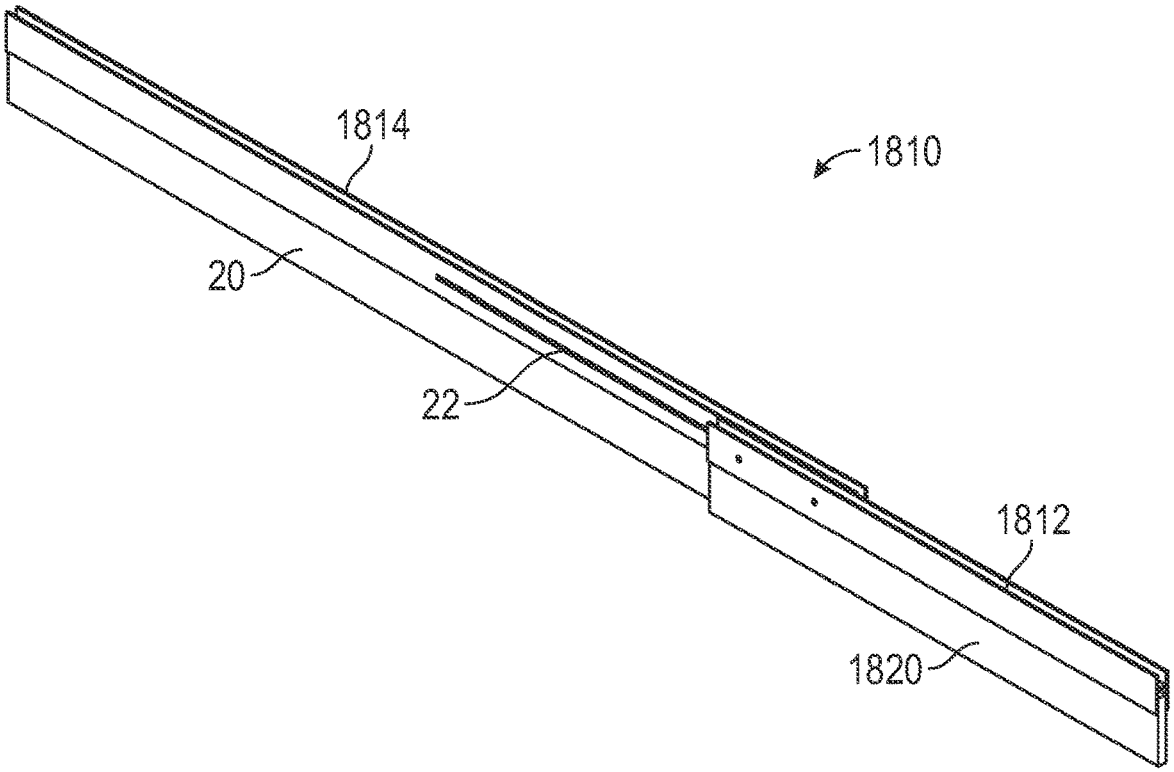

FIG. 18A is a perspective view of a female starter trim panel.

Figure 18B:
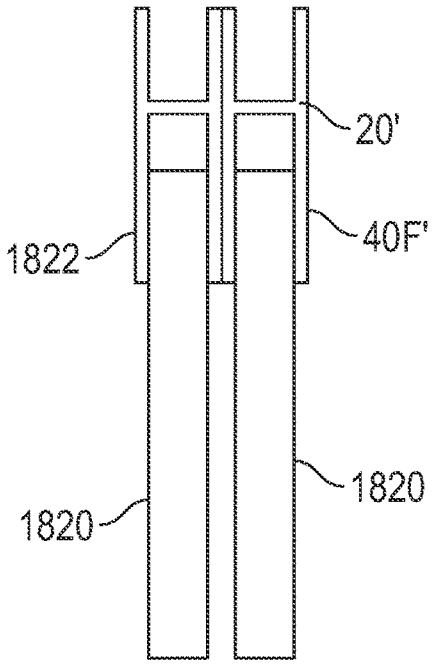

FIG. 18B is a cross sectional view of the starter trim panel of FIG. 18A.

Figure 18C:
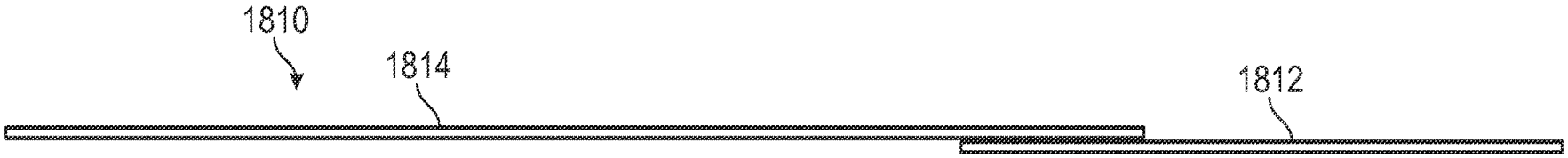

FIG. 18C is a side view of the trim panel of FIG. 18A.

Figure 18D:
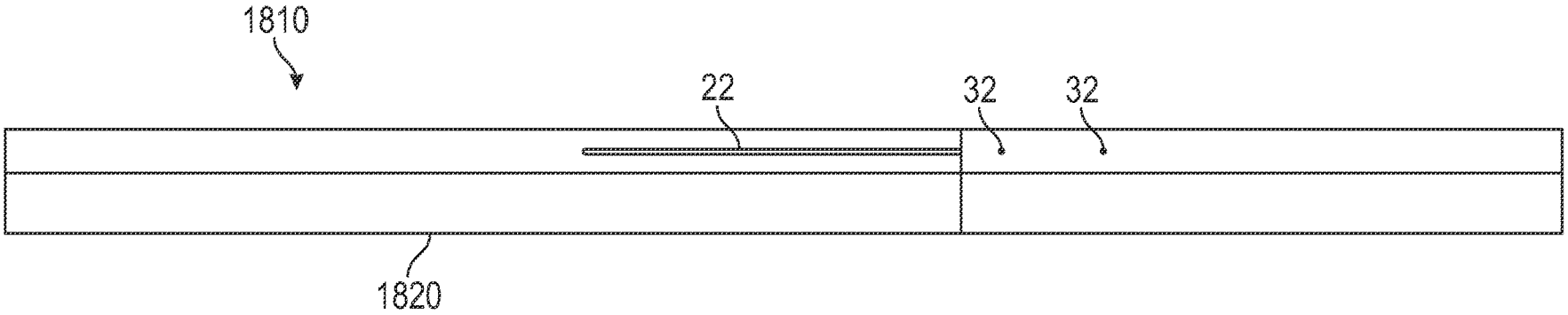

FIG. 18D is a rear view of the trim panel of FIG. 18A.

Figure 19A:
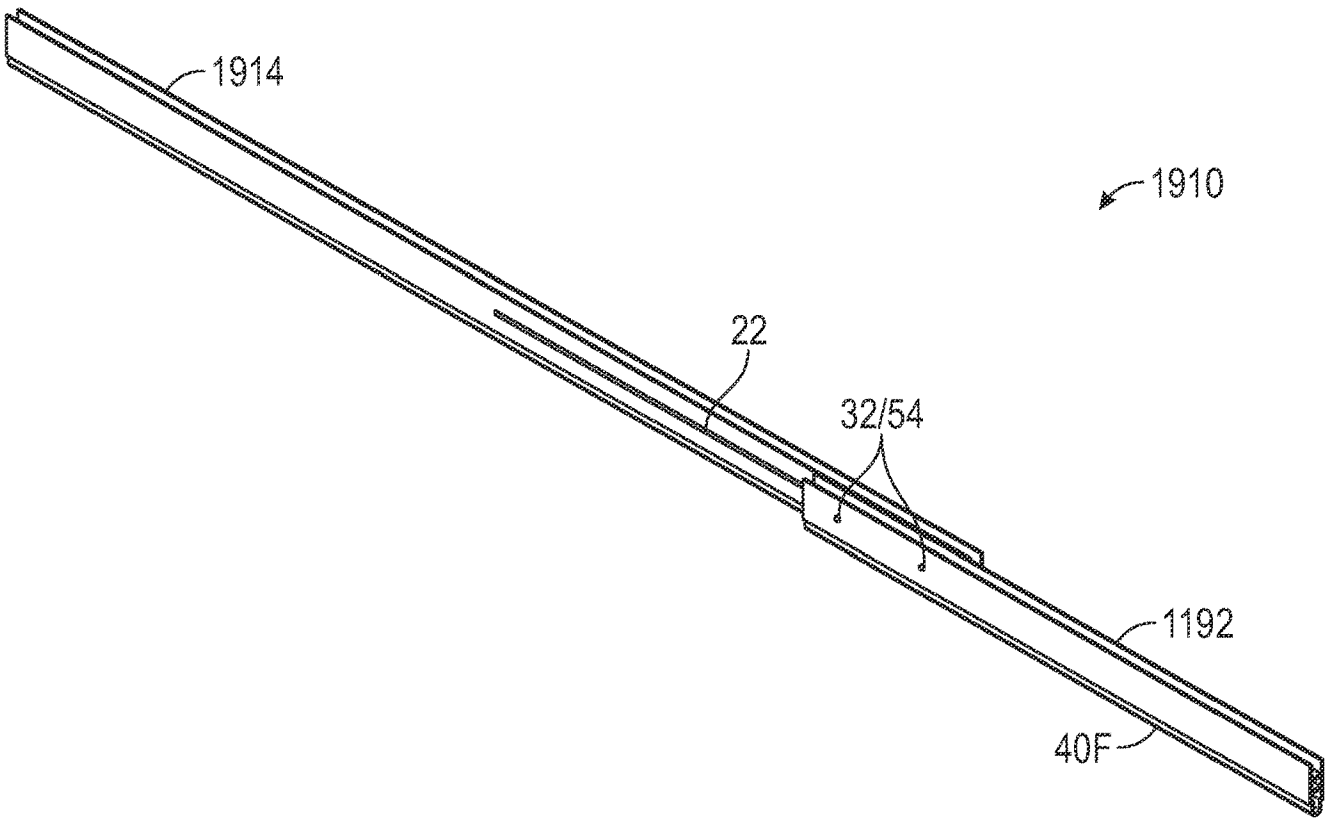

FIG. 19A is a perspective view of a male trim panel.

Figure 19B:
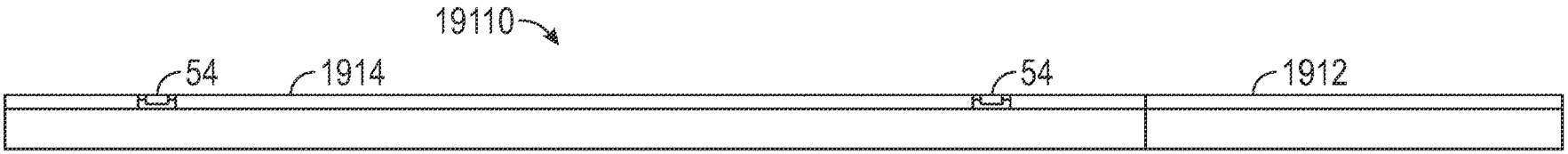

FIG. 19B is a front side view of a male trim panel.

Figure 19C:
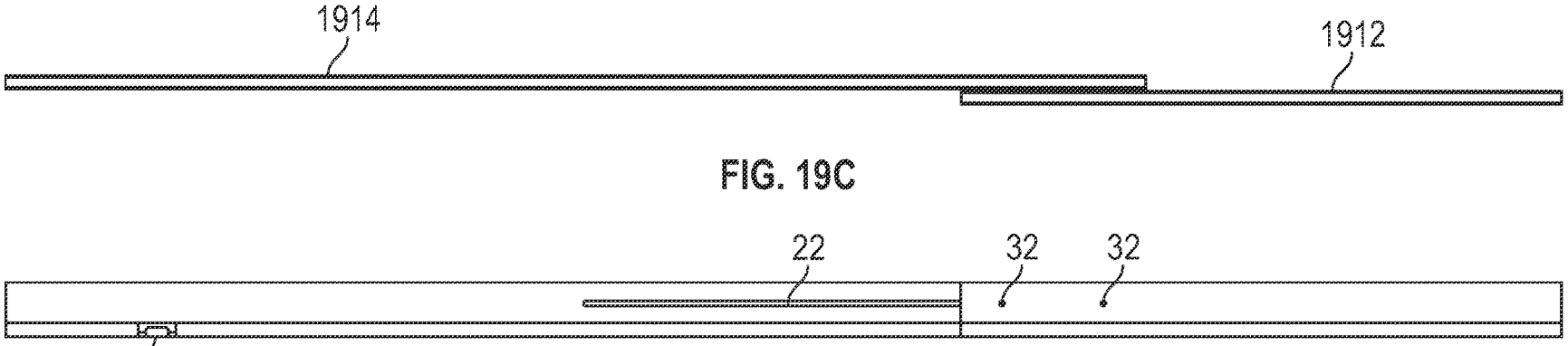

FIG. 19C is a side view of the male trim panel of FIG. 19A.

Figure 19D:
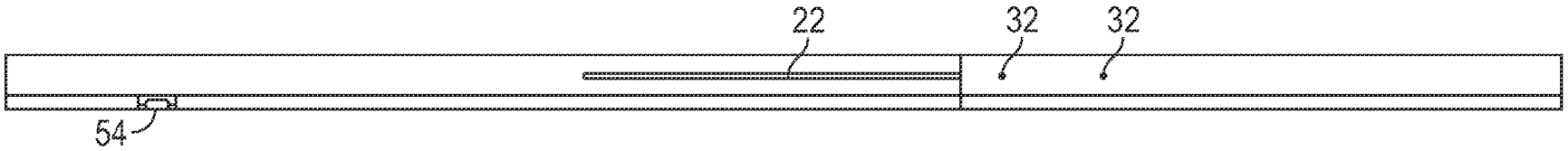

FIG. 19D is a rear view of the male trim panel of FIG. 19A.

Figure 19E:
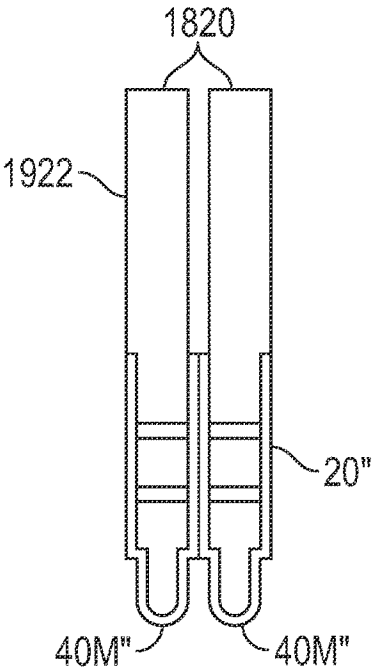

FIG. 19E is a top view of the panel of FIG. 19A.

Figure 20A:
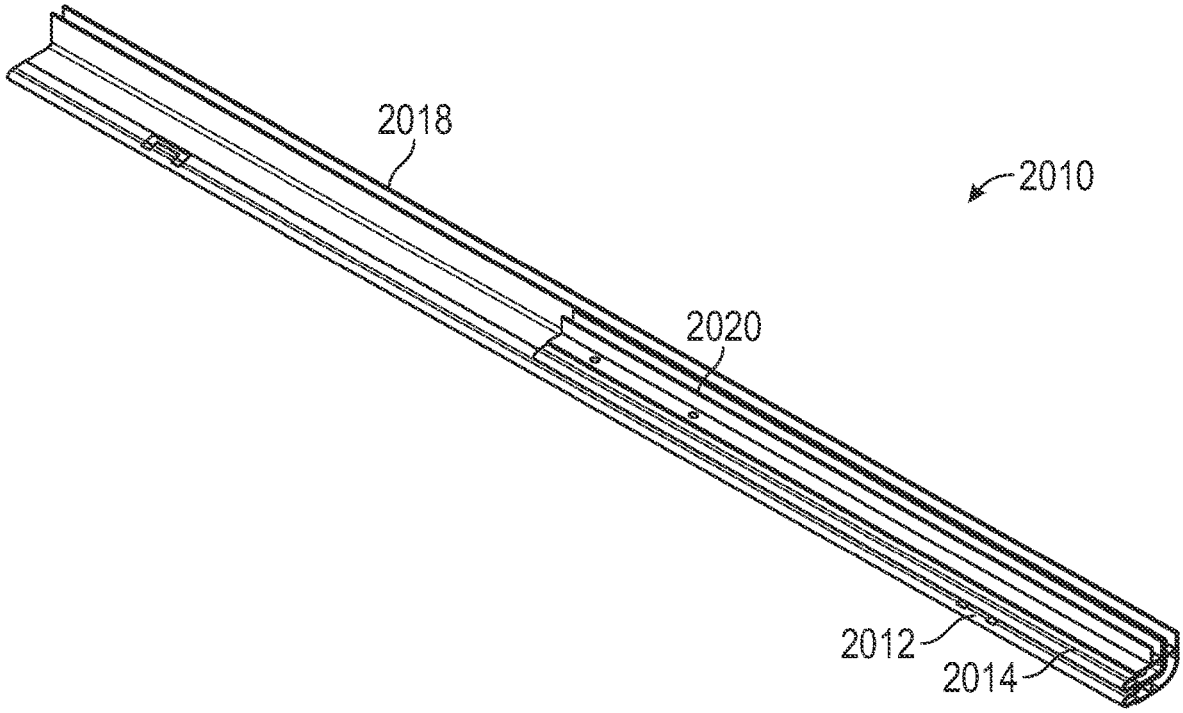

FIG. 20A is a respective view of an outside corner assembly.

Figure 20B:
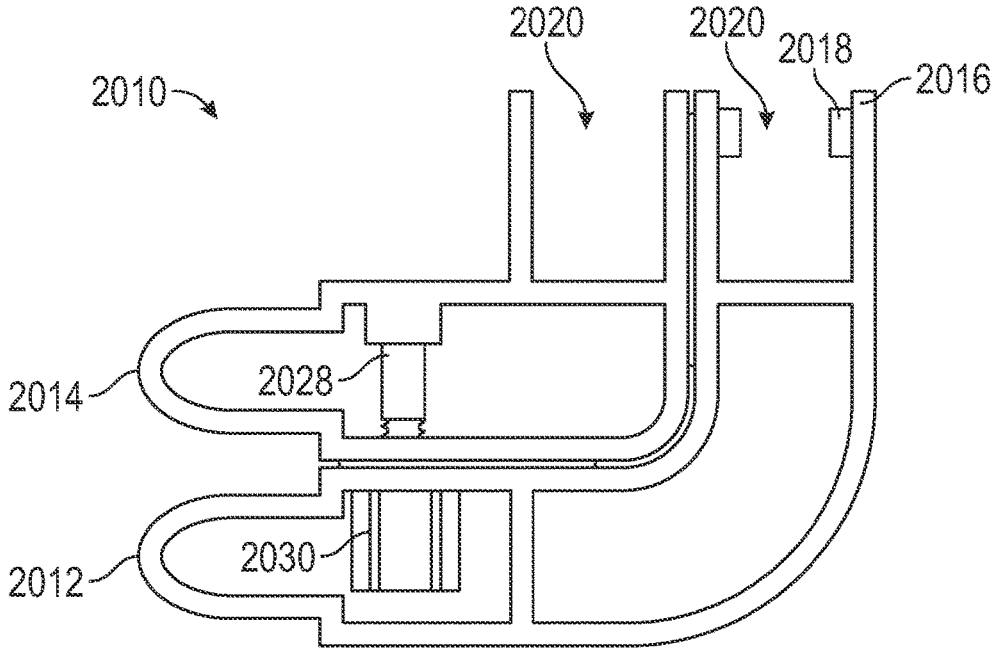

FIG. 20B is a cross sectional view of the outside corner assembly of FIG. 20A.

Figure 21A:
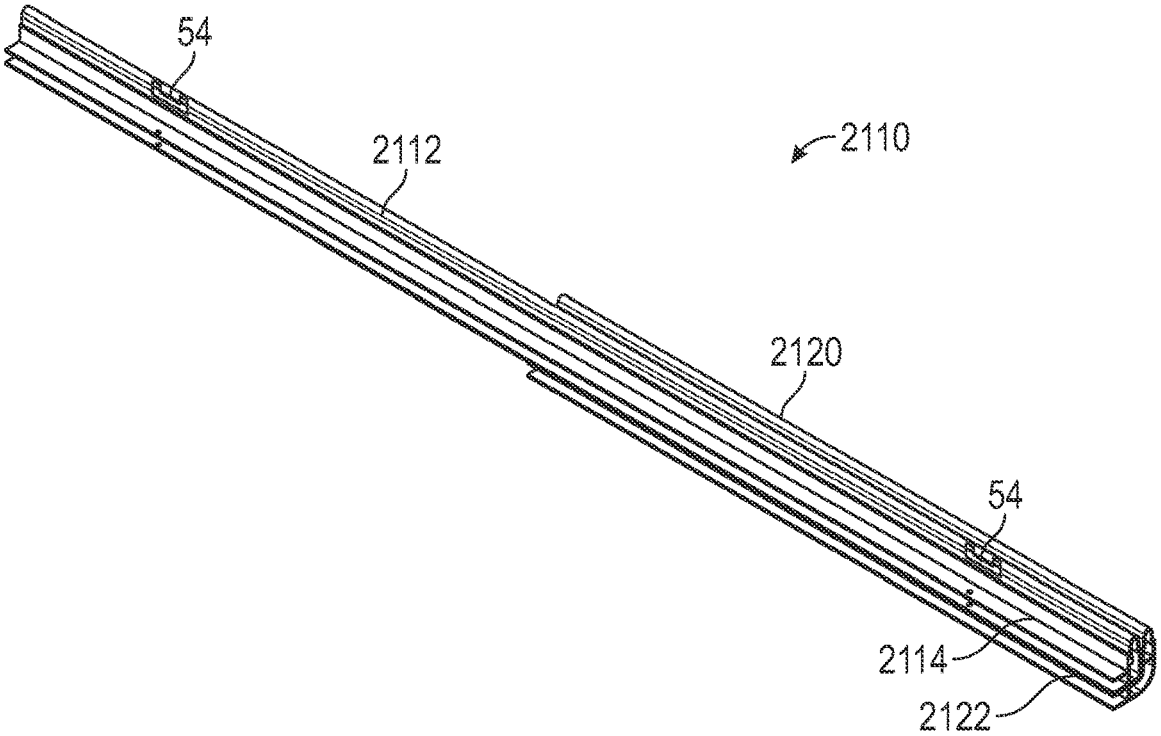

FIG. 21A is a perspective view of the inside corner assembly.

Figure 21B:
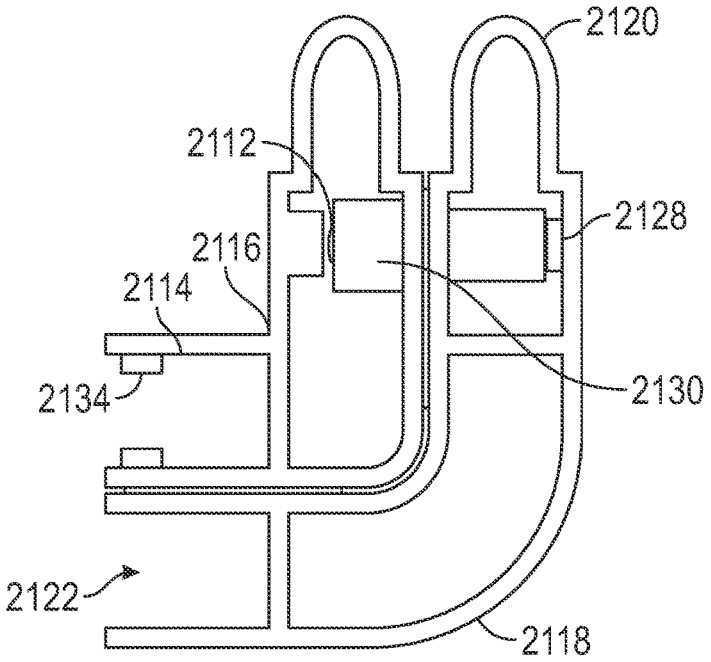

FIG. 21B is a cross sectional view of the inside corner assembly of FIG. 21A.

Figure 22B:
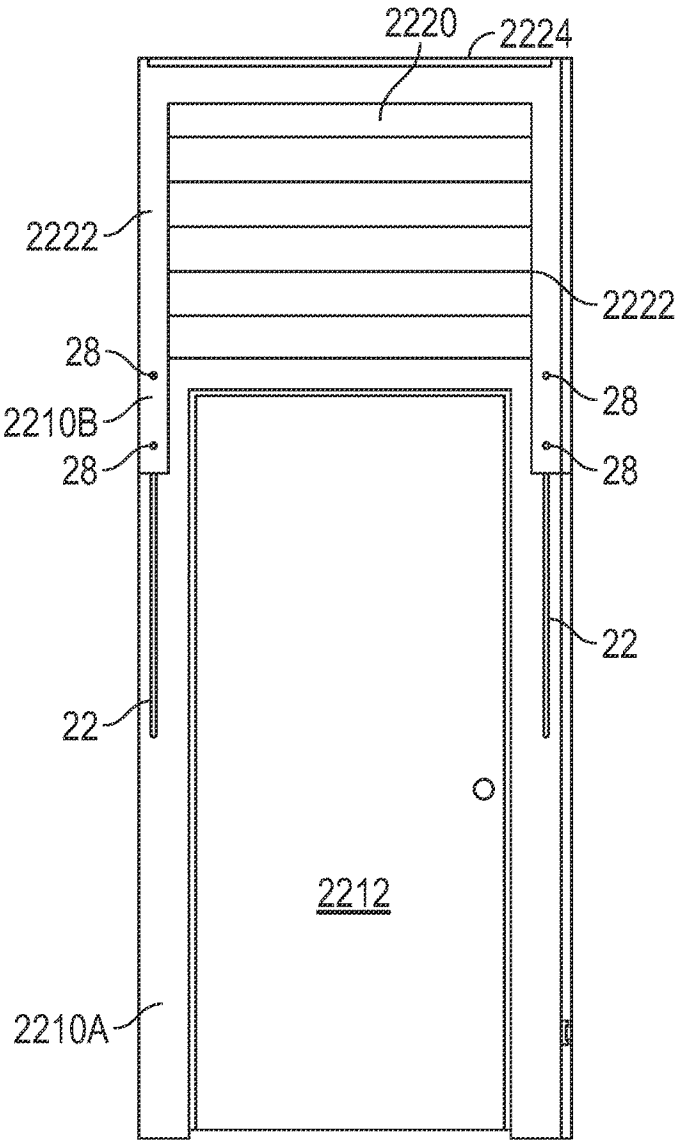
Figure 22A:
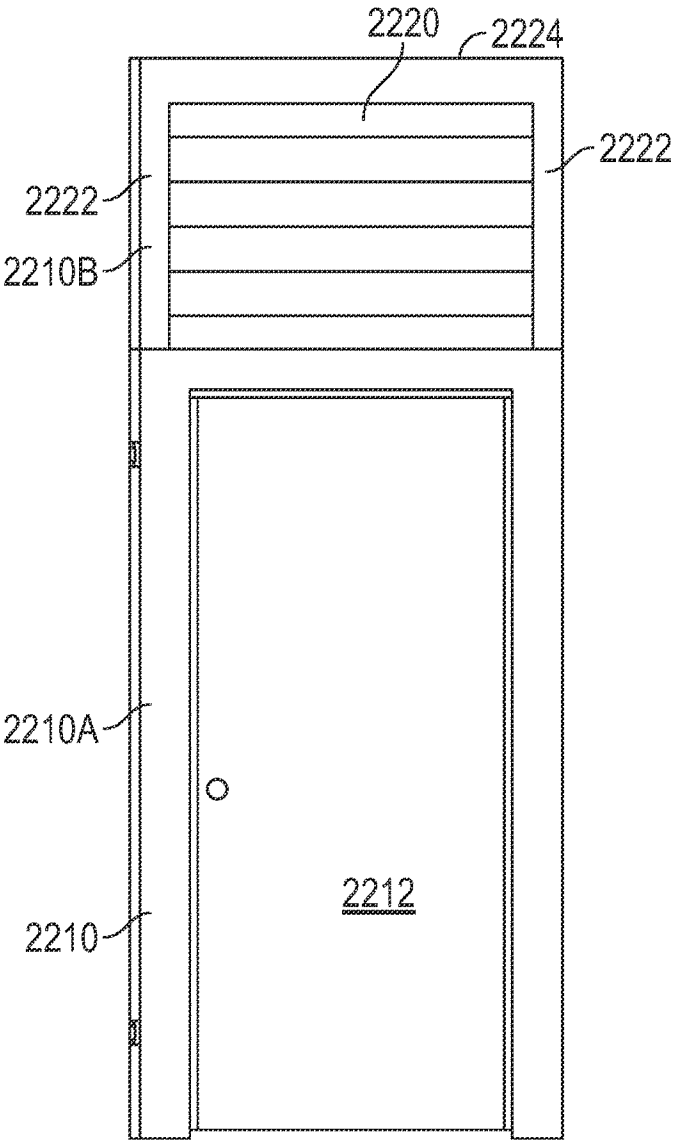

FIG. 22A is a front view of a single door system according to the present disclosure.

FIG. 22B is a rear view of the single door system of FIG. 22A.

Figure 22C:
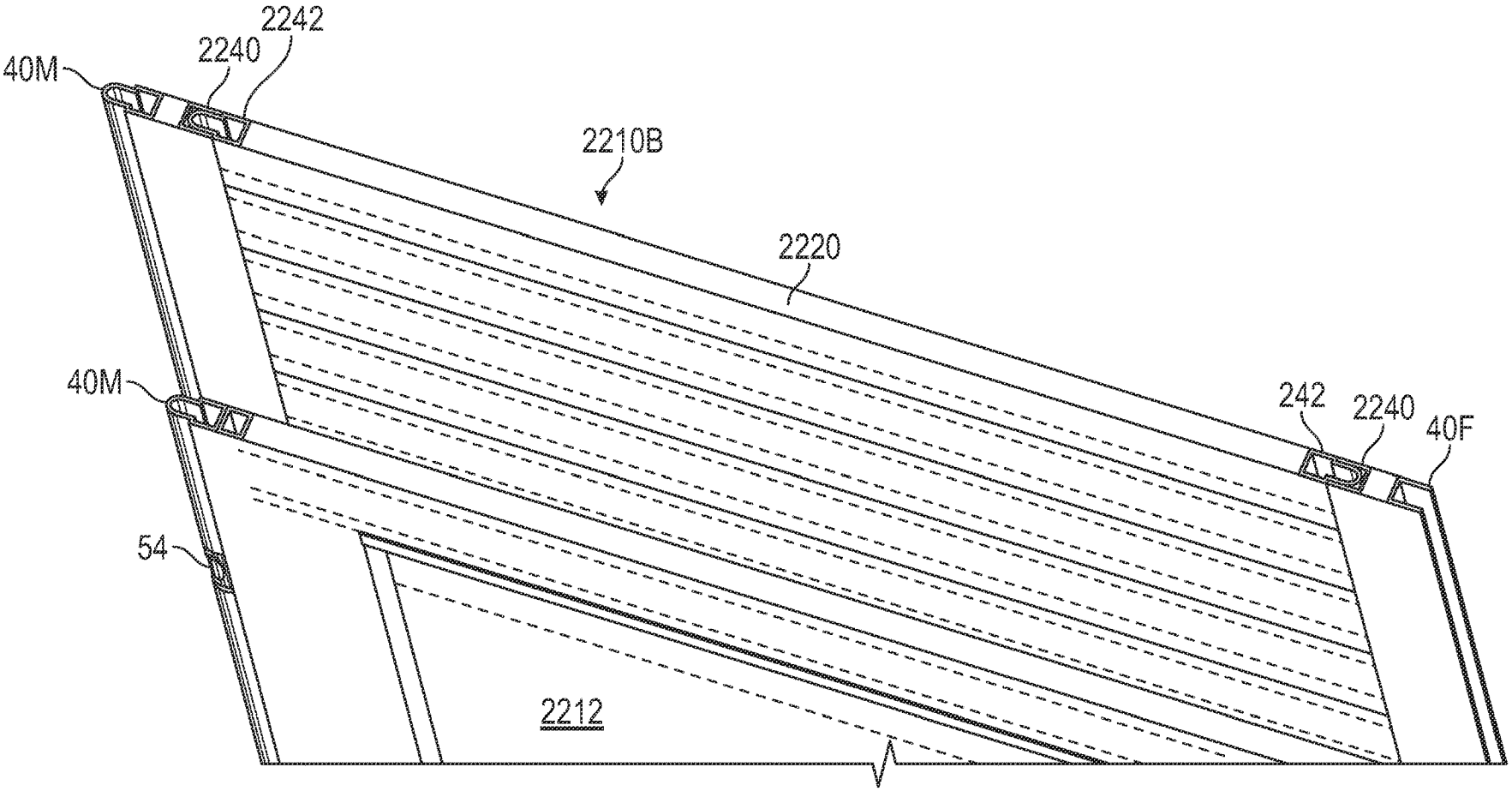

FIG. 22C is a cross sectional perspective view of the extendable portion of FIGS. 22A and 22B.

Figure 22D:
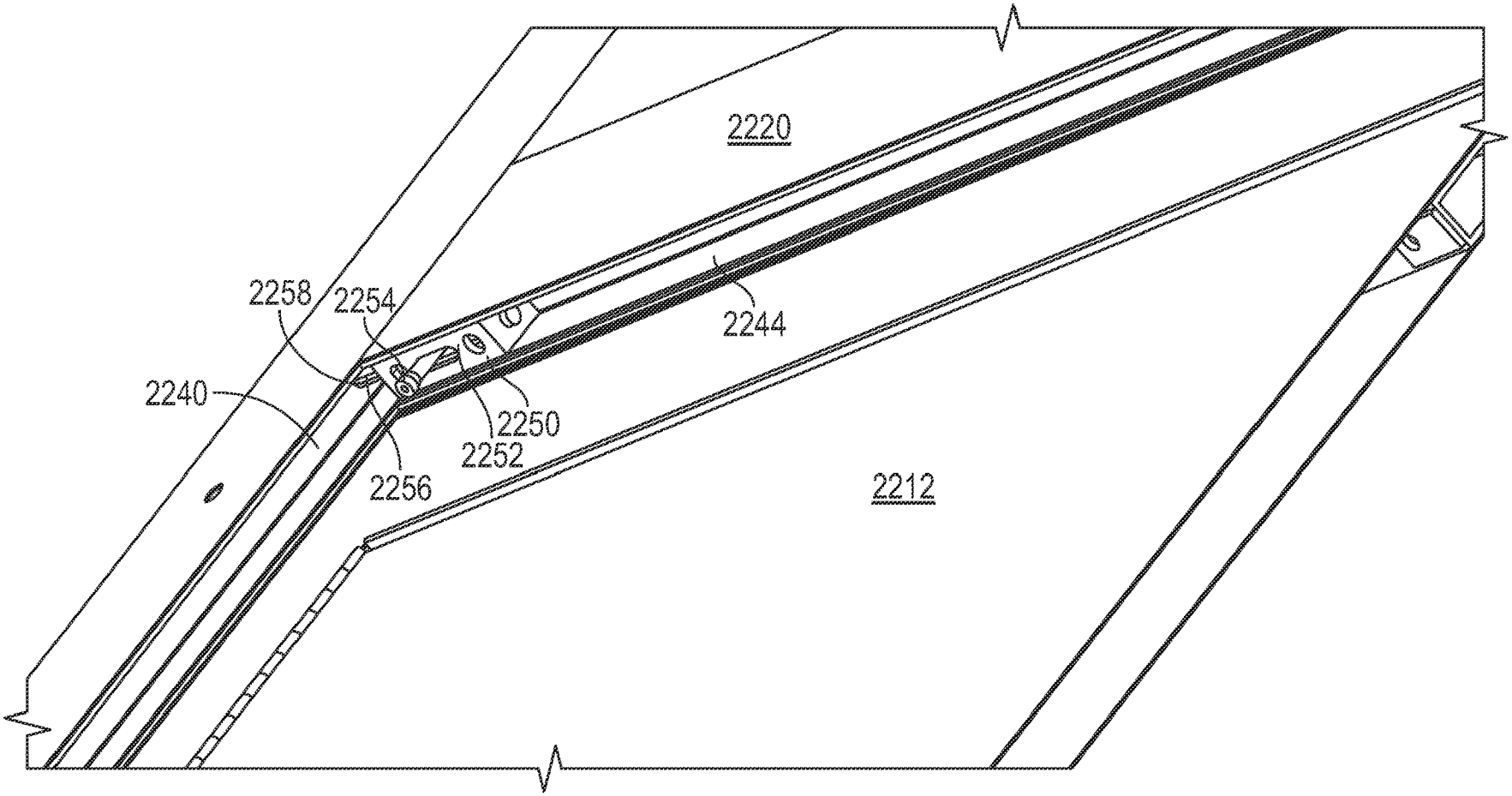

FIG. 22D is a perspective underside view of the latch for latching the flexible panels into the extendable wall portion.

Figure 23B:
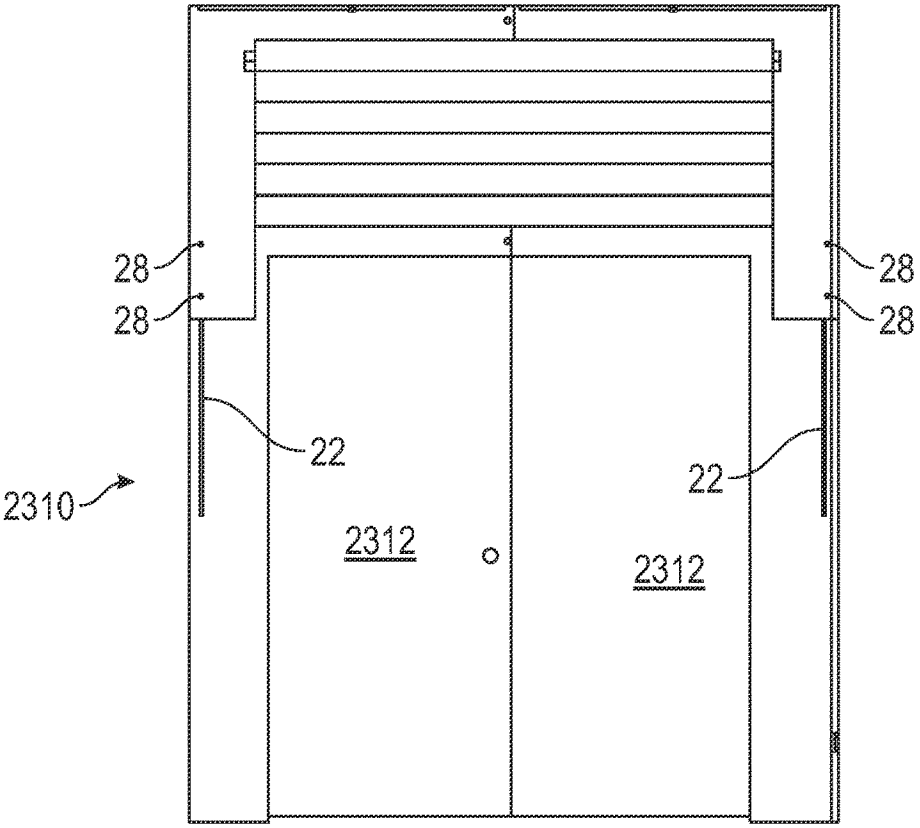
Figure 23A:
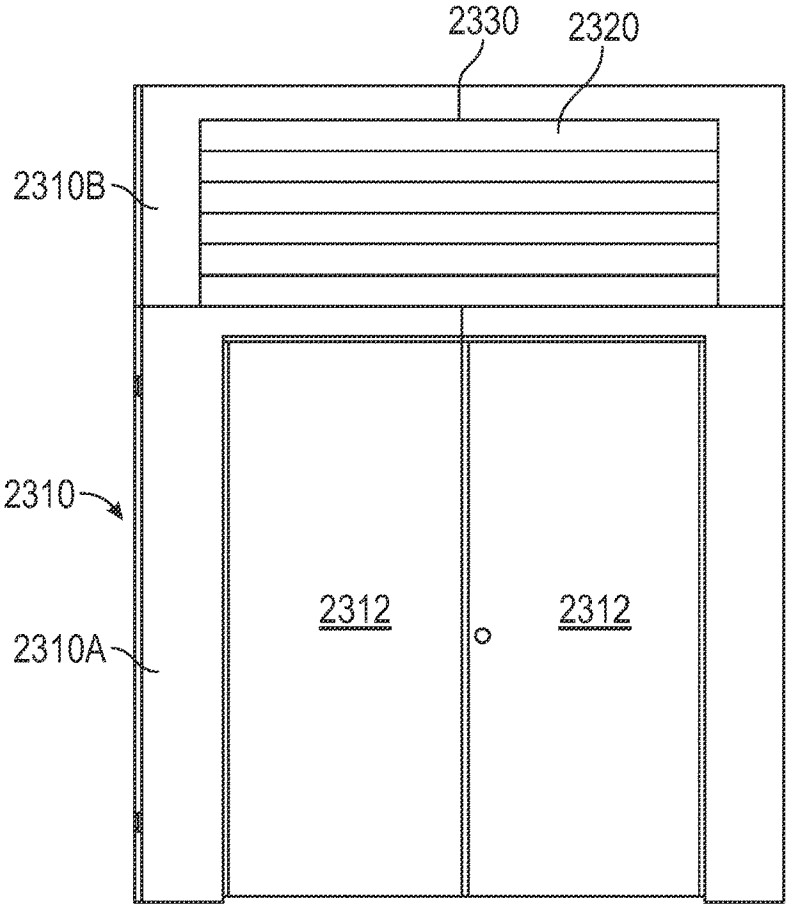

FIG. 23A is a front view of a double door assembly.

FIG. 23B is a rear view of the double door assembly.

Figure 23C:
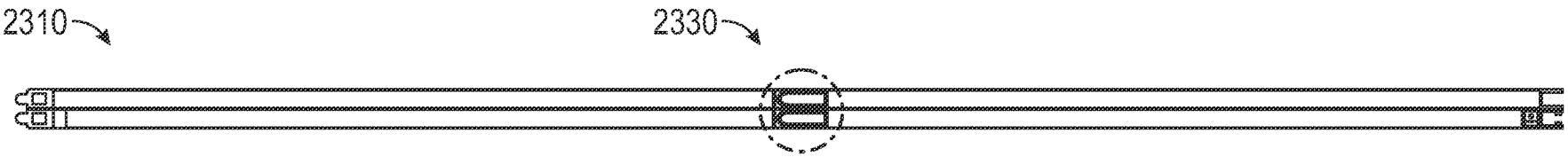

FIG. 23C is a top view of the double door assembly.

Figure 23D:
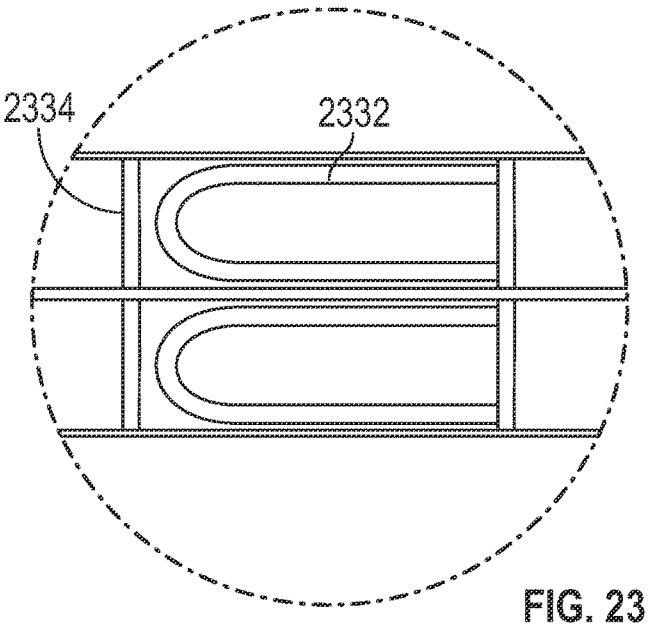

FIG. 23D is a cross-sectional view of a joint for the top portion of FIG. 23A.

Figure 24A:
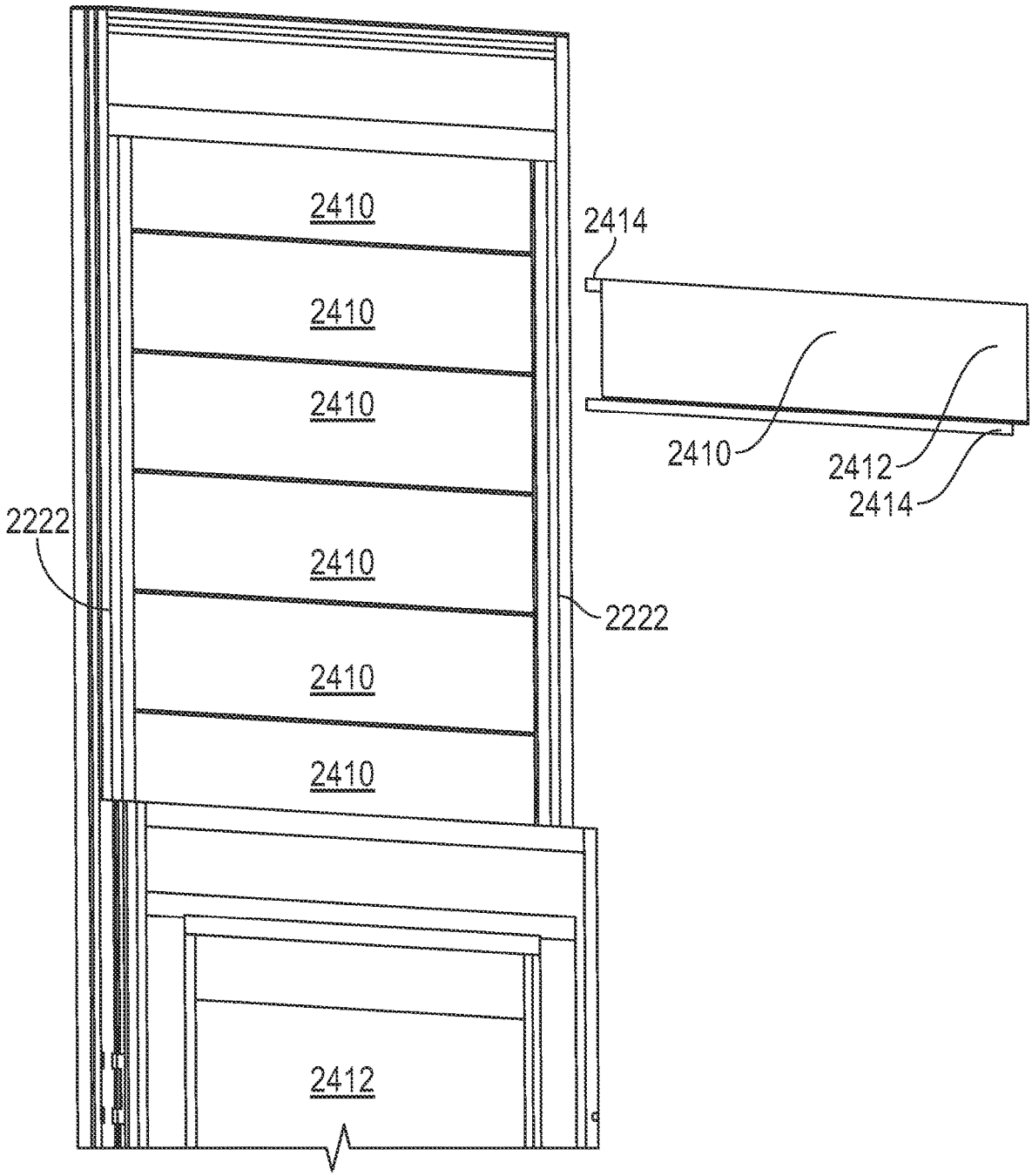

FIG. 24A is front view of the single door assembly having an alternate filler panel.

Figure 24B:
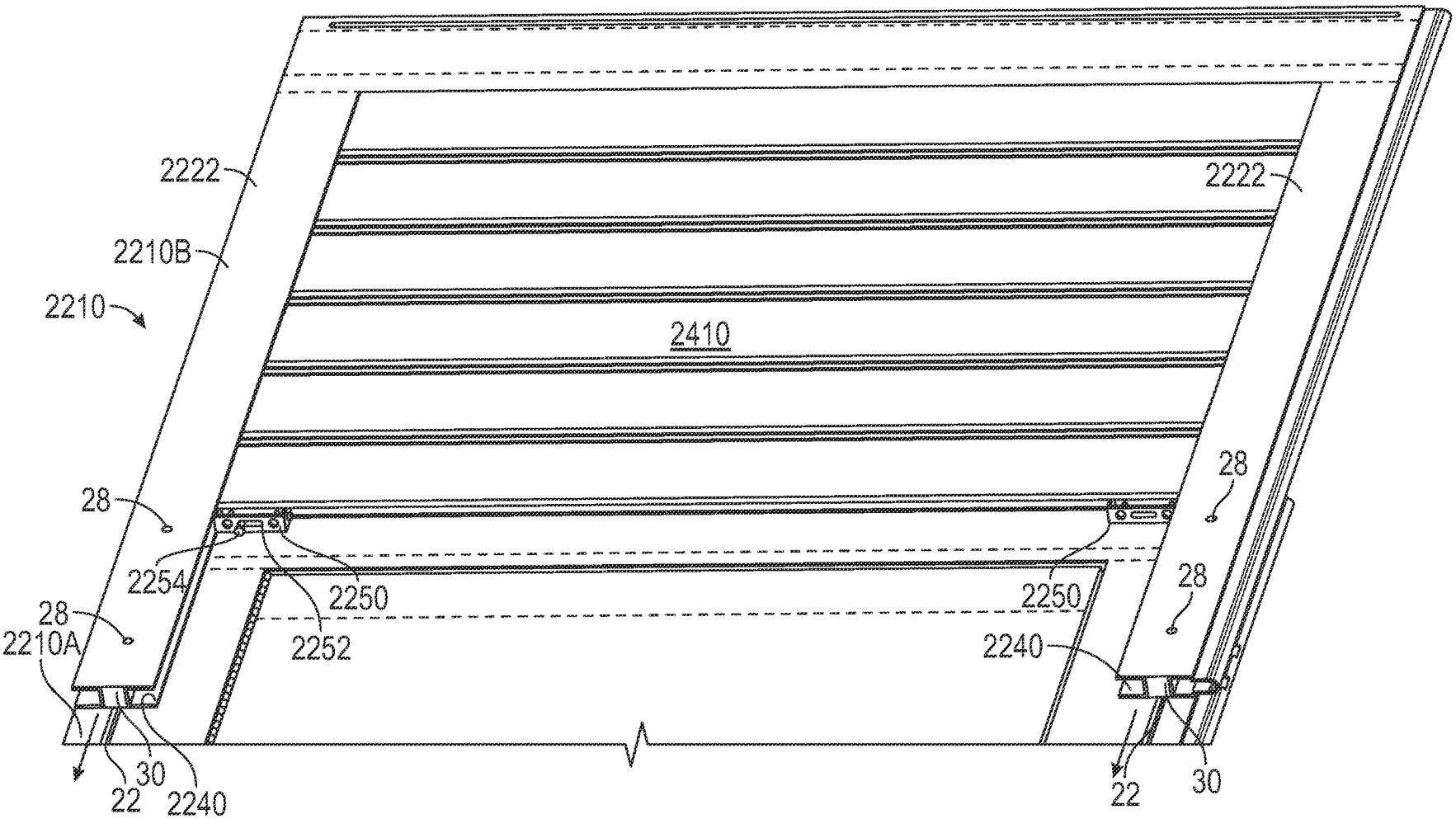

FIG. 24B is a perspective underside view of the alternate filler panels of FIG. 24A.

Figure 25:
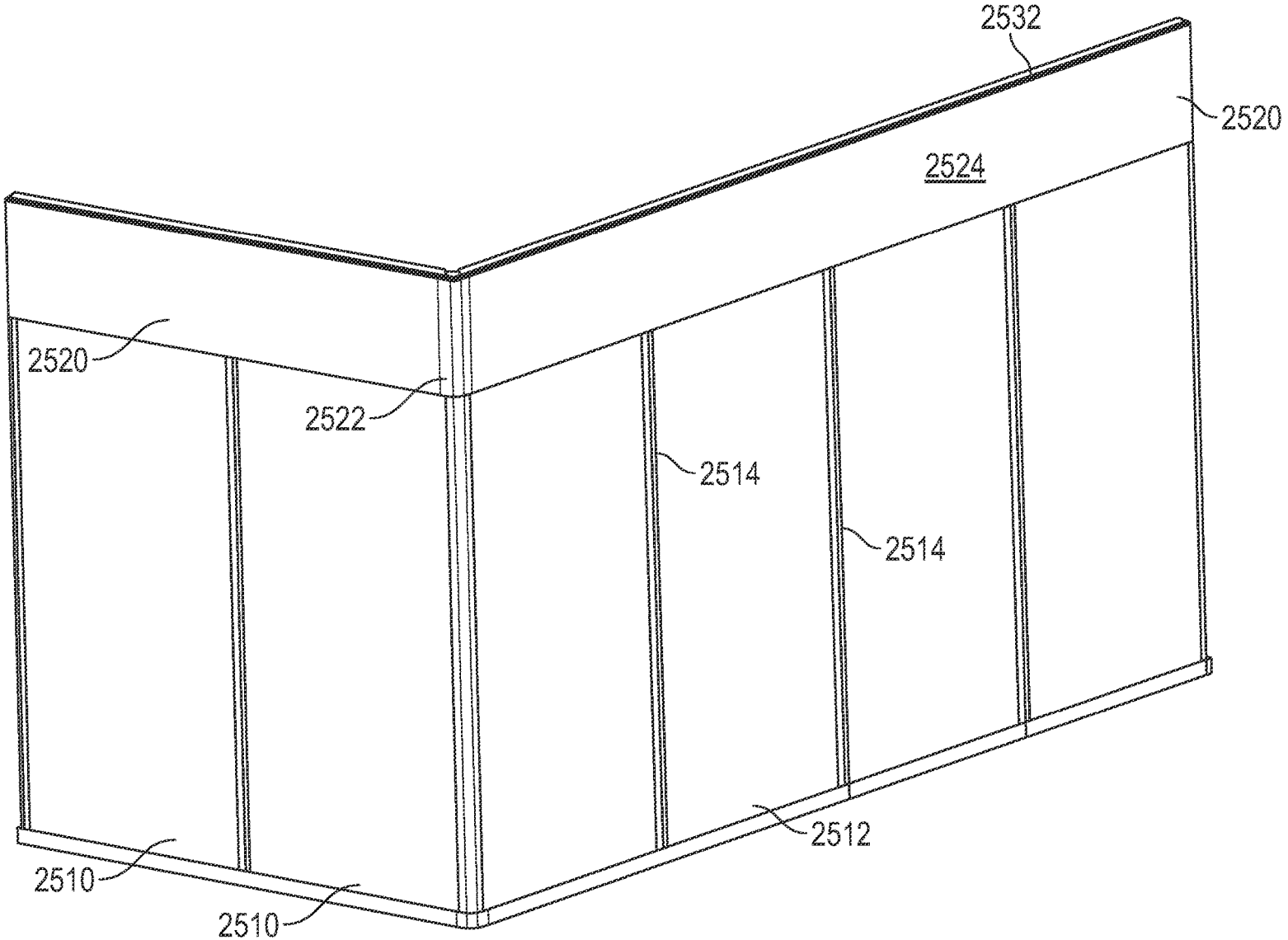

FIG. 25 is a perspective view of a portion of a wall system at a corner of a front wall and a side wall.

Figure 26A:
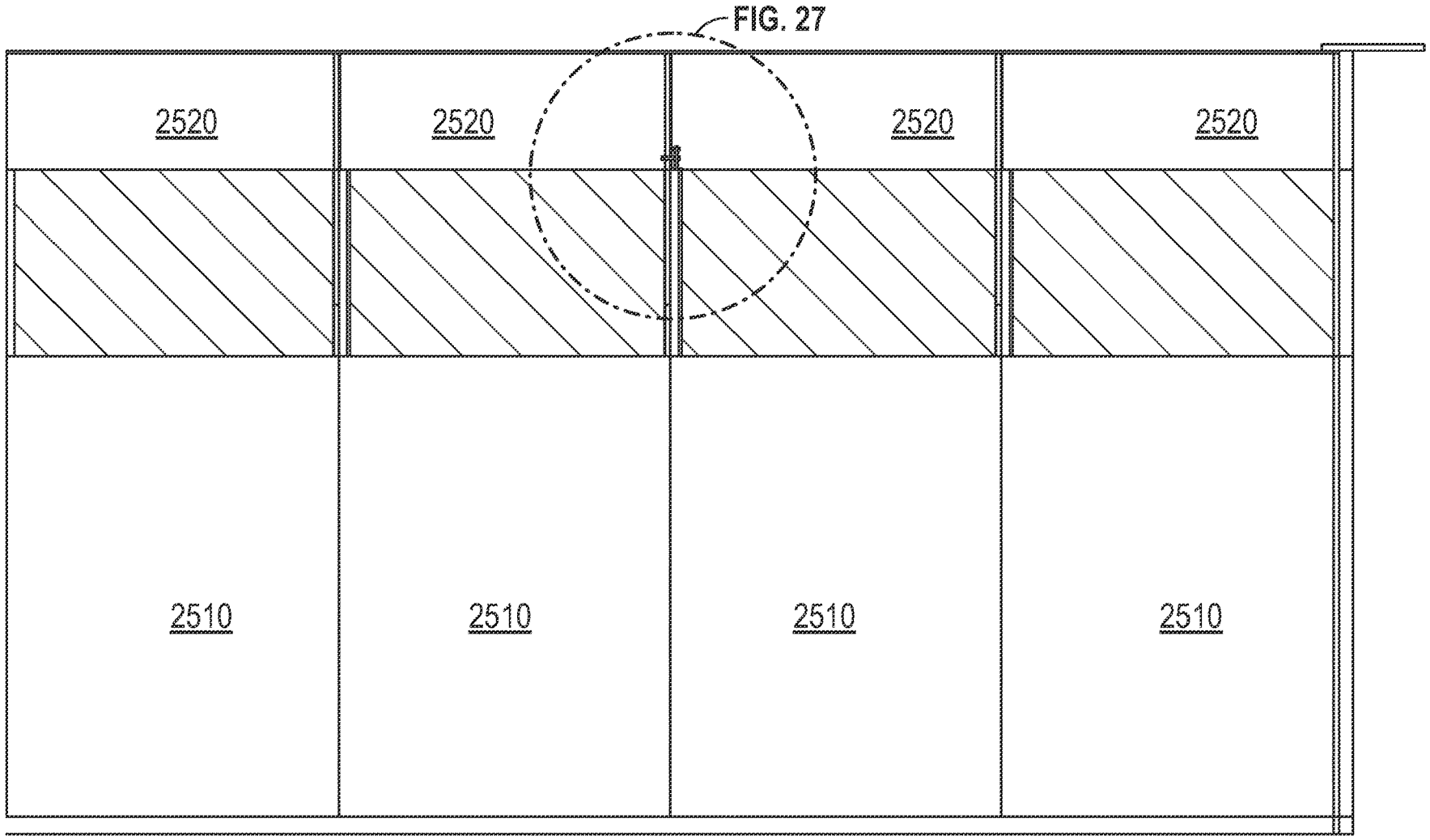

FIG. 26A is a front view of a plurality of assembled wall panels of the front wall.

Figure 26B:
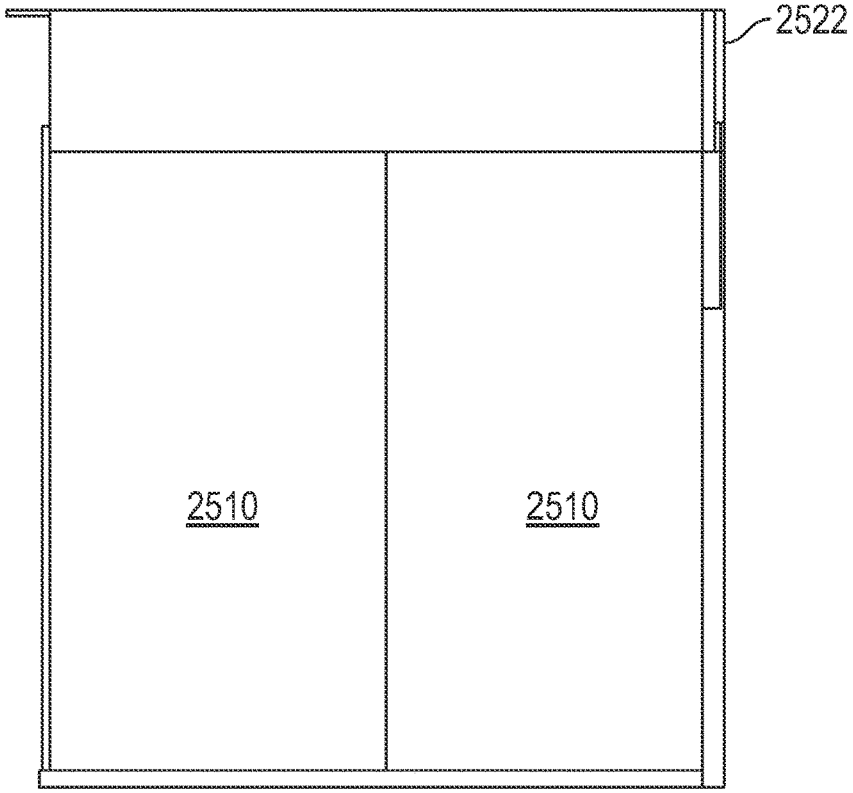

FIG. 26B is a front view of a plurality of assembled wall panels of the side wall.

Figure 27A:
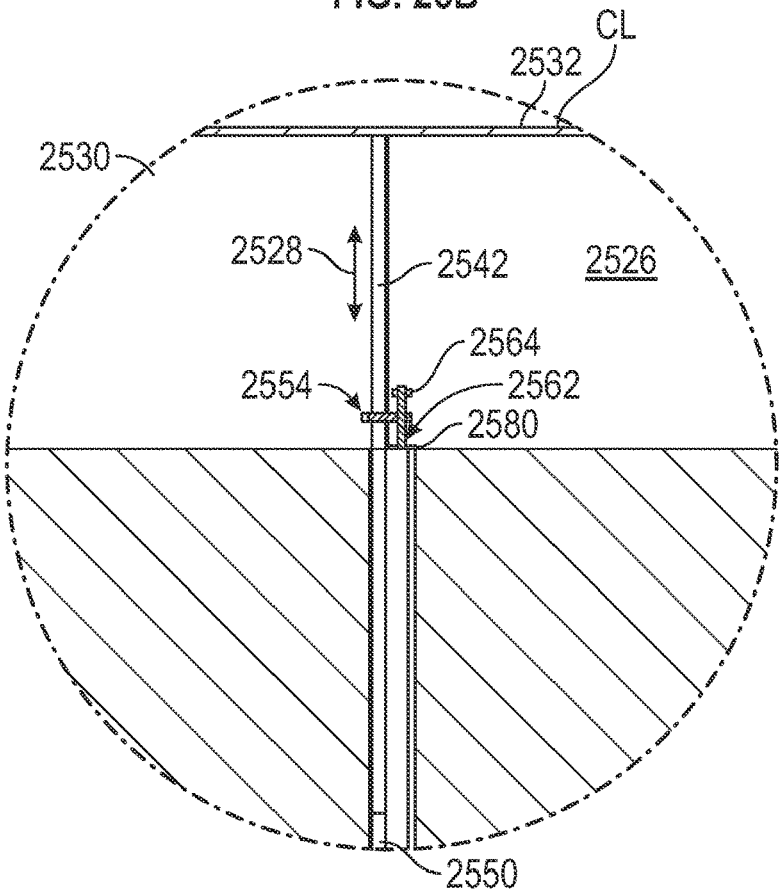

FIG. 27A is a front cross-sectional view of two wall panels joined together.

Figure 27B:
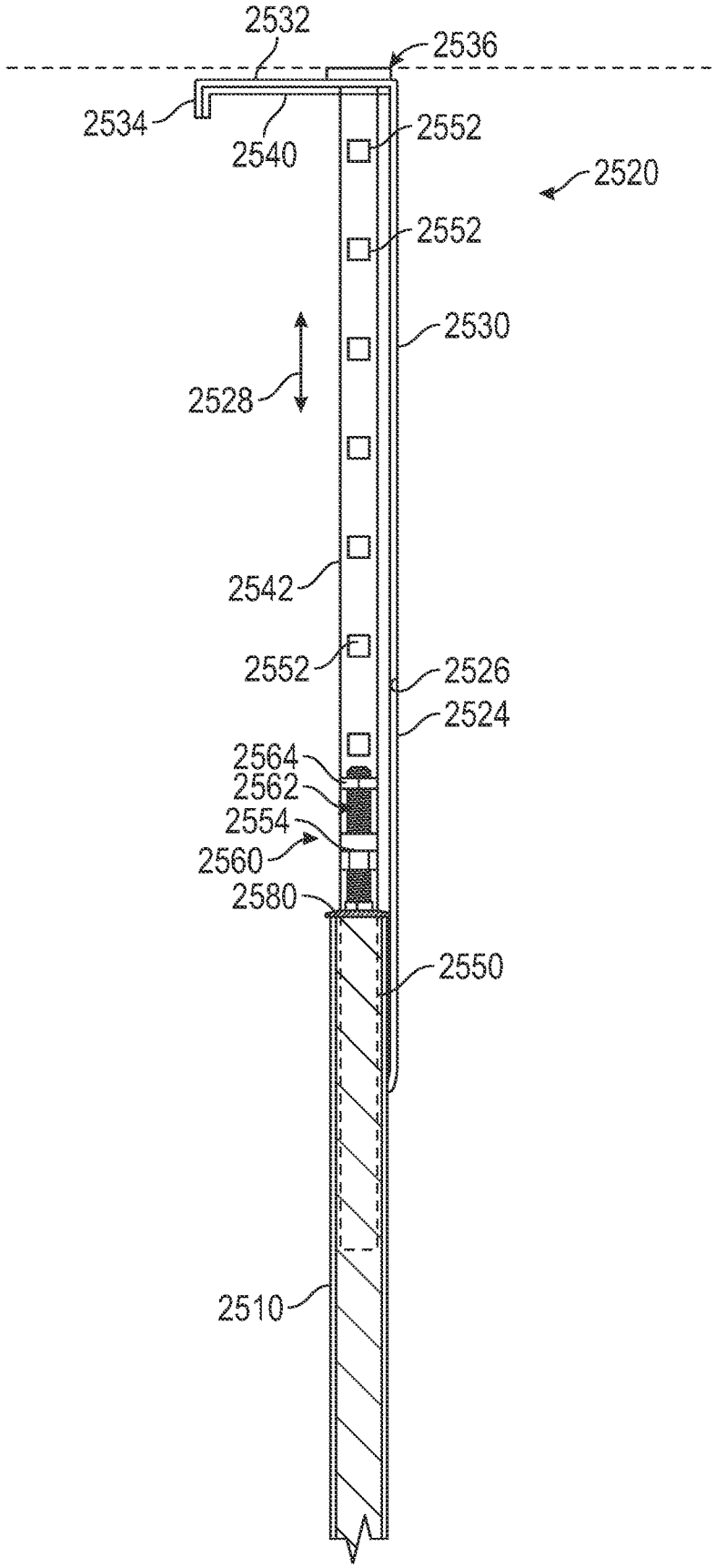

FIG. 27B is a side view of two wall panels joined together.

Figure 28B:
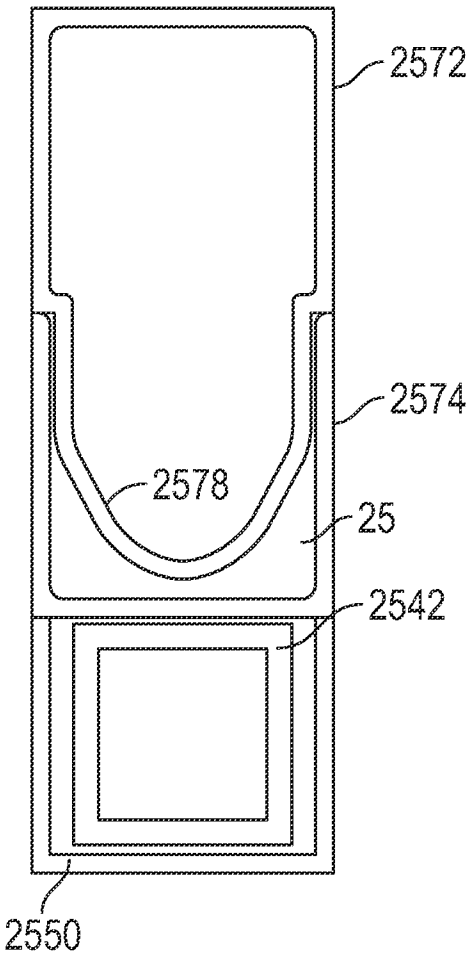
Figure 28A:
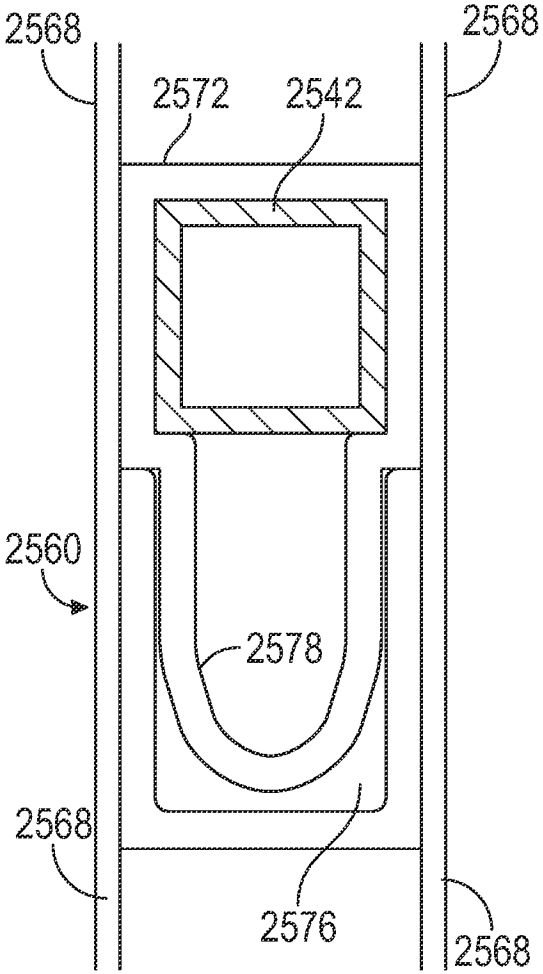

FIG. 28A is a cross-sectional view of a male and female joiner having extension at the male portion.

FIG. 28B is a cross-sectional view of a male and female joiner having extension at the female portion.

Figure 29:
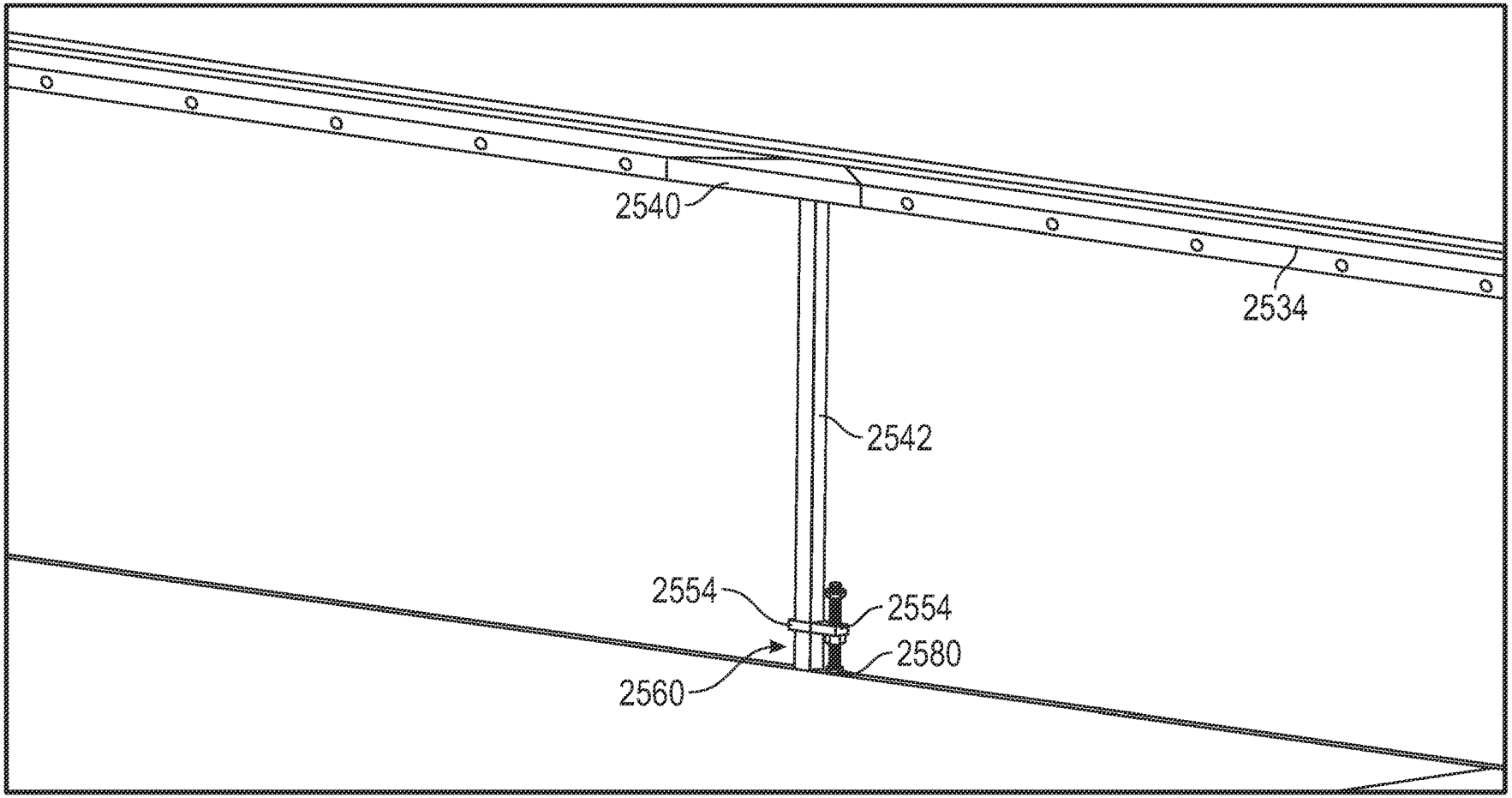

FIG. 29 is a perspective view from the rear of a top of a wall panel showing the extension and trim cover.

Figure 30A:
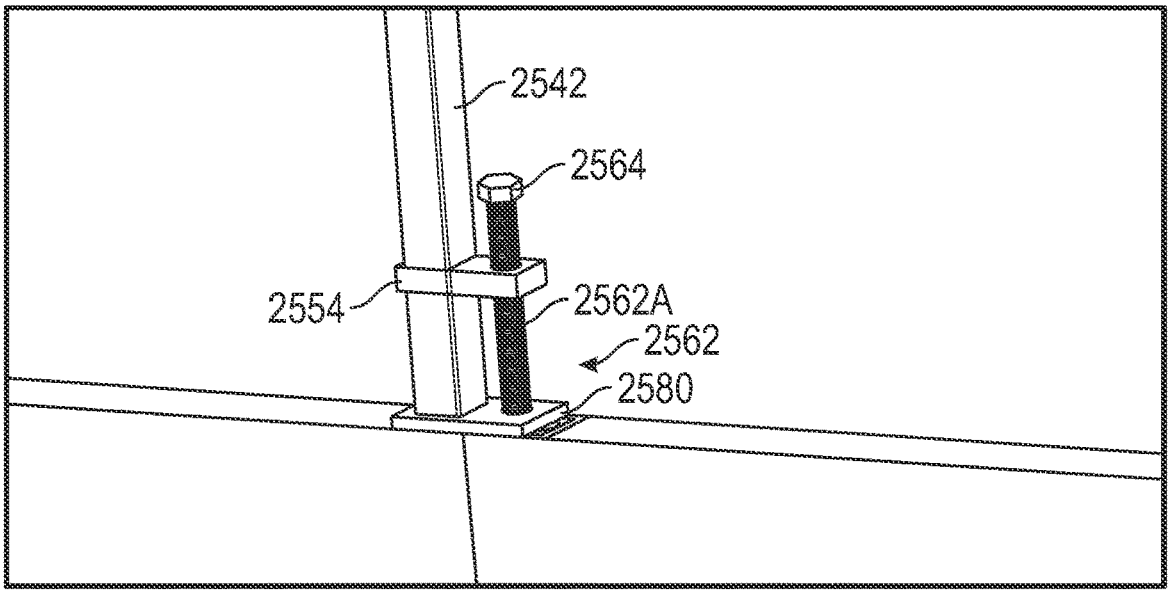

FIG. 30A is a perspective view from the rear of a top of a wall panel showing an adjustment mechanism in further detail.

Figure 30B:
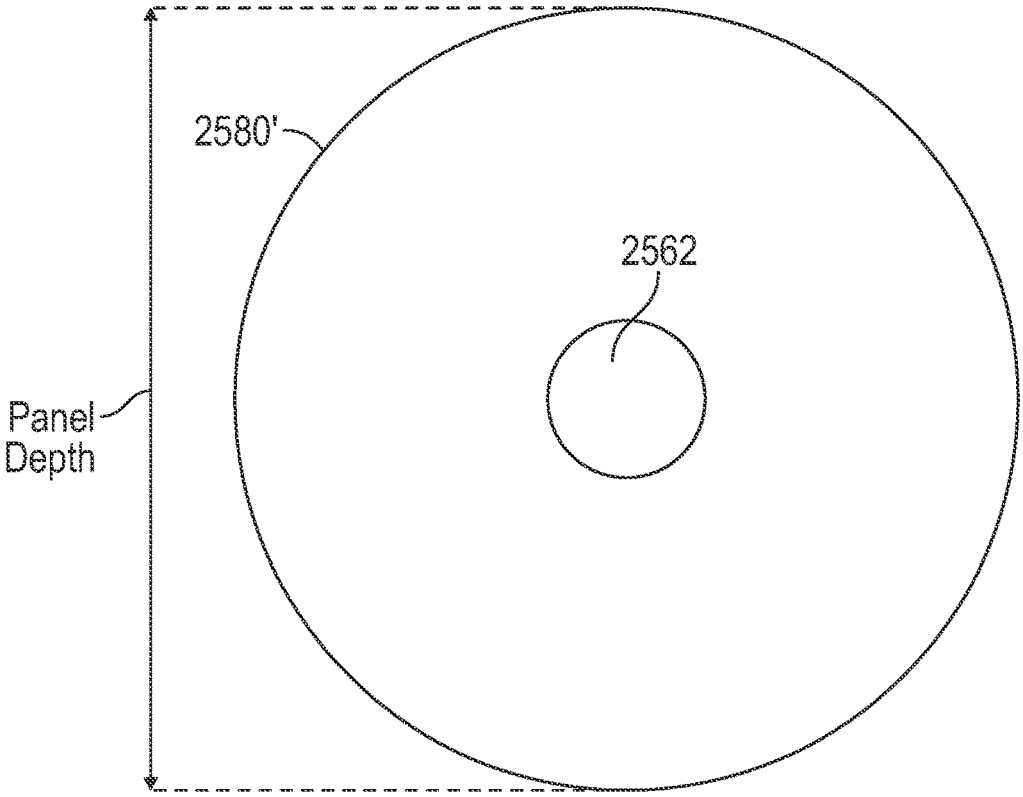

FIG. 30B is a top view from the rear of a top surface of a wall panel an alternate load distribution plate shape.

Figure 31:
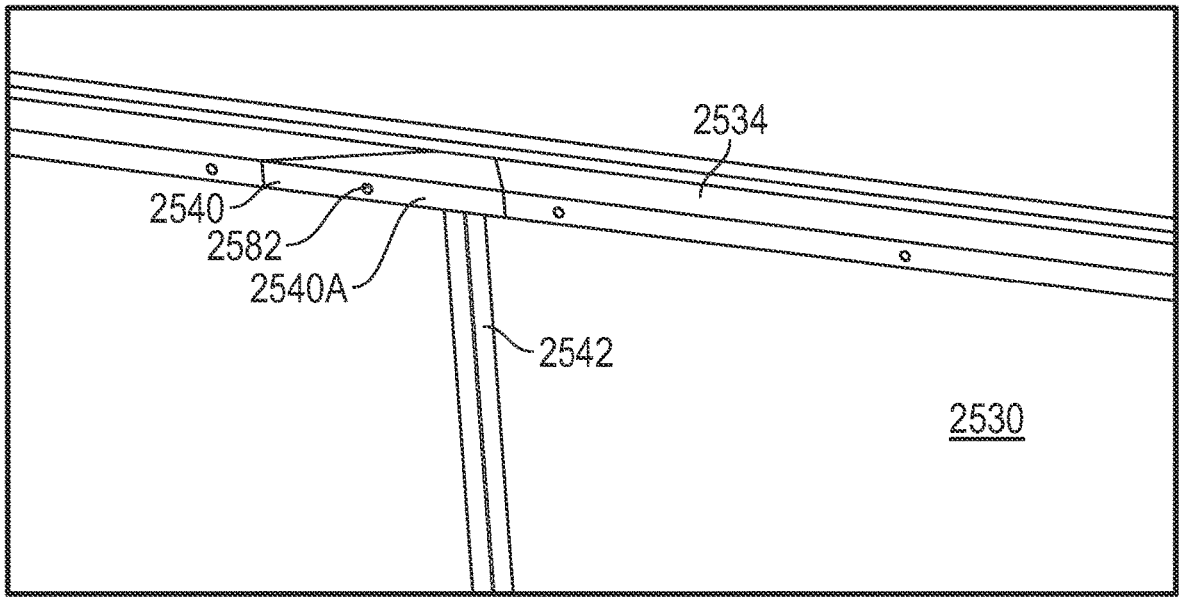

FIG. 31 is a perspective view from the rear of a top of a wall panel showing the post mounting plate and trim cover coupling in further detail.

Figure 32A:
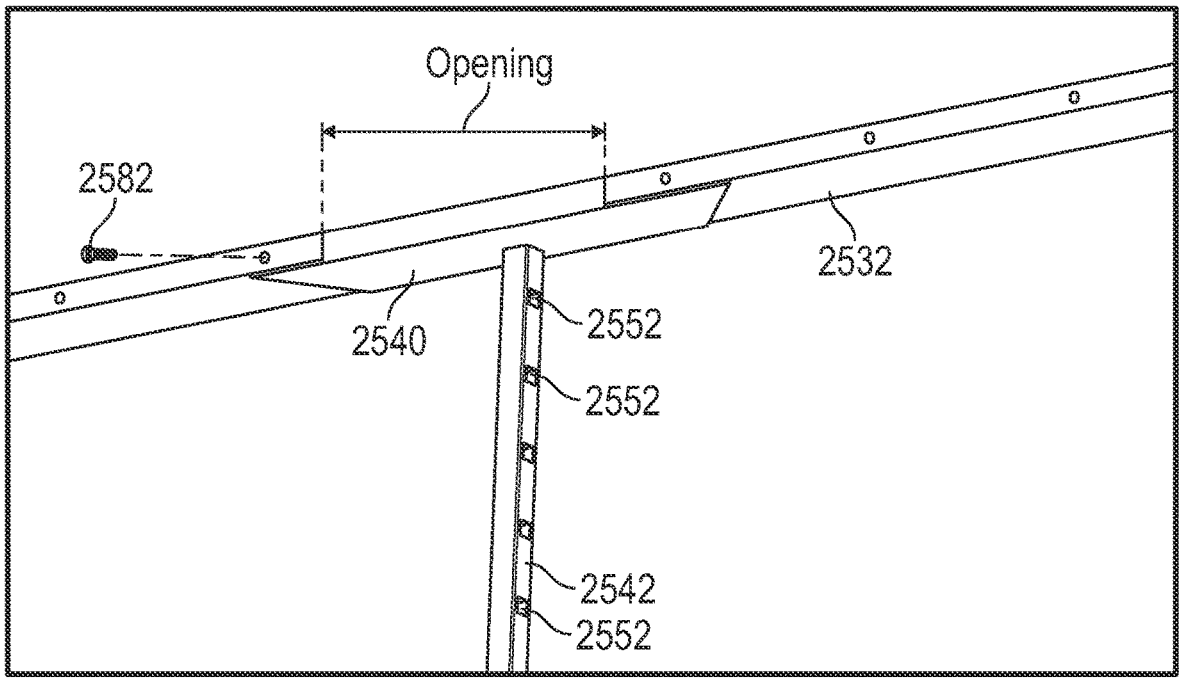

FIG. 32A is a perspective view from the rear of a top of a wall panel showing the post mounting plate and trim cover coupling in further detail from the underside.

Figure 32B:
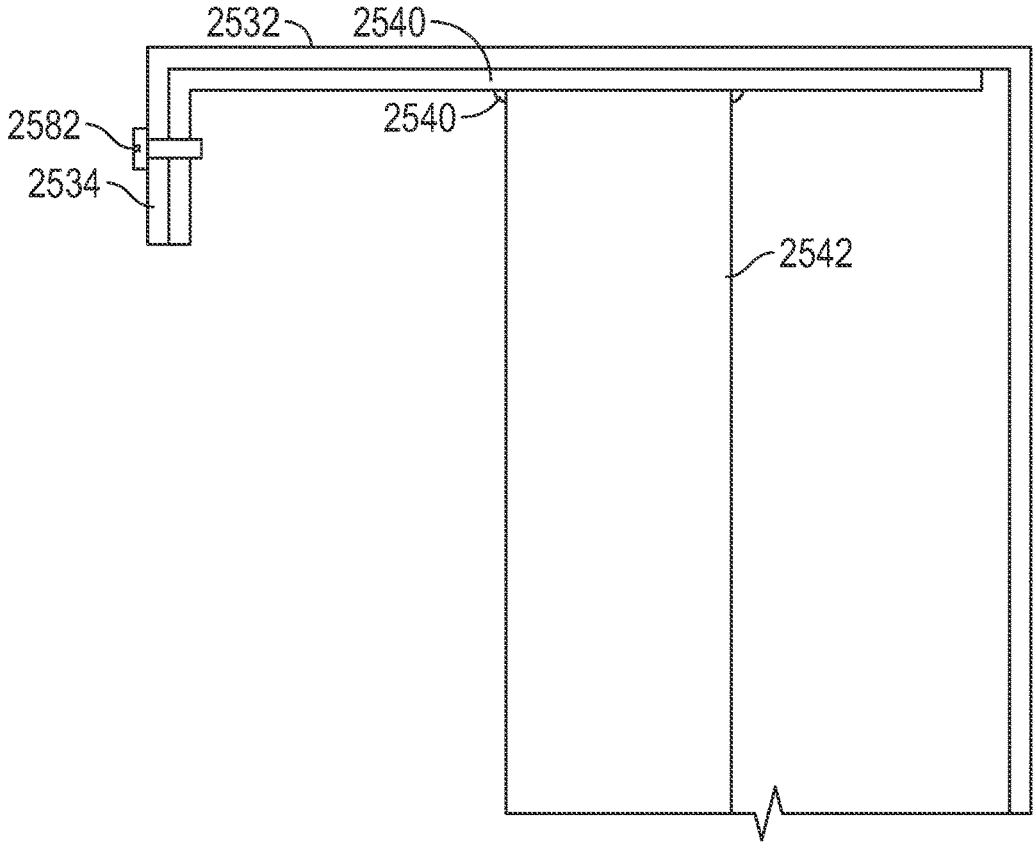

FIG. 32B is a cross sectional view of post mounting plate and trim cover horizontal top plate coupling in further detail.

Figure 33:
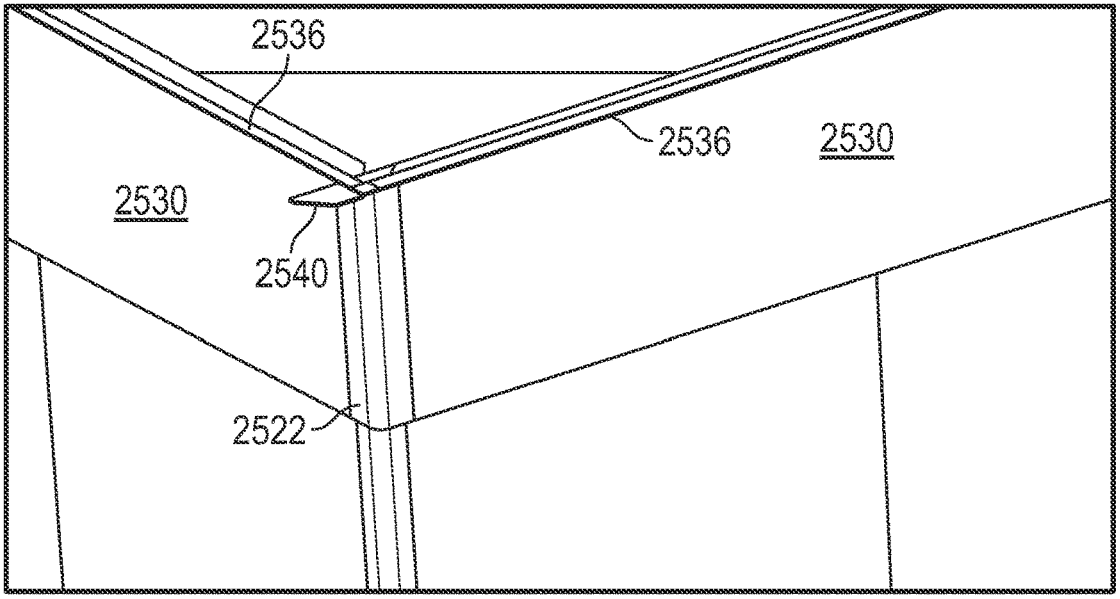

FIG. 33 is an outside perspective view of a trim cover and corner trim cover.

Figure 34:
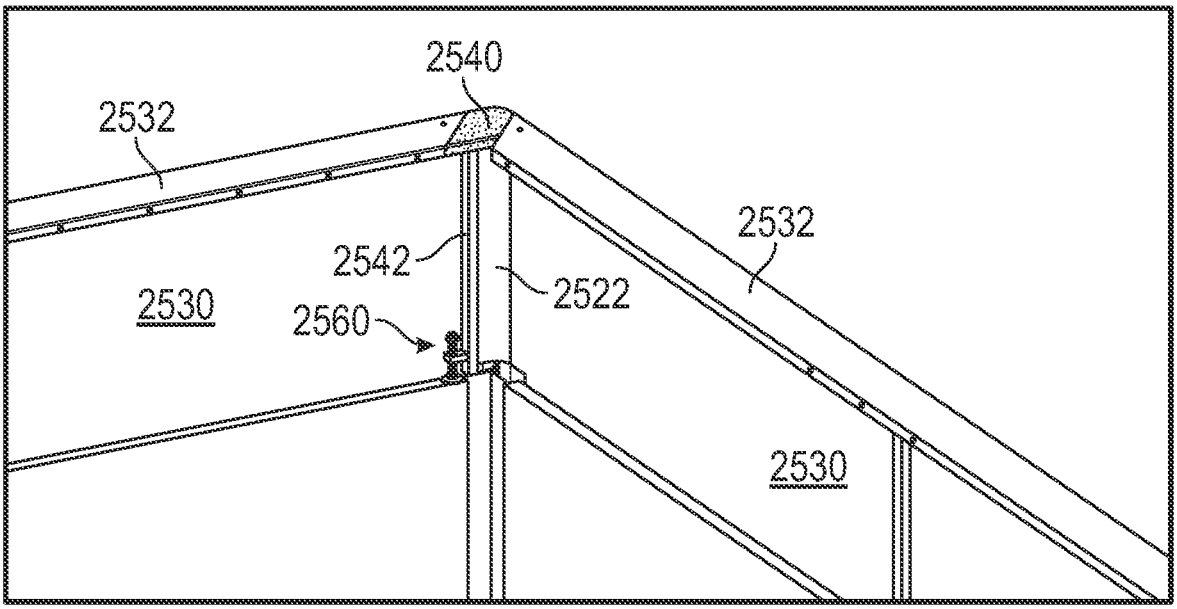

FIG. 34 is an inside perspective view of a trim cover and corner trim cover.

Figure 35:
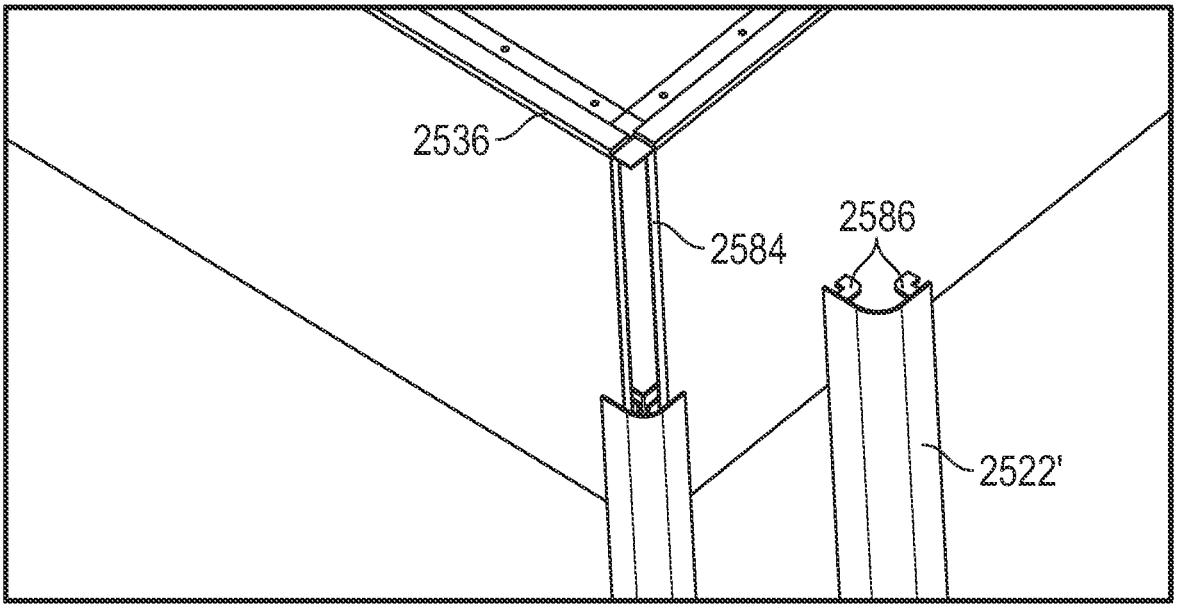

FIG. 35 is an outside perspective view of a trim cover and alternate corner trim cover.

DETAILED DESCRIPTION

Example embodiments will now be described more fully with reference to the accompanying drawings.

Figure 1A:
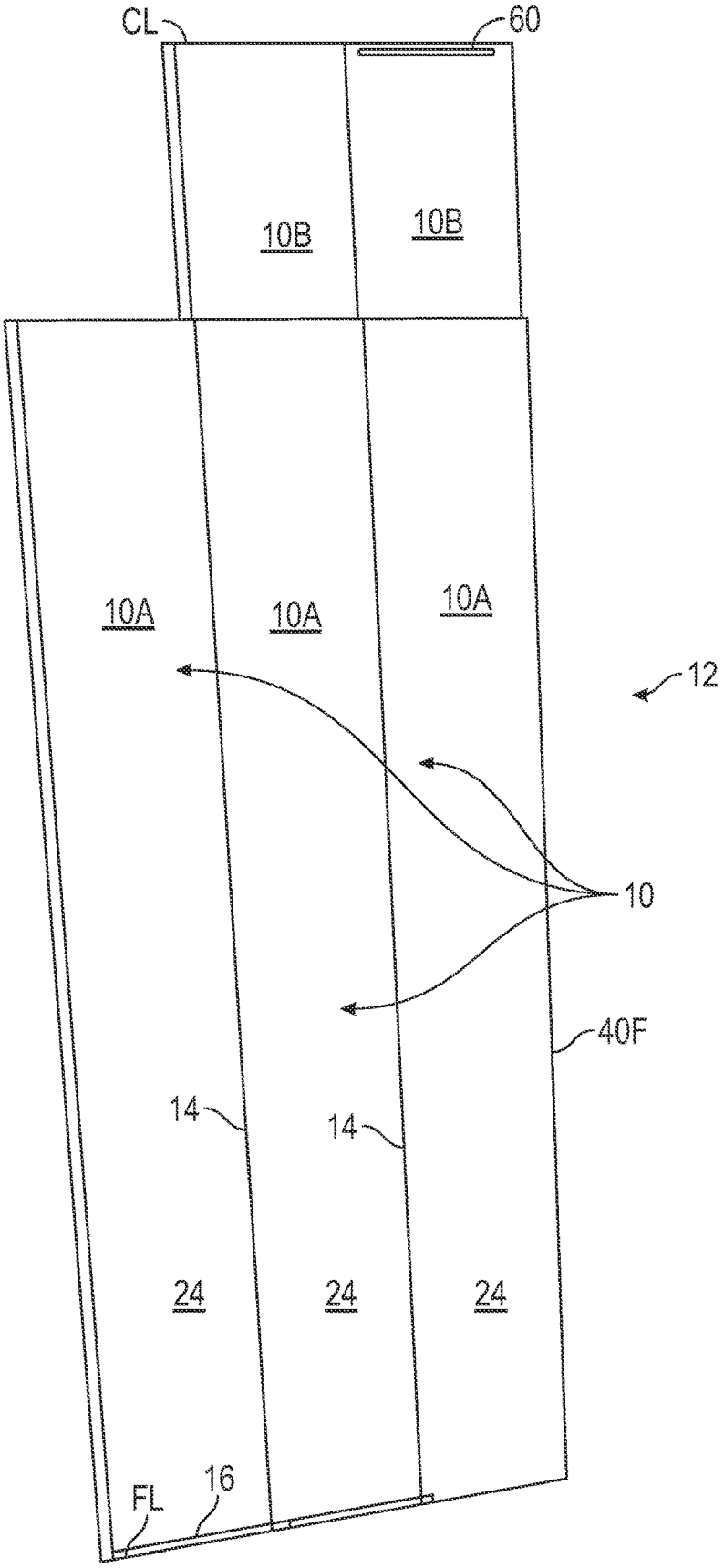
FIG. 1A is a front view of an extendable panel in an extended position.
Figure 1B:
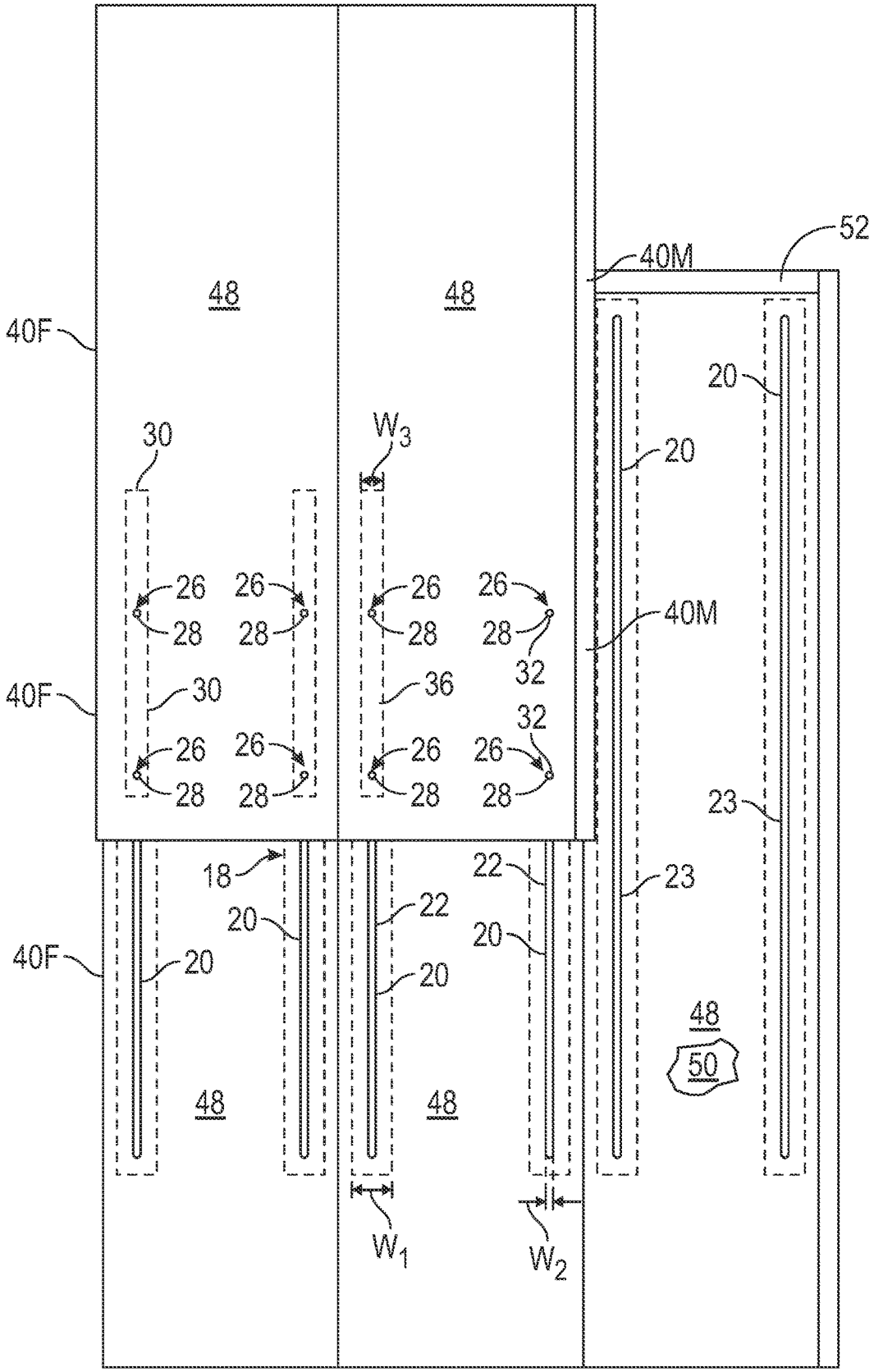
FIG. 1B is a rear view of the extendable panel in an un-extended position.

Referring now to FIGS. 1A and 1B, a front or finished-side view of a plurality of extendable wall panel assemblies 10 joined together to form a wall system 12 are illustrated. The "front" side provides a more finished look and is intended to be customer facing. However, the word front is meant as a reference to the more aesthetically pleasing side. Certainly, the back side may be customer-facing as well. The panel assemblies 10 each comprise and lower or front fixed panel 10A and an upper or back extendable panel 10B. The panel assemblies 10 are joined together and illustrated in an extended position. The leftmost upper panel (relative to the front side) is removed to illustrate the rear configuration. In use, the panel assemblies 10 are shipped assembled so that in a lowered position with the extendable panel 10B in a downward position. The extendable panel 10B may then be easily extended. The wall panel assemblies 10, when assembled, rest on the floor at the floor line FL or within a channel or lower track 16 on the floor line FL. An upper edge of the wall panel assemblies 10 are fastened to the building structure or ceiling denoted by ceiling line CL directly or using a track (not illustrated).

The words fixed and extendable are used to denote the in-use positions while being installed. The wall panel assemblies 10 are transportable and intended to be used as temporary walls that are fixed during use. Once positioned, the fixed panels 10A are into position and the extendable panels 10B are moved vertically into position they are fixed until removal.

The adjacent panel assemblies 10 form joints as will be further described below. Seams 14 are formed at the joints when assembled. The seams 14 are hardly noticeable when the panels 10 are assembled when the same finishing materials are used. In this example, three fixed panel 10As are joined together and therefore two seams 14 are shown. Two extendable panels 10Bs are joined together at a joint that form the seam 14. In FIG. 1A, the front view is illustrated. The front view corresponds to the view that faces away from the enclosed area and may have a more finished look. In many examples, the panels are used for blocking a construction area. The front view illustrated in FIG. 1A faces outward while the rear view in FIG. 1B faces the construction or blocked off area.

In FIG. 1B, the extendable panels 10B are partially extended. The amount of extension may vary based on the final use and the physical structure into which the wall systems will be formed. The height of fixed panels 10A may vary. As well the height of the extendable panels 10B may vary. Coupling mechanisms 18 also govern the amount of extendibility of the extendable panels 10B of the wall panel assemblies 10.

The coupling mechanisms 18 are hidden in the front view in FIG. 1A and at least partially hidden in the rear view of FIG. 1B. The fixed panels 10A have a plurality of slot tubes 20 with elongated slots 22 that are recessed within each of the fixed panels 10A. The slot tubes 20, in this example are square tubes having a width W1. The slot tubes 20 may extend the entire height (length) of the fixed panels 10A. Although the length maybe limited to about the length of the slots 22. Slots 22 in the slot tubes have a width W2 less than the width of the slot tubes 20.

As will be described in more detail below, the extendable panels 10B have fastener receivers 26 embedded therein. The fastener receivers 26 receive fasteners 28 and are described in greater detail below. The fastener receivers 26 may be formed in square bars 30 embedded within the extendable panels 10B. Holes 32 in the extendable panels 10B through the square bars 30 are used to secure a clamp bar 36 within the slot tube 20 by the fasteners 28 that are received within the holes 32. The holes 32 allow the fasteners 28 to be recessed therein. A description of the clamp bar 36 will be provided in more detail below. The clamp bar 36 is received within the slot tube 20. The clamp bar 36 has a width W3 that is less than W1 to allow the clamp bar 36 to move freely within the slot tube 20 when desired. In the fixed position, the fasteners 28 are tightened so that the clamp bar 36 is drawn or forced against the surface of the slot tube 20 having the slot 22. To move the extendable panel 10B, the fasteners 28 are loosened so that the clamp bar 36 is no longer secure. In this manner, the extendable panel 10B may be raised and lowered and the secured into place.

In general, each fixed panel 10A and extendable panel 10B has edge joiners on the vertically extending edges. A male edge joiner 40M is one edge and a female edge joiner 40F is on the other side of each panel 10A, 10B. When assembled, the male edge joiner 40M is inserted into the female edge joiner 40F of the respective fixed panel 10A or extendable panel 10B. In this example, the extendable panel 10B and the fixed panel 10A both have the male edge joiner 40M located on the same edge of the panel. The female edge joiner 40F has a female receiver on both the extendable panel 10B and the fixed panel 10A. The interaction of the male edge joiner 40M end and the female edge joiner 40F allow the extending panel to extend relative to adjacent extending panels.

In one example, the male edge joiner 40M and the female edge joiner 40F are formed from extruded aluminum with machining in certain areas. The female edge joiner 40F forms a rectangular C-shaped or U-shaped channel that extends in the vertical direction when assembled. Likewise, the slot tubes 20 and the bar 30 may be extruded.

In this example, the wall panels 10A and 10B have two outer layers or skins 458 with a foam layer or core layer 50 therebetween. The core layer 50 is a low-density material to make the walls lighter. Examples of the core layer 50 include but are not limited to foam made from expanded polystyrene (EPS), isocyanurates, polyethylene and urethanes The outer layers or skins 48 may be planar and formed of acrylonitrile butadiene styrene (ABS) or another type of polymer, aluminum, paper or other materials. By forming the outer layer or skins 48 of plastic or aluminum, the outer layers or skins 48 become durable, washable and may be printed with graphics.

Referring now to FIGS. 2A-2D, various views of the fixed panel 10A are illustrated. The outer layer or skins 48 covers the female edge joiner 40F and partially covers the male edge joiner 40M and the other components of a panel 10A. Adhesive may be applied to the skins 48 to stabilize the panel and hold the components together. Details of the male edge joiner 40M and female edge joiner 40F will be illustrated in further detail below. FIG. 2A is a front view of the fixed panel 10A. FIG. 2B is a rear view of the fixed panel 10A. The pair of slots 22 extend through the skin 48 and into a slot tube 20 that is secured within the fixed panel 10A. A lubrication area 52 may be provided for placement of glide tape or other lubricating tape. The lubrication area 52 may comprise nylon, Teflon® or another lubricating component so that the panel 10B when extending is not bound and moves freely. In a specific example, a strip or strips of glide tape are located at the back side of the fixed panel 10A near the top edge. Glide tape may be used on various joining or facing surfaces to promote movement of the upper and lower panels.

FIG. 2C is top view of the fixed panel 10A. The slot tubes 20 are illustrated as separate components from the edge joiners 40M, 40F. However, the slot tubes 20 and edge joiners 40M, 40F may be integrally formed in a monolithic structure with a common wall as described below. FIG. 2D is a side view of the fixed panel 10A at the female edge joiner end. In one example the panel 10A was constructed to be 90 inches tall and 48 inches wide. The male joiner 40 may have one or more channel openings 54 to facilitate assembly as described below.

Referring now to FIGS. 3A-3D, various views of an extendable panel 10B are illustrated. In this example, the front view, in FIG. 3A, may have a lubrication area (e.g., glide tape) in various locations around the bottom edge and partially on the side edge to facilitate movement between the front of the extendable panel 10B and the back of the fixed panel 10A. In this example, two vertical lubrication areas 56A, 56B are disposed adjacent to the edges of the panel 10B and a horizontal portion 56C is disposed at the bottom of the panel between lubricating areas 56CA and 56B. As illustrated, the back of the fixed panel 10A may have larger holes 32 than the holes 58 in the front of the extendable panel 10B. The larger holes 32 in the back of the extendable panel 10B may allow a screw head to be at least partially recessed therein. The holes 58 receive the shaft of the fasteners FIG. 3A is a front view of the extendable panel 10B. FIG. 3B is a back view of the fixed panel 10A. FIG. 3C is a top view of the fixed panel 10A and FIG. 3D is a side view of the fixed panel 10A at the female side.

As is best shown in FIG. 3B, a horizontal slot 60 may be formed in an upper cross member 62. The slot 60 may be used to receive a bracket or fastener for securing the wall panel assembly to a structure of the building.

FIGS. 4A, 4B and 4C show respective front side and top views of the wall panel assembly 10 is shown in a minimum height condition. That is, the extendable panel 10B is lowered to a position not extending above the top edge of the fixed panel 10A. In the position illustrated in FIGS. 4A-4C, the wall panel 10B may be easily lifted to the positions illustrated below in FIGS. 5A-5C.

FIG. 4D is an enlarged portion of the male edge joiner 40 having the channel opening 54. In this example, the channel opening is a generally C-shaped slot having a first horizontal portion 54A, a second horizontal portion 54B and a vertical portion 54C extending therebetween. In FIG. 4E is a top view of the fixed panel 10A joined to the extendable panel 10B. The extensions 64M are protrusions that extend inward in the direction of the thickness from the outer walls of the female joiner 40F. The extensions 64 are aligned opposite to each other collinearly, in this example.

During assembly the female edge joiner 40 of one panel may be brought to the male edge joiner 40M of another panel or vice versa. The extensions 64 are aligned with one of the horizontal portions 54A or 54B. If the male edge joiner 40M is being moved, the bottom horizontal portion 54B may be aligned with the extension 64. The extensions 64 positioned in the vertical portion 54C as the panel assembly 10 being moved is lowered onto the stationary wall panel assembly. If the wall panel assembly with the female side is being moved, the extensions 64 are aligned with the upper channel portion 54A so that as the end with the female joiner 40M of the panel assembly is lowered, the extensions 64 are moved into the vertical portion 54C. The extendable panels 10B may not include channel opening to allow maximum flexibility in the panel positions.

The clamp bar 36 is shown received within the slot tube 20 and adjacent to the wall within the slot tube 20 closest to the extendable panel 10B in a locked position. The slot tube 20 with the clamp bar 36 is directly adjacent to the female edge joiner 40F. On the other end of the panel 10A, the clamp bar 36 is adjacent to the male edge joiner 40M is configured in in a similar manner.

Referring now to FIG. 4F, the coupling mechanism 18 for the fixed panel 10A and extendable panel 10B is shown. In this example, the extendable panel 10B has a solid frame portion or bar 30 that has a channel that is described as holes 32/54 therethrough. A head 28A of the fastener may be countersunk into the bar 30. The clamp bar 36 is drawn toward the head 28A of the fastener 28 when the threads 36A of the clamp bar 36 engage the threads 28B of fastener 28. By pulling the clamp bar 36 toward the head 28A of the fastener 28, the clamp force on the bar 30 in FIG. 4F is in the direction toward the back of the panel and thus the upper panel 10B is held against the lower panel 10A and the position is thereby maintained.

Referring now to FIGS. 5A-5C, the extendable panel 10B is illustrated at a maximum height relative to the fixed panel 10A. The views illustrated in FIGS. 5A-5C correspond generally to FIGS. 1A and 1B with only one panel illustrated. Slots 22 illustrated in FIG. 5B extend through both the skin 48 and into slot tubes 20. The fasteners 28 move vertically in the slots 22 and lock the extendable panel 10B in place.

Referring now to FIGS. 6A-6B, the fixed panel 10A is illustrated with the skins 48 removed. A top tube 70 and a bottom tube 72 are illustrated, which are square in this example. Slot tubes 20 extend between the top tube 70 and bottom tube 72 in a vertical direction. The horizontal slot 60 is formed in the top tube 70. Slots 22 are formed in the slot tubes 20 and are less than the width of the slot tubes 20. Each of the female edge joiner 40F and male edge joiner 40M are directly adjacent to the slot tubes 20 on each edge of the panel 10A. The slot tubes 20 are exposed so that the clamp bar 36 may be received therein during assembly as described in more detail below. The perimeter of the panel assembly has the top tube 70 and bottom tube 72 as well as a female edge joiner 40F adjacent to the slot tube 20 as well as a male edge joiner 40M adjacent to a slot tube 20. The male edge joiner 40M and female edge joiners 40F are provided at respective vertical edges of the fixed panel 10A.

Referring now to FIGS. 7A-7B the extendable panel 10B is illustrated. The extendable panel 10B is formed in a similar manner to that described above with respect to the fixed panel 10A. That is, the top panel 10B has male edge joiners 40M and female edge joiners 40F disposed on opposite vertical edges. Lower frame solid bars 30 are directly adjacent to the male edge joiner 40M and female edge joiner 40F. Ultimately, the holes 32, 58 that form channels 66 illustrated in FIG. 1B are drilled or formed into the upper frame solid bars 30 to receive fasteners therein. A top tube 74 and bottom 76 coupled to the upper frame solid bars 30. The top tube 74 has the horizontal slot 60. Two horizontal slots 60 may be provided, one on the front side and one on the rear side.

Referring now to FIG. 8, a perspective view of the female edge joiner 40F is shown. The female edge joiner 40 is essentially a C-shaped or U-shaped channel. Holes 64A are at the position where the extensions 64 are attached. The extensions 64 may be welded, press fit, glued or screwed into the holes 64A. The position of the holes 64A is such that when two adjacent wall panels are assembled the extensions align with the channel openings 54, and more specifically to the vertical portion 54C to assist in securing the female edge joiner 40F to the male edge joiner 40M.

Referring now to FIGS. 9A-9C a perspective view, a side view, a bottom view of the male edge joiner 40M is illustrated to show the details of the channel openings portions 54A-54C. In one example the width of the openings were 0.5 inches. As is illustrated in FIG. 9C, both the front and back side of the male joiner 40M has a channel opening 54. In this example, a total of four channel openings 54 are set forth.

Referring now to FIG. 10, the top tubes 70, 74, bottom tubes 72, 76 may be made of a rectangular, and more a specifically square hollow tube 1010 and sized to the proper dimension.

Referring now to FIGS. 11A-11D, a respective view of the clamp bar 36 is illustrated. The clamp bar 36 has receiving openings 1110 for receiving the fasteners 28. The size of the clamp bar 36 is sized to be received within the slot tubes 20. That is, the inside of the slot tubes 20 is just larger than the width of the clamp bar 36 so that the clamp bar 36 may be moved within the slot tube 20. The clamp bar 36 may also include an end opening 1112 disposed in an end of the clamp bar 36. The openings 1110 and 1112 may be threaded.

Referring now to FIG. 12, a perspective view of the foam or core layer 50, a front view and an edge view of the foam core of an upper panel is illustrated. The upper panel 10B is illustrated as a one-inch-thick foam panel having foil skin 1210.

Referring now to FIGS. 13A-13D, a respective perspective view, side view, an end view and a top view of the slot tube 20 are illustrated respectively. The slot tube 20 is essentially a square tube which, in this example, is a one-inch square tube that has channel 1310. The slot 22 having a width of about 5/16", in this example is used. The inside distance (length and width) of the slot tube 20 forms the channel 1310 that is sized to allow the clamp bar 36 to be received and move therein when the extendable wall panel 10B is positioned. The width of the slot 22 allows the fasteners 28 to travel therein when positioning the extendable panel 10B. The slot 22 may be made different lengths depending upon the desired position of the upper or extendable panel 10B relative to the lower panel 10A.

Referring now to FIGS. 14A-C, a perspective view of the solid bar 30 is illustrated. These may be used as the upper frame solid bars 30 illustrated in FIG. 7B. The holes 33, 58 that form the channels 66 are formed therethrough and are space apart to align with the openings 1110. The channels 66 receive the fasteners 28 and may be drilled or formed therethrough.

During assembly, the core layer 50, the solid bars 30 for the upper panel and the joiners 40F, 40M may be laid out and covered with an outer layer or skin 48 to hold the assembly together. The same procedure may be used to form the lower panel 10A. However, the upper frame solid bars 30 are replaced with the slot tube 20. After assembly, the skin 48 over the slot of the slot tube 20 may be opened by a routing type process. The panel 10A may be laid out horizontally and the clamp bar may be inserted from the top with the holes 32, 58 and channels 66 in the clamp bar 36 aligned with the slots 22. The extendable panel 10B frame may be positioned so that the holes that extend therethrough are aligned with the openings 1110 in the clamp bar 36 so that the fasteners 28 may be received in the clamp bar 36. That is, each clamp bar 36 at each end of the panel 10A may have two fasteners that are coupled thereto. The assembled wall panel assembly 12 may be shipped in a position where the extendable panel 10B is in the lowermost position.

Referring now to FIG. 15, a partial cutaway view of a male edge joiner inserted into a female edge joiner is set forth. In this example, a female edge joiner has an inward extension, one of which is shown. In a constructed embodiment, two inward extensions are provided. The extensions may be formed directly in the material of the female edge joiner or as separate component, such as rivet or another type of fastener that extends inward into the female edge joiner. The male edge joiner has a cutaway portion that has a horizontal part. The inward extension or extensions align with the horizontal part of the cutaway portion during the initial phase of assembly. Then, the vertical part of the cutaway portion or channel engages the inward extension. In this example, the female edge joiner and the panel associated with the female edge joiner is lifted so that the inward extension aligns with the horizontal part of the cutaway portion. Horizontal motion of the panel having the female edge joiner part allows the inward extension to move horizontally within the horizontal part of the cutaway portion until the end of the horizontal part is reached. At this point, the female edge joiner fully is coupled to the male edge joiner. The panel with the female edge joiner is lowered into position on the floor and the inward extension moves downward in the vertical part. This allows the wall panels to be maintained and not come apart.

Referring now to FIGS. 15 and 16 as well as FIG. 4D, the channel opening 54 is illustrated. The channel opening 54, as described above are C-shaped. The channel opening 54 is formed in and through a surface of the male edge joiner 40M. Each side of the male edge joiner 40M (toward the front and rear of the panel when assembled) have a male edge joiner 40M. In this example, four channel openings 54 are used on each male edge joiner. However, more or fewer channel openings 54 may be used. In this example, two channel opening portions 54A, 54B and two inward extensions 64 are provided at one location on the male edge joiner 40M. The inward extensions 64 extend inward from the female edge joiner 40F and engage the channel opening portion 54A or 54B and 54C during assembly. Because the portions 54A, 54B of the channel opening 54 is in the curved portion, as the male edge joiner 40A is inserted into the female edge joiner 40F, the inward extension 64 is received in one of the horizontal portions 54A, 54B. The horizontal portions 54A, 54B are separated by a vertical portion 54C of the channel opening.

During assembly, the panel 10A with the female edge joiner 40F may be received in the uppermost horizontal portion 54A, inserted, then slid downward by moving the panel 10A downward within the vertical portion 54C of the channel portion 54. That is, the inward extension 64 moves from the horizontal portion 54A to which it is moved into the vertical portion 54C. Assembly may also take place by lifting the panel with the male edge joiner 40M and inserting the inward extension 64 into the vertical portion 54C at the lowest extent of the channel opening 54 and horizontally moving the male edge joiner 40M into the female edge joiner 40F where the vertical portion 54C may be engaged with the inward extension of the female edge joiner 40F in the channel opening.

The wall panel assembly 10 may be shipped having the extendable panel 10B in a completely retracted position as illustrated in FIGS. 4A-4BC. The fasteners 28 may secure the clamp bars 36 into the slot tubes 20 to prevent movement. Upon loosening the fasteners 28 at the clamp bars 36, the upper panel 10B with the male edge joiner 40M and female edge joiner 40F may be positioned into place in the desired height as shown in FIGS. 5A-5C. Once the height is secured by fasteners 28 an adjacent panel may be aligned and coupled together. Some of the male edge joiner features such the C-shaped channel openings 54 and the extensions 64 on the female edge joiners 40F may be used. Securing the height of the upper panels 10B may be performed before or after the panels are secured to an adjacent panel.

Referring now to FIG. 17, the building structure having a ceiling line CL, a floor line FL and two wall lines WL are illustrated. In this example, a plurality of wall panel assemblies 10 are used to form the wall system 12. In this example, a female starter trim panel 18A is illustrated in the left side of the illustration. A male starter panel 1910 is illustrated on the right side of the wall system 12. Because of various structural limitations, the larger width wall panel assemblies 10 may not entirely fit. Therefore, the starter trim panels 1810 and/or 1910 may be used on one or either side of the wall system to accommodate and completely seal the wall system 12 in place. A single door panel assembly 2210 having a fixed panel 2210A and an extendable panel 2210B is set forth. A door 2212 provides access to the space beyond the wall system 12. Further details of the trim panel assemblies and the door assembly are provided below.

Referring now to FIGS. 18A-18D, a female starter panel 1810 is illustrated. The female starter panel 1810 is used when the female side is directly against an adjacent wall. The female starter panel 1810 is shown having an extendable portion 1812 and a fixed portion 1814. The fixed portion 1814 and the extendable portion 1812 are configured in the manner described above relative to the slot tubes 20 and the edge joiners 40F. That is, rather than separate components, the slot tubes 20' and the female joiner 40A are integrally formed in an integrated monolithic structure. Because the slot tube 20' and the female edge joiner 40F' are integrally formed, they have a common wall therebetween as is best illustrated in FIG. 8B. The female starter panel 1810 also have compliant material 1820 extending from the upper portion 1812 and the lower portion 1814. The compliant material 1820 may be cut to size to fill the gap between the wall system 2512 and the existing structure. That is, the amount the compliant material 1820 extends from the female edge joiner 40F may vary. In one example, the compliant material 1820 extends about six inches from the female edge joiner but may be trimmed to size as desired. The compliant material 1820 may be foam, foam rubber or other material suitable to form a seal with the adjacent wall or building structure.

The compliant material 1820 is disposed in a compliant material receiver 1822 that is also integrally formed with the slot tube 20' and the female edge joiner 40F'. It should be noted that the slot tube 20' and the female edge joiner 40F may be integrated together and used in any of the examples set forth above. That is, the receivers 1822 may be eliminated if the integrated slot tube 20' and female edge joiner are integrated in one of the examples set forth above.

Referring now to FIGS. 19A-19E, a male starter panel 1910 is set forth. The male starter panel 1910 has the slot tube 20' and the edge joiner 40M" formed as an integral structure. Compliant material 1820 similar to that illustrated above may be formed in a compliant material receiver 1922. That is, the compliant material receiver 1922 may be used to receive one or more pieces of compliant material 1820 to accommodate any gaps on the female side of the wall system 12. The male edge joiners 40M" insert in a female edge joiner. The male starter panel 1910 includes an extendable portion 1912 and a stationary portion 1914. The slot 22 is formed with in the slot tube 20" which is integrally formed with the male edge joiner 40M.

Referring now to FIGS. 20A and 20B, an edge joiner 2010 used for outside corners of a wall system is illustrated. In this example, the corner is 90° however other angles may be formed in a similar manner. The edge joiner 2010 has a male portion 2012 on a stationary side of the edge joiner 2010 and a male portion 2014 on the extendable portion of the edge joiner 2010. A female portion 2016, having extensions 2018, is formed on the stationary side while the female portion 2020 is formed on the extendable portion. The system operates in a similar manner to that described above in that a fastener 2028 may extend into a fastener receiver 2030 to secure the extendable portion relative to the fixed portion.

Referring now to FIGS. 21A and 21B, an inside corner assembly 2110 is illustrated having a male portion 2112 and a female portion 2114 on a fixed portion 2116. On a movable portion 2118, a male portion 2120 and a female portion 2122 are formed. A fastener 2128 is received in a fastener receiver 2130 in the stationary portion 2116. The assembly of the corners is similar in that the extensions 2134 engage the channel opening portions 54A or 54B and 54C.

Referring now to FIGS. 22A and 22B, a wall panel assembly 2210 having a door 2212 built therein is illustrated. The fixed wall panel 2210A is formed in a similar manner to the fixed wall panels 10A described above but includes a door opening and a door coupled thereto. The extendable panel 2210B has a plurality of removable filler panels 2220 coupled thereto. The filler panels 2220 are removably coupled as will be described in more detail below. The filler panels 2220 extend between vertical subportions 2222 of the extendable panel 2210B. A horizontal sub-panel portion 2224 extends between the vertical sub-panel portions 2222. Slot tubes with slots 22 may be used in a similar manner as well as the fasteners 28 for fixing the extendable panel 2210B.

Referring now to FIG. 22C, a cross sectional perspective view of the removable panels 2220 is illustrated. In this example, a female channel on each side of the vertical sub-panel portions 2222 are vertical edge channels 2240. The female-channel vertical edge channels 2240 receives male joiners 2242 formed at each end of the removable panel 2220 (or the panel themselves without joiners 2242 illustrated in FIGS. 24A and 24B below).

Referring now also to FIG. 22D, the removable panels 2220 may also have a recess 2244 thereunder. The bottom filler panel 2220 may be retained in place by a latch 2250. The latch 2250 has a latch body 2252 and a handle 2254 that moves a latch panel 2256 into and out of a recess 2258 of the channel 2240. Although only one latch 2250 is illustrated, a latch 2250 may be disposed at each end of the filler panel 2220 and configured in a similar way. As the extendable panel 2210B is lowered, filler panels 2220 that are blocking the opening of the door 2212 the bottom filler panel may be removed and the latch or latches 2250 may be reinstalled. The filler panels 2220 may be slid to the bottom of the extendable panel 2210B and removed, one by one until the door opening is clear. That is, the bottom filler panel changes as the lowermost filler panel is removed. Because the filler panels 2220 are made of the same materials as the panels 2210A, 2210B, they are light and can be easily moved and removed.

Referring now to FIGS. 23A-23D, a double door panel assembly 2310 is illustrated. The double door panel assembly 2310 has two doors 2312. A fixed portion 2310A has an extendable portion 2310B that extends therefrom. In the example set forth in FIGS. 22 and 23, because the ceiling height or the coupling height of the extendable panels 2210B and 2310B are unknown, the removable panels 2220 and the removable panels 2320 may be removed from the bottom so that from the front view, there are no gaps in the system. As the extendable panels 2210B and 2310B are lowered, the panels 2220 and 2320 may be removed from the bottom up to provide a complete closure.

Referring back to FIGS. 23A-23D, the double door assembly 2310 may be formed of two halves joined together at a joiner 2330. The joiner 2330 includes a nail portion 2332 and a female portion 2334.

Referring now to FIGS. 24A-24B, an alternate style of filler panel 2410 is set forth. In this example, the wall panel assembly 2210 having the fixed panel 2210A and 2210B are formed the same as that set forth in FIGS. 22A-22C. However, the panels are formed of a thin plastic material and stamped metal having a face 2412 and flanges 2414. The latch 2250 is ultimately used to engage the panel 2410 proximate the flange 2414. The latch 2450 may be configured similar to the latch 2250 described above. The latches 2250 have the latch body 2252 and the handle 2254 used for removing the latch from the female channel 2240. It should be noted that in FIGS. 22-24, the fasteners 28 are used to secure the clamp bar (not shown) relative to the slots 22.

Referring now to FIGS. 25, 26A and 26B, an adjustable trim cover assembly 2520 is provided that allows for coarse and fine vertical adjustability for the wall system 2512. This is accomplished using a trim cover 2530 that is adjustably mounted to upper portion of the wall panel 10. A trim cover 2530 is vertically moved and secured in place, creating a pressure seal. The trim cover 2530 is coupled to an adjustment mechanism 2560 that moves a telescoping extension 2542 vertically to allow the wall system 2512 to look finished at various ceiling heights.

In FIG. 25, a plurality of assembled wall panels 2510 are illustrated to form a wall system 2512. The wall panels 2510 have seams 2514 that are formed at joints between adjacent wall panels 10. The wall panels 10 may be various sizes. In a commercial example, the lengths may be standardized such as 4 feet, 8 feet, and 16 feet, although another length can be used. The seams 2514 may also vary in length. For example, 2 foot to 16 foot high panels may be used.

In the present example, separate male and female joiners are illustrated that are used for joining the wall panels. The joiners are mostly concealed in FIG. 25. However, in FIGS. 28A, 28B, the joiners will be described in further detail.

In FIGS. 25, 26A and 26B, an adjustable trim cover assembly 2520 may adjust vertically so that the adjustable trim cover assembly 2520 may be disposed against a ceiling of the building. A corner trim cover 2522 is also illustrated to complete the finished look of the adjustable trim cover assembly 2520 of two adjacent panels 2510. The adjustable trim cover assembly 2520 may be formed of aluminum or another material. Likewise, the corner trim cover 2522 may also be formed of the same material as the adjustable trim cover assembly 2520 or a different material. The formation of the corner of two walls will be described in further detail below.

Referring now to FIGS. 27A and 27B, the adjustable trim cover assembly 2520 is illustrated having a trim cover 2530 having a finished surface 2524. The finished surface 2524 is placed toward the side customers or the public view. The rear side 2526 illustrated in FIG. 27A is the cordoned off or construction area. The vertical height of the trim cover is adjustable to accommodate different ceiling heights of a building as indicated by arrows 2528. The trim cover 2530 may have a horizontal top plate 2532 and a flange 2534 formed therein. The horizontal top plate 2532 extends parallel to the ceiling CL and is perpendicular to the trim cover 2530 in the present example. The flange 2534 may also be formed in the trim cover 2530. The flange 2534, as will be described in more detail below, may have a plurality of holes for receiving a screw or fastener.

The horizontal top plate 2532 may have a closed cell foam seal 2536 between the ceiling CL and the horizontal top plate 2532 to further increase the sealing of the system. The closed cell foam may be a thickness to allow accommodation of locally uneven ceilings. Dust and noise transfer between sides of the wall is reduced by providing a closed cell foam seal between the horizontal top plate and the ceiling.

A post mount plate 2540 is coupled to an adjustable extension 2542, which in this example is a square tube that is adjustably received into a receiving channel 2550 within the wall panels 2510. As will be described in FIG. 28, the receiving channel 2550 may be disposed in a joiner that is used for coupling two adjacent wall panels 10 together. The adjustable extension 2542 has a plurality of horizontally disposed receiving holes 2552 for coarse adjustment of the height of the trim cover. A rough adjustment block or coarse adjustment plate 2554 is inserted into one of the receiving channels 2550 to roughly adjust the height of the trim cover 2530 relative to the ceiling CL. The adjustment mechanism 2560 has a fine adjustment screw 1562 or tensioner that is moved or rotated to adjust the height of the adjustable extension 2542 and thus the horizontal top plate 2532 of the trim cover 2530 into the desired position. The adjustment mechanism 2560 has the threaded fastener or fine adjustment screw 2562 that moves relative to the coarse adjustment block 2554 in the vertical direction. By rotating the fine adjustment screw 2562, movement relative to rough adjustment block is performed. The fine adjustment screw 2562 moves the adjustable extension 2542 into and out of the receiving channel 2550, which, in turn, causes the trim cover 2530 to move in the direction illustrated by the arrows 2528. A retaining nut 2564 is disposed on the fine adjustment screw 2562 and may be used to rotate the screw 2562.

Referring now to FIGS. 28A and 28B, adjacent wall panels 10 form a joint 2566 as illustrated. The wall panels 2510 are formed with an outer skin 2568 on each of the wall surfaces. The skins 2568 may be formed of acrylonitrile butadiene styrene (ABS) or another type of polymer. The skins 2568 in a constructed example had a density of about 1.07 $g/cm^3$+/−0.1. The skins 2568 in the constructed example are between 0.35 and 0.60 inches thick.

Between the skins 2568 is a high density foam core layer 2570. The high density foam core layer 2570, in constructed examples, had a density of about 2-4 $lbs/ft^3$. In the present example, expanded polystyrene (EPS) was used, although other suitable materials may be used. Other examples include but are not limited to isocyanurates, polyethylene and urethanes. The thickness of the wall panel including the skins and foam core in the constructed example is about 1.070 inches. However, other thicknesses and relative thicknesses may be used.

The joints in this example are formed by a pair of extrusions. A male extension (male joiner 2572) that is received by a female joiner 2574 to assist in maintaining the wall system 2512 in a predetermined position. Each end of the wall panel may have either a male joiner 2572 or a female joiner 2574. A seamless look is created when two adjacent wall panels 2510 are assembled and the adjacent surfaces are nearly flush. The opening 2576 in the female joiner 2574 may be referred to as a receiver. The receiver or receiver end receives the male extension 2578 or male end of the wall panel 10. The male extension 2578 is shaped to allow the panels to be easily assembled even though a slight misalignment occurs. The male extension 2578 may be referred to as a bullnose.

The joiners 2572, 2574 are coupled to their respective panels with adhesive or fasteners. The male extension 2578 of one panel is received in the female opening 2576 or receiver of the adjacent panel. In the present example, the female opening 2576 in thickness about 0.75 inches. The remaining thickness of the wall panel 2510 corresponds to female hip on each side of the opening. The female opening 2576 extends a distance or depth to accommodate the male extension 2578. The depth may be slightly larger than the male extension.

In FIG. 28A, 28B, joiners between two panels having different geometries as illustrated. In FIG. 28A, longer lateral surfaces are illustrated in the male joiner 2572. In FIG. 28B, the receiving channel 2550 is in the female joiner 2574.

Referring also now to FIGS. 29, 30A, 30B, 31, 32A and 32B, the adjustment mechanism 2560 is illustrated in further detail. As illustrated, the coarse adjustment plate 2554 may push against a load distribution plate 2580 as illustrated best in FIG. 30A through the fine adjustment screw 2562. The coarse adjustment plater is placed into a receiving hole 2552 to approximate the distance to the building structure. In this example the fine adjustment screw can accommodate smaller distances of or less than the distance between adjacent receiving holes 2552. The load distribution plate 2580 in this example is rectangular. However, another shape may be used. The load distribution plate 2580 is placed adjacent to the telescoping tube or extension 2542. However, the load distribution plate 2580 may also extend around or partially around the extension or telescoping tube. That is, an opening in the load distribution plate 2580 may receive the telescoping extension 2542 and allow the extension 2542 to move relative thereto. The load distribution plate 2580 may also be adjacent to the telescoping tube. In FIG. 30BB, the load distribution plate 2580' may be circular and have a diameter that is about the panel depth. The diameter of the load distribution plate 2580' may be slightly greater than the panel depth, the panel depth or slightly smaller than the panel depth. The load distribution plate 2580, 2581', in any example, distributes the load from the fine adjustment screw 2562 across the thickness or depth of the wall panel 2510. By moving the fine adjustment screw 2562, the threads 2562A force the coarse adjustment plate up 2554 or down which, in turn, forces the extension 2542 up or down. By moving the telescoping extension 2542, the post mounting plate illustrated in FIGS. 31 and 32, moves up and down which, in turn, moves the horizontal top plate of the trim cover vertically.

The post mount plate 2540 has a fastener surface 2540A to receive fasteners 2582 that extend through the flange 2534. The post mount plate 2540 extends wider than an opening between the flanges of two adjacent panels. A weld connection may bind the telescoping extension 2542 and the post mounting plate 2540. Of course, other types of fasteners may form the joint between the post mount plate 2540 and the telescoping extension 2542. When joined together, a portion of the post mount plate 2540 extends under the horizontal top plate 2532. Thus, the post mount plate 2540 supports the horizontal top plate 2532 and thus the adjustable trim cover assembly 2520 to the flange 2534. That is, the flange 2534 and the post mounting plate 2540 are directly adjacent so that they may be held together with the fasteners 2582. This is best illustrated in FIG. 32B.

Referring now to FIGS. 33-35, the corner trim covers 2522 of two adjacent wall panels 2510 forming a corner are illustrated. The trim covers 2522 come together at a corner trim cover 2522. A post mount plate 2540 at the corner is modified or trimmed at the job site or prior to the job site so that both trim covers at the corner are supported thereby. The adjustment mechanism 2560 is disposed at a corner adjacent to one of the walls. The adjustment mechanism 2560 thus can change the height of the trim cover in both portions of the corner. A removed piece of the post mount plate is illustrated. The gap between the trim covers is covered by the corner trim cover 2522.

In FIG. 35, an alternate corner trim cover 2522' is illustrated. A corner post 2584 engages tabs 2586 couple to and engage the top of the post 2584. The tabs 2586 hold trim cover 2522' to the desired position to enclose the corner. The foam seals 2536 in FIG. 35 are directly adjacent and thus the corner is also sealed between the ceiling and trim covers.

Example embodiments are provided so that this disclosure will be thorough and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below", or "beneath" other elements or features would then be oriented "above" the other elements or features. Thus, the example term "below" can encompass both an orientation of above and below. The device may be otherwise oriented (rotated 90° or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An extendable wall panel assembly comprising:

a first wall panel comprising;

a first core comprising a first surface and a second surface opposite the first surface;

a first edge joiner extending between the first surface and the second surface, the first edge joiner comprises a first male extension extending therefrom;

a second edge joiner extending between the first surface and the second surface parallel to the first edge joiner, the second edge joiner comprises a first female receiver disposed therein, a second wall panel slidably coupled to the first wall panel, said second wall panel comprising:

a second core comprising a third surface and a fourth surface opposite the third surface;

a third edge joiner extending between the third surface and the fourth surface, the third edge joiner comprises a second male extension extending therefrom;

a fourth edge joiner extending between the third surface and the fourth surface parallel to the third edge joiner, the fourth edge joiner comprises a second female receiver disposed therein; and a coupling mechanism comprising a first channel disposed in the first wall panel receiving a first clamp bar therein, a first fastener receiver disposed in the second wall panel and a fastener extending through the first fastener receiver and into the first clamp bar in the first channel.

2. The extendable wall panel assembly of claim 1 wherein the first channel is formed in a slot tube.

3. The extendable wall panel assembly of claim 1 wherein the first channel is integrally formed with the first edge joiner.

4. The extendable wall panel assembly of claim 1 wherein the first fastener receiver is integrally formed with the third edge joiner.

5. The extendable wall panel assembly of claim 1 wherein a third channel is integrally formed with the second edge joiner.

6. The extendable wall panel assembly of claim 1 wherein the first fastener receiver comprises a second channel disposed within the second wall panel.

7. The extendable wall panel assembly of claim 6 wherein the coupling mechanism further comprises a second fastener receiver disposed in the second channel for receiving a second fastener.

8. The extendable wall panel assembly of claim 7 wherein the first clamp bar receives the first fastener and the second fastener.

9. The extendable wall panel assembly of claim 1 wherein the first surface comprises a first planar skin, the second surface comprises a second planar skin, and wherein the first core is disposed between the first planar skin and the second planar skin.

10. The extendable wall panel assembly of claim 9 wherein the first planar skin and the second planar skin are composed of polymer.

11. The extendable wall panel assembly of claim 9 wherein the first core and the second core are composed of a high-density foam.

12. The extendable wall panel assembly of claim 11 wherein the high-density foam is composed of expanded polystyrene.

13. The extendable wall panel assembly of claim 1 wherein the first clamp bar comprises a rectangular cross section.

14. A wall system comprising:

a plurality of wall panel assemblies formed according to claim 1;

wherein the first male extension of a first wall panel of the plurality of wall panels is inserted into the first female receiver of a second wall panel of the plurality of wall panels.

15. The wall system of claim 14 wherein the first wall panel comprises a door disposed therethrough, said second panel comprising a first vertical sub-panel portion, a second vertical sub-panel portion and a horizontal sub-panel portion extending between the first vertical sub-panel portion and the second vertical sub-panel portion, wherein a distance between the first vertical sub-panel portion and the second vertical sub-panel portion is greater than or equal to a width of the door, a plurality of filler panels extending between first vertical sub-panel portion and the second vertical sub-panel portion.

16. The wall system of claim 15 wherein the first vertical sub-panel portion comprises a first vertical edge channel and the second vertical sub-panel portion comprises a second vertical edge channel.

17. The wall system of claim 16 wherein the plurality of filler panels is at least partially received in the first vertical edge channel and the second vertical edge channel.

18. The wall system of claim 17 wherein a bottom filler panel is secured to the first vertical edge channel by a first latch secured to the bottom filler panel.

19. The wall system of claim 17 wherein a bottom filler panel is secured to the first vertical edge channel by a first latch and a second latch secured to the bottom filler panel.

20. An extendable wall panel assembly comprising:

a first wall panel comprising;

a first core comprising a first surface and a second surface opposite the first surface;

a first edge joiner extending between the first surface and the second surface, the first edge joiner comprises a first male extension extending therefrom;

a second edge joiner extending between the first surface and the second surface parallel to the first edge joiner, the second edge joiner comprises a first female receiver disposed therein, a first channel receiving a first clamp bar therein;

a second channel receiving a second clamp bar therein;

a second wall panel slidably coupled to the first wall panel and second wall panel comprising:

a second core comprising a third surface and a fourth surface opposite the third surface;

a third edge joiner extending between the third surface and the fourth surface, the third edge joiner comprises a second male extension extending therefrom;

a fourth edge joiner extending between the third surface and the fourth surface parallel to the third edge joiner, the fourth edge joiner comprises a second female receiver disposed therein;

a third channel having a first fastener extending therethrough, said first fastener coupling the first clamp bar within the first channel; and a fourth channel having a second fastener extending therethrough, said second fastener coupling the second clamp bar within the second channel.

21. The extendable wall panel assembly of claim 20 further comprising a third fastener coupling the first clamp bar within the first channel and a fourth fastener coupling the second clamp bar within the first channel.

22. The extendable wall panel assembly of claim 21 wherein the first fastener and the third fastener extend into the first channel through a first elongated slot through the first channel.

23. The extendable wall panel assembly of claim 22 wherein the second fastener and the fourth fastener extend into the second channel through a second elongated slot through the first channel.

* * * * *